US009838777B2

(12) United States Patent
Kuwahara et al.

(10) Patent No.: US 9,838,777 B2
(45) Date of Patent: Dec. 5, 2017

(54) HEADPHONE AND ACOUSTIC CHARACTERISTIC ADJUSTMENT METHOD

(71) Applicant: SONY CORPORATION, Tokyo (JP)

(72) Inventors: Eiji Kuwahara, Tokyo (JP); Takahiro Suzuki, Saitama (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/034,748

(22) PCT Filed: Sep. 17, 2014

(86) PCT No.: PCT/JP2014/074582

§ 371 (c)(1),
(2) Date: May 5, 2016

(87) PCT Pub. No.: WO2015/076006

PCT Pub. Date: May 28, 2015

(65) Prior Publication Data

US 2016/0295315 A1 Oct. 6, 2016

(30) Foreign Application Priority Data

Nov. 19, 2013 (JP) ..... 2013-238582

(51) Int. Cl.
*H04R 1/28* (2006.01)
*H04R 1/10* (2006.01)
(Continued)

(52) U.S. Cl.
CPC ..... *H04R 1/2811* (2013.01); *G10K 11/178* (2013.01); *H04R 1/1008* (2013.01);
(Continued)

(58) Field of Classification Search
CPC .. H04R 1/2811; H04R 1/1008; H04R 1/1016; H04R 1/1041; H04R 1/2849; H04R 1/2857; H04R 3/04; G10K 11/178
See application file for complete search history.

(56) References Cited

U.S. PATENT DOCUMENTS 4,061,970 A * 12/1977 Magneron ..... H04B 3/10 333/18
4,538,706 A 9/1985 Koppensteiner
(Continued)

FOREIGN PATENT DOCUMENTS

JP 59-177287 U 11/1984
JP 62-141293 A 6/1987
(Continued)

*Primary Examiner* — Sonia Gay
(74) *Attorney, Agent, or Firm* — Chip Law Group

(57) ABSTRACT

[Object] To make it possible to further improve acoustic characteristics.
[Solution] There is provided a headphone including: a driver unit including a vibration plate; a housing configured to house the driver unit, to form an air-tightened front air chamber of which a part except for an opening for sound output is spatially blocked from the outside on a front side on which the vibration plate of the driver unit is provided, and to form a rear air chamber that has a predetermined capacity on a rear side that is the opposite side to the front side; and an acoustic tube provided in a partial region of a partition wall of the housing that constitutes the rear air chamber and configured to spatially connect the rear air chamber and the outside of the housing through a tube.

21 Claims, 28 Drawing Sheets

(51) Int. Cl.
*H04R 3/04* (2006.01)
*G10K 11/178* (2006.01)

(52) U.S. Cl.
CPC ..... *H04R 1/1016* (2013.01); *H04R 1/1041* (2013.01); *H04R 1/2849* (2013.01); *H04R 1/2857* (2013.01); *H04R 3/04* (2013.01)

(56) References Cited

U.S. PATENT DOCUMENTS

| | | | | |
|---|---|---|---|---|
| 4,646,872 | A * | 3/1987 | Kamon | H04R 1/225 181/129 |
| 4,742,887 | A | 5/1988 | Yamagishi | |
| 6,549,635 | B1 * | 4/2003 | Gebert | H04R 25/456 381/322 |
| 9,282,394 | B1 * | 3/2016 | Clark | H04R 1/1058 |
| 2007/0036385 | A1 * | 2/2007 | Harvey | H04R 1/2819 381/388 |
| 2008/0253604 | A1 * | 10/2008 | Yamagishi | H04R 1/2819 381/379 |
| 2012/0008804 | A1 * | 1/2012 | Bedwell | H04R 11/02 381/150 |
| 2014/0056455 | A1 * | 2/2014 | Sakaguchi | H04R 1/2811 381/328 |
| 2014/0226847 | A1 * | 8/2014 | Yang | H04R 1/1075 381/380 |

FOREIGN PATENT DOCUMENTS

| | | |
|---|---|---|
| JP | 03-184499 | 8/1991 |
| JP | 04-227396 A | 8/1992 |
| JP | 08-172691 A | 7/1996 |
| JP | 2003-179990 | 6/2003 |

* cited by examiner

HEADPHONE AND ACOUSTIC CHARACTERISTIC ADJUSTMENT METHOD

CROSS REFERENCE TO RELATED APPLICATIONS

This application is a U.S. National Phase of International Patent Application No. PCT/JP2014/074582 filed on Sep. 17, 2014, which claims priority benefit of Japanese Patent Application No. JP 2013-238582 filed in the Japan Patent Office on Nov. 19, 2013. Each of the above-referenced applications is hereby incorporated herein by reference in its entirety.

TECHNICAL FIELD

The present disclosure relates to a headphone and an acoustic characteristic adjustment method.

BACKGROUND ART

In general, headphones generate sounds when a driver unit that is disposed in a housing drives a vibration plate according to an audio signal to vibrate air. Here, acoustic characteristics of headphones are known to depend on a structure of a housing. Specifically, acoustic characteristics of headphones can change according to a volume of a space provided in the housing, a size of a vent hole that is formed in the housing and is capable of serving as a passage of air, a size of an opening that is formed on a partition wall of the housing and is capable of serving as a passage of air between the inside and the outside of the housing, and the like. Thus, there are a number of technologies proposed in relation to structures of housings in order to improve acoustic characteristics.

For example, Patent Literature 1 discloses a technology for improving acoustic characteristics by providing a tubular duct unit which spatially connects the inside and the outside of a housing on a rear side of the housing that is the opposite side to the side on which a vibration plate of a driver unit is provided.

CITATION LIST

Patent Literature

Patent Literature 1: JP H4-227396A

SUMMARY OF INVENTION

Technical Problem

However, demands for acoustic characteristics, e.g., for emphasis of an output of sounds of a lower register, and the like, differ according to applications of headphones. Thus, a desired acoustic characteristic is not necessarily obtained when the technology disclosed in Patent Literature 1 above is applied to headphones.

Therefore, the present disclosure proposes a novel and improved headphone and acoustic characteristic adjustment method which can further improve acoustic characteristics.

Solution to Problem

According to the present disclosure, there is provided a headphone including: a driver unit including a vibration plate; a housing configured to house the driver unit, to form an air-tightened front air chamber of which a part except for an opening for sound output is spatially blocked from the outside on a front side on which the vibration plate of the driver unit is provided, and to form a rear air chamber that has a predetermined capacity on a rear side that is the opposite side to the front side; and an acoustic tube provided in a partial region of a partition wall of the housing that constitutes the rear air chamber and configured to spatially connect the rear air chamber and the outside of the housing through a tube.

According to the present disclosure, there is provided an acoustic characteristic adjustment method including: housing a driver unit that includes a vibration plate in a housing, forming an air-tightened front air chamber of which a part except for an opening for sound output is spatially blocked from the outside between the housing and a front side on which the vibration plate of the driver unit is provided, and forming a rear air chamber that has a predetermined capacity on a rear side that is the opposite side to the front side; and providing an acoustic tube provided in a partial region of a partition wall of the housing that constitutes the rear air chamber and configured to spatially connect the rear air chamber and the outside of the housing through a tube.

According to the present disclosure, by providing an acoustic tube that spatially connects a rear air chamber in a housing and the outside of the housing through a tube, a parallel resonance circuit is formed at least with capacitance that corresponds to the volume of the rear air chamber and inductance that corresponds to an inductance component with respect to a flow of air of the acoustic tube in an acoustic equivalent circuit. Thus, a sound pressure level characteristic can be adjusted using anti-resonance in the parallel resonance circuit. Since a parameter for adjusting the sound pressure level characteristic increases, it is easier to realize a desired sound pressure level characteristic, and thus an acoustic characteristic can be further improved.

Advantageous Effects of Invention

According to the present disclosure described above, acoustic characteristics can be further improved. Note that the effect is not necessarily limitative, and along with or instead of the effect, any effect disclosed in the present specification or any other effect that can be understood from the present specification may be exhibited.

DESCRIPTION OF EMBODIMENTS

Figure 1:
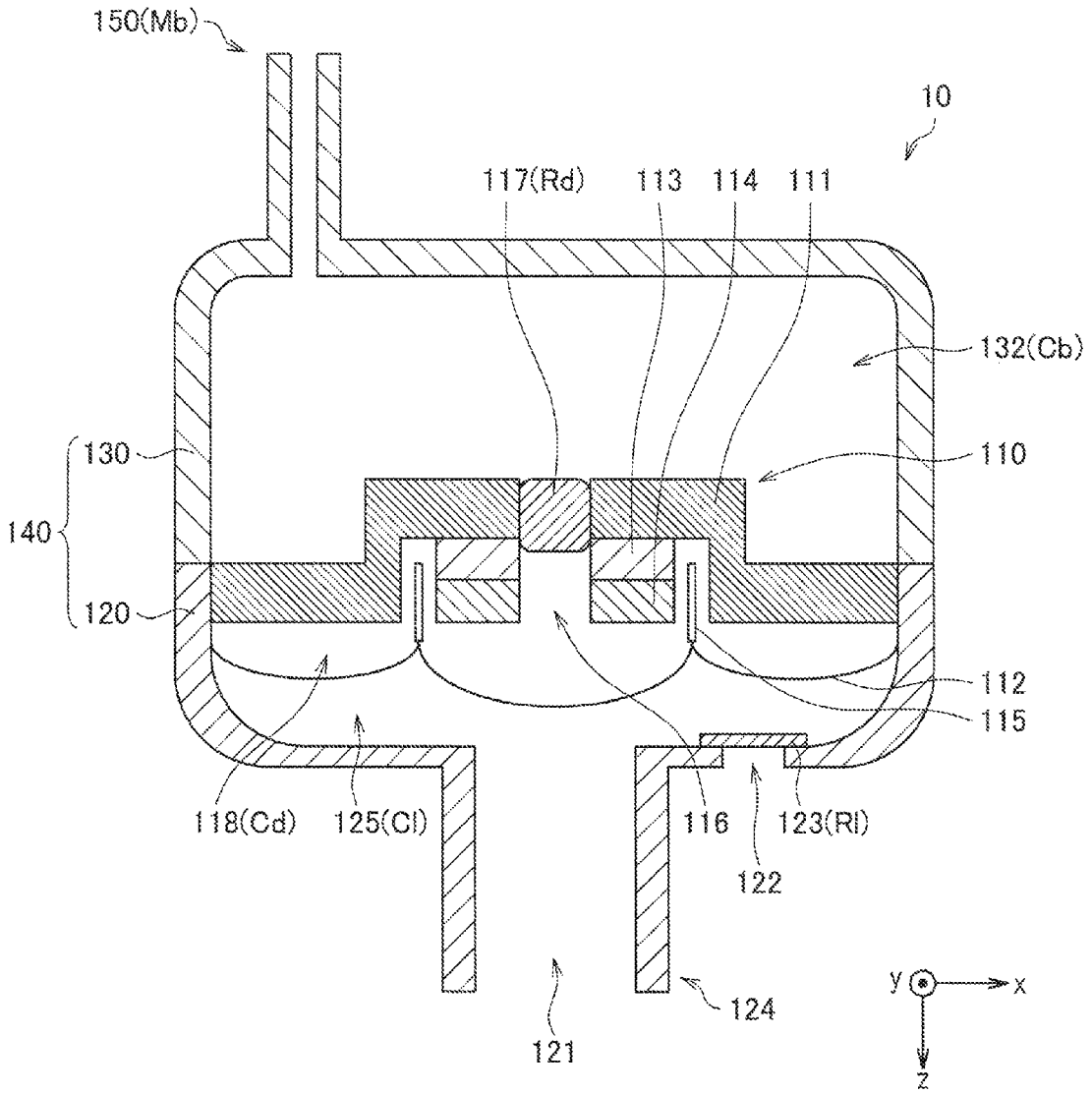
FIG. 1 is a schematic diagram showing an outline configuration of a headphone according to an embodiment of the present disclosure.

Hereinafter, (a) preferred embodiment(s) of the present disclosure will be described in detail with reference to the appended drawings. In this specification and the appended drawings, structural elements that have substantially the same function and structure are denoted with the same reference numerals, and repeated explanation of these structural elements is omitted.

Note that description will be provided in the following order.

1. Overview of an embodiment of the present disclosure
2. Configuration of a headphone according to the present embodiment
3. Acoustic characteristics of the headphone according to the present embodiment
4. Acoustic tube design method
5. Modified example
6. Supplement

1. Overview of an Embodiment of the Present Disclosure

An overview of an embodiment of the present disclosure will be described with reference to FIGS. 1 to 3. First, a schematic configuration of a headphone of the present embodiment will be described with reference to FIG. 1. Next, an acoustic equivalent circuit of the headphone of the present embodiment will be described with reference to FIG. 2. Further, acoustic characteristics realized through the present embodiment will be described qualitatively with reference to FIG. 3.

First, the schematic configuration of the headphone according to the embodiment of the present disclosure will be described with reference to FIG. 1. FIG. 1 is a schematic diagram showing the schematic configuration of the headphone according to the embodiment of the present disclosure. Referring to FIG. 1, the headphone 10 according to the present embodiment is provided with a driver unit 110 and a housing 140 that houses the driver unit 110. FIG. 1 shows a cross-section of the headphone 10 passing substantially the center of the driver unit 110. In addition, in FIG. 1, only principal constituent members among constituent members of the headphone 10 of the present embodiment are schematically shown for the sake of simplification. In addition, in order to show a correspondence between the constituent members of the headphone 10 and elements of the acoustic equivalent circuit shown in FIG. 2, reference symbols of the elements of the acoustic equivalent circuit are affixed to several reference numerals given to the constituent members in FIG. 1.

The driver unit 110 has a frame 111, a vibration plate 112, a magnet 113, a plate 114, and a voice coil 115. The frame 111 has a substantial disc shape, and the magnet 113, the plate 114, the voice coil 115, and the vibration plate 112 are placed on one surface side of the disc shape. The frame 111 has a projecting part substantially at the center part thereof that projects on the opposite side to the side on which the magnet 113, the plate 114, the voice coil 115, and the vibration plate 112 are provided. The magnet 113, the plate 114, and the voice coil 115 have a cylindrical shape and are placed inside the projecting part substantially in a concentric shape with the frame 111. The magnet 113 is interposed between the frame 111 and the plate 114. The voice coil 115 is placed on a further outer circumferential side than the magnet 113 and the plate 114. The vibration plate 112 is provided to cover one surface of the frame 111, and some regions thereof are connected to the voice coil 115. When the voice coil 115 is driven according to an audio signal supplied from outside by, for example a cable (not illustrated) or the like in a magnetic field generated by the magnet 113, the vibration plate 112 vibrates in the thickness direction. Here, the audio signal refers to an electric signal on which information of a sound is overlaid, and when the vibration plate 112 vibrates according to an audio signal, ambient air becomes sparse or dense, and thus a sound corresponding to the audio signal is generated.

Here, in the description below, the center axis direction of the disc shape of the driver unit 110 will be referred to as a z axis direction. In addition, the side on which the vibration plate 112 is provided when it is viewed from the driver unit 110 will be referred to as a front side, and the direction on the front side in the z axis direction will be referred to as a forward direction or a front side direction of the z axis. In addition, the opposite side to the front side will be referred to as a rear side, and the direction on the rear side in the z axis direction will be referred to as a backward direction or a rear direction of the z axis. In addition, two directions that are orthogonal to each other within the plane that is orthogonal to the z axis direction will be referred to as an x axis direction and a y axis direction.

In the present embodiment, the voice coil 115 has a cylindrical shape. In the vibration plate 112, a region positioned on the inner side of the voice coil 115 will also be referred to as a dome part, and a region positioned on the outer side of the voice coil 115 will also be referred to as an edge part. Likewise, in the frame 111, a region positioned on the inner side of the voice coil 115 (region corresponding to the projecting part) will also be referred to as a dome part, and a region positioned on the outer side of the voice coil 115 (region corresponding to a flange part on a circumference of the projecting part) will also be referred to as an edge part. For the sake of convenience in the description below, in the space between the frame 111 and the vibration plate 112 (which will be referred to as a driver unit rear air chamber 118 hereinbelow), the space formed on the inner side of the voice coil 115 will also be referred to as a dome part, and the space formed on the outer side of the voice coil 115 will also be referred to as an edge part.

The frame 111 of the driver unit 110 is provided with a vent hole 116 that passes through the frame 111 in the z axis direction, and the driver unit rear air chamber 118 is spatially connected to the space which is a space on the rear side of the driver unit 110 and is surrounded by the driver unit 110 and the housing 140 (a rear air chamber 132 to be described below) through the vent hole 116. In the example shown in FIG. 1, the vent hole 116 is formed substantially at the center of the frame 111, spatially connecting the dome part of the driver unit rear air chamber 118 and the rear air chamber 132.

The vent hole 116 is provided with a ventilation resistor 117 to plug the hole. The ventilation resistor 117 is formed of, for example, compressed urethane, non-woven fabric, or the like, and acts as a resistive component to a flow of air. However, a material of the ventilation resistor 117 is not limited thereto, and any material that can exert predetermined resistance to a flow of air can be used.

Here, in the present embodiment, an element that has relatively small resistance to a flow of air can be selected as the ventilation resistor 117. Due to the relatively small resistance of the ventilation resistor 117 to a flow of air, air between the driver unit rear air chamber 118 and the rear air chamber 132 flows relatively freely. However, as will be described below with reference to FIGS. 2 and 3, resistance Rd for the resistive component of the ventilation resistor 117 in an acoustic equivalent circuit 40 is linked to a sound pressure level characteristic of the headphone 10. In addition, as will be described in (3. Acoustic characteristics of the headphone according to the present embodiment) below, when the ventilation resistor 117 is not provided (in other words, when the resistance Rd is zero), acoustic characteristics of the headphone 10 remarkably change. Thus, a characteristic with regard to ventilation resistance, such as a material of the ventilation resistor 117, can be appropriately selected in reality when taking the influence of the resistance Rd on the acoustic characteristics of the headphone 10 into account.

Note that, in the example shown in FIG. 1, although the vent hole 116 is provided in the region corresponding to the dome part of the frame 111, a position in the frame 111 at which the vent hole 116 is provided is not limited thereto. In the present embodiment, it is desirable that the vent hole 116 be provided to spatially connect the driver unit rear air chamber 118 and the rear air chamber 132. For example, the vent hole 116 may be formed at a position deviated from the center of the frame 111 only a predetermined distance in the radial direction (i.e., the edge part). In addition, a plurality of vent holes 116 may be provided at different positions in the frame 111. As will be described below with reference to FIG. 2, the ventilation resistor 117 provided in the vent hole 116 functions as the resistance Rd that affects acoustic characteristics in the acoustic equivalent circuit 40 of the headphone 10. In the present embodiment, the position at which the vent hole 116 is provided in the frame 111 may be a position in the acoustic equivalent circuit 40 at which the ventilation resistor 117 provided in the vent hole 116 has the same function, and may be appropriately set when taking, for example, disposed positions of other constituent members within the housing 140 into account.

In addition, the driver unit 110 according to the present embodiment may be a so-called dynamic driver unit. As such a driver unit 110, an existing general dynamic driver unit can be applicable. With regard to disposed positions of the frame 111, the vibration plate 112, the magnet 113, the plate 114, and the voice coil 115 or a driving method of the driver unit 110, for example, disposed positions or a driving method of these members in a general dynamic driver unit may be applied. The driver unit 110 according to the present embodiment, however, is not limited to a dynamic driver unit, and may be a driver unit of another type. For example, the driver unit 110 may be a so-called balanced armature driver unit (a BA driver unit). Even if the driver unit 110 is a BA driver unit in the present embodiment, the same effect as that obtained when the driver unit is a dynamic driver unit to be described below can be obtained.

The housing 140 houses the driver unit 110. A front air chamber 125 that is a space surrounded by the driver unit 110 and the housing 140 is formed on the front side of the driver unit 110. In addition, the rear air chamber 132 that is a space surrounded by the driver unit 110 and the housing 140 is formed on the rear side of the driver unit 110.

The housing 140 may be composed of a plurality of members. In the example shown in FIG. 1, the housing 140 is formed by bonding a front housing 120 that covers the front side of the driver unit 110 and a rear housing 130 that covers the rear side of the driver unit 110. Note that the present embodiment is not limited thereto, and the housing 140 may be composed of three or more members.

Openings 121 and 122 which spatially connect the inside and the outside of the housing 140 are provided in a partition wall of the front housing 120. The opening 121 is a sound output opening for outputting a sound to the outside. Air inside the front air chamber 125 is output to the outside via the opening 121 as a sound. A sound guiding tube 124 which is a tubular portion protruding to the outside is formed in a partial region of the front housing 120, and the opening 121 is provided at the tip of the sound guiding tube 124. When a user listens to a sound, the tip of the sound guiding tube 124 is inserted into an external auditory canal of the user. As described above, the headphone 10 of the present embodiment may be a so-called canal earphone. Note that an earpiece (not illustrated) for bringing the sound guiding tube 124 in close contact with the inner wall of the external auditory canal of a user may be provided in the outer circumference of the tip of the sound guiding tube 124. In addition, an equalizer (not illustrated) which is a ventilation resistor may be provided inside the sound guiding tube 124. By setting a material and a shape of the equalizer appropriately, adjustment of sound quality, for example, reducing an output of a sound of a specific frequency band, or the like, can be performed.

A ventilation resistor 123 is provided in the opening 122 to plug the hole thereof. The ventilation resistor 123 has the same function as the ventilation resistor 117 described above. In the present embodiment, however, a material and a shape of the ventilation resistor 123 are selected to substantially block air. As described, in the present embodiment, the front air chamber 125 except for the opening 121 may be spatially blocked from the outside with regard to a flow of air. In the description below, the front air chamber 125 except for the opening 121 for sound output that is formed to be spatially blocked from the outside with regard to a flow of air will also be referred to as an enclosed front air chamber 125. In addition, the headphone 10 with the enclosed front air chamber 125 will also be referred to as an enclosed headphone 10.

An acoustic tube 150 which is formed of a tubular member and spatially connects the rear air chamber 132 and the outside of the housing 140 (i.e., the outside of the headphone 10) through a tube is provided in a partial region of the partition wall of the rear housing 130. The acoustic tube 150 is provided, for example, projecting toward the outside from the partition wall of the rear housing 130 as shown in FIG. 1. Here, the acoustic tube 150 is formed to have a length and an inner cross-sectional area (a cross-sectional area of the tube inner part regulated by the inner diameter of the acoustic tube 150) in which a predetermined inductance component acts on a flow of air passing through the inside of the acoustic tube 150. As will be described below with reference to FIG. 2, in the present embodiment, the inductance component of the acoustic tube 150 acting on the flow of air functions as inductance Mb acting on acoustic characteristics in the acoustic equivalent circuit 40 of the headphone 10. Note that a specific configuration and shape of the acoustic tube 150 will be described in detail in (4. Acoustic tube design method) below.

In addition, in the present embodiment, an opening that spatially connects the rear air chamber 132 and the outside of the housing 140 may not be provided in the region of the partition wall of the rear housing 130 other than the region in which the acoustic tube 150 is provided. Thus, the rear air chamber 132 can be spatially blocked from the outside except for ventilation in the acoustic tube 150. In order to realize such a configuration, the joining part of the front housing 120 and the rear housing 130 is joined in a state in which, for example, air tightness is maintained using an adhesive or the like. Note that the influence caused by providing an opening other than the acoustic tube 150 in the partition wall of the rear housing 130 (which corresponds to providing housing resistance to be described below) on the acoustic characteristics of the headphone 10 will be described in detail in (3. Acoustic characteristics of the headphone according to the present embodiment) below.

The acoustic tube 150 is formed such that, for example, a tubular member is prepared separately from the housing 140 and the tubular member and the housing 140 are combined. For example, the acoustic tube 150 is configured such that an opening which spatially connects the rear air chamber 132 and the outside of the housing 140 is provided in a partial region of the partition wall of the housing 140 that forms the rear air chamber 132 and the tubular member is connected to the opening. Specifically, the tubular member of the acoustic tube 150 may be provided so as to pass through the opening so that one end thereof is positioned inside the rear air chamber 132 and the other end is positioned outside of the housing 140. In addition, the acoustic tube 150 may be configured such that one end of the tubular member is connected to the opening. In the present embodiment as described above, however, the rear air chamber 132 can be spatially blocked from the outside except for ventilation in the acoustic tube 150, and thus, with regard to the opening provided in the partition wall of the housing 140 connected to the tubular member, the joining part of the opening and the tubular member is joined in a state in which, for example, air tightness is maintained using an adhesive or the like.

In addition, for example, the acoustic tube 150 may be formed integrated with the housing 140. If the acoustic tube 150 is formed integrated with the housing 140, it is not necessary to form an opening to be connected to the tubular member in the partition wall of the housing 140, and thus air tightness of the rear air chamber 132 can be secured more reliably.

The schematic configuration of the headphone 10 according to the present embodiment has been described above with reference to FIG. 1. Next, the acoustic equivalent circuit of the headphone 10 shown in FIG. 1 will be described with reference to FIG. 2. FIG. 2 is a diagram showing the acoustic equivalent circuit of the headphone 10 shown in FIG. 1.

Here, the acoustic equivalent circuit refers to a circuit obtained by replacing elements of the mechanical system and the acoustic system of the headphone 10 with elements of an electrical circuit. In the acoustic equivalent circuit, a voltage thereof corresponds to sound pressure in the acoustic system, and a current thereof corresponds to a particle velocity of air (in other words, a flow of air) in the acoustic system. Thus, by analyzing a voltage of the acoustic equivalent circuit of the headphone 10, sound pressure of a sound output from the headphone 10 can be analyzed. Here, a ratio of sound pressure of an output sound to a reference value (for example, a minimum value of audible sound pressure of a person) expressed in the unit of decibels is referred to as a sound pressure level (SPL), which is one index for evaluating acoustic characteristics. Adjusting a sound pressure level characteristic can be said to be, in other words, adjusting an acoustic characteristic. By calculating a sound pressure level of the headphone 10 from the acoustic equivalent circuit, an acoustic characteristic of the headphone 10 can be evaluated.

Figure 2:
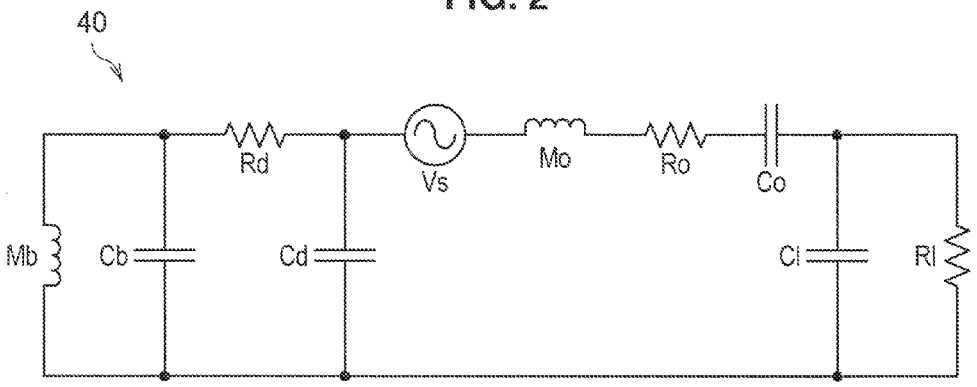
FIG. 2 is a diagram showing an acoustic equivalent circuit of the headphone shown in FIG. 1.

Referring to FIG. 2, a signal source Vs, inductance Mo, resistance Ro, and capacitance Co are arranged in series in the acoustic equivalent circuit 40. The signal source Vs, the inductance Mo, the resistance Ro, and the capacitance Co are elements corresponding to the elements of the mechanical system of the driver unit 110. Specifically, the signal source Vs is an element corresponding to vibratory force when the driver unit 110 causes the vibration plate 112 to vibrate, and is a power source element that generates electromotive force in the acoustic equivalent circuit 40. In addition, the inductance Mo, the resistance Ro, and the capacitance Co are elements respectively corresponding to a mass, mechanical resistance, and compliance of the driver unit 110.

In addition, resistance Rl and capacitance Cl are arranged in parallel in the acoustic equivalent circuit 40. Here, the resistance Rl and the capacitance Cl are elements relating to a flow of air in the front air chamber 125. Specifically, the resistance Rl corresponds to a resistive component of the ventilation resistor 123 provided in the opening 122 of the front air chamber 125. In the present embodiment as described above, the front air chamber 125 is an air-tightened type, and thus the resistance Rl can be deemed as having a sufficiently large value. In addition, the capacitance Cl corresponds to the volume of the front air chamber 125.

In addition, in the acoustic equivalent circuit 40, capacitance Cd, capacitance Cb, and inductance Mb are arranged in parallel. In addition, resistance Rd is present between the capacitance Cd and the capacitance Cb that are arranged in parallel. Here, the resistance Rd, the capacitance Cd, the capacitance Cb, and the inductance Mb are elements relating to a flow of air in the driver unit rear air chamber 118 and the rear air chamber 132. Specifically, the resistance Rd corresponds to the resistive component of the ventilation resistor 117 that is provided in the vent hole 116 which spatially connects the driver unit rear air chamber 118 and the rear air chamber 132. In addition, the capacitance Cd and the capacitance Cb respectively correspond to the volumes of the driver unit rear air chamber 118 and the rear air chamber 132. In addition, the inductance Mb corresponds to an inductance component of the acoustic tube 150. As will be described with reference to FIG. 3, by changing values of the resistance Rd, the capacitance Cd, the capacitance Cb, and the inductance Mb here in the present embodiment, the acoustic characteristics of the headphone 10 are adjusted. Hereinbelow, the resistance Rd will also be referred to as an acoustic resistance, the capacitance Cb as an acoustic capacity, and the inductance MB as an acoustic inductance.

Here, focusing on the capacitance Cb and the inductance Mb, it can be assumed that a parallel resonance circuit that causes anti-resonance at a predetermined resonance frequency is formed at least with the capacitance Cb and the inductance Mb in the acoustic equivalent circuit 40. In the present embodiment, as anti-resonance occurs due to an acoustic capacity and an acoustic inductance, a sound pressure level in a predetermined frequency band can be adjusted.

Note that, since one having a relatively small resistance (in other words, a value of the resistance Rd may be relatively small) to a flow of air may be selected as the ventilation resistor 117 in the present embodiment as described above, air can flow relatively freely between the driver unit rear air chamber 118 and the rear air chamber 132. In this case, the acoustic capacity described above may further include the capacitance Cd that is a capacity component corresponding to the volume of the driver unit rear air chamber 118. Thus, it can be assumed that, when a value of the resistance Rd is relatively small, a parallel resonance circuit that causes anti-resonance at a predetermined resonance frequency is formed approximately with the inductance Mb and combined capacitance Cs of the capacitance Cd and the capacitance Cb. In this manner, anti-resonance can be said to occur due to the capacitance Cd, the capacitance Cb, and the inductance Mb in the present embodiment. In description below, an acoustic capacity may be the capacitance Cb, and may further include the capacitance Cd.

Adjustment of a sound pressure level using anti-resonance caused by an acoustic capacity and an acoustic inductance will be described in detail with reference to FIG. 3. FIG. 3 is a graph diagram qualitatively showing sound pressure level characteristics of the headphone 10 according to the embodiment. In FIG. 3, the horizontal axis represents frequency, the vertical axis represents sound pressure level, and sound pressure level characteristics of the headphone 10 obtained from the analysis result of the acoustic equivalent circuit 40 shown in FIG. 2 are plotted. In addition, in the example shown in FIG. 3, the acoustic capacity includes the capacitance Cb and the capacitance Cd.

First, a desired acoustic characteristic in the present embodiment will be described with reference to FIG. 3. For the sake of convenience in the description below, the frequency band equal to or lower than 200 (Hz) will be referred to as a lower register, the frequency band from 200 (Hz) to 2000 (Hz) will be referred to as a middle register, and the frequency band equal to or higher than 2000 (Hz) will be referred to as an upper register. If frequency bands are divided as above, for example, a voice of a person belongs to the middle register, and a bass note lower than that belongs to the lower register.

An example of a desired acoustic characteristic in the present embodiment is realized by, for example, a sound pressure level characteristic in which a sound of the lower register is more emphasized and sound quality of a sound of the middle register is more improved. Emphasizing a sound of a lower register more can be realized by, for example, setting the front air chamber 125 of the headphone 10 to be an air-tightened type. For example, it is known that, in a headphone having an air-tightened front air chamber, such as a canal earphone, a sound can be output in a state in which predetermined sound pressure is maintained up to an even lower frequency band. FIG. 3 shows an example of the sound pressure level characteristic of an existing general headphone of an air-tightened type using the dotted curve A.

Meanwhile, it is known with regard to the quality of a sound of the middle register that, for example, if sound pressure significantly changes in a frequency band of the middle register in which a voice of a person is included, a user who hears the sound feels that the voice of the person is like a muffled sound. Thus, in order to improve the quality of a sound of the middle register, it is desirable to cause a sound pressure level of the middle register to undergo a relatively small change.

Thus, a sound pressure level characteristic in which the quality of a sound of the middle register is improved while a sound of a lower register is more emphasized can be considered to be a sound pressure level characteristic in which, so to speak, a sound pressure level decreases from the lower register to the middle register in a stair pattern (hereinafter referred to simply as a "stair-like sound pressure level characteristic"), e.g., sound pressure decreases from the lower register to the middle register with a steep slope and a sound pressure level changes as little as possible in the middle register. Here, referring to the curve A shown in FIG. 3, in a sound pressure level characteristic of an existing headphone, sound pressure decreases from the lower register to the middle register with a relatively gentle slope, and the decreased sound pressure level is maintained with the gentle slope in the middle register. In such a sound pressure level characteristic, there is concern of high sound quality not being realized for, for example, a voice of a person that is included in the middle register. As described above, with regard to existing headphones of the air-tightened type, a sound pressure level characteristic in the middle register, in particular, has room for improvement.

Here, it is known for an existing headphone that a sound pressure level of a predetermined frequency band is decided based at least on a value of ventilation resistance between the driver unit rear air chamber and the space on the rear side of the driver unit (i.e., which corresponds to the resistive component of the ventilation resistor 117 shown in FIG. 1 and the resistance Rd shown in FIG. 2 in the present embodiment). Specifically, by changing the value of the resistance Rd corresponding to the ventilation resistance, a value of a sound pressure level can be adjusted from the lower register to the middle register. Thus, by changing the value of the resistance Rd, there is a possibility of a sound pressure level in the middle register being adjusted and the acoustic characteristics being improved. However, when the value of the resistance Rd changes as indicated by the arrow in FIG. 3, the value of the sound pressure level fluctuates with the maintained slope of the curve A. Even if it is attempted to improve an acoustic characteristic by adjusting, for example, the value of the resistance Rd in an existing headphone it is difficult to obtain the above-described stair-like sound pressure level characteristic.

Meanwhile, in the present embodiment, a parallel resonance circuit that causes anti-resonance with an acoustic capacity and an acoustic inductance is formed by providing the acoustic tube 150. Anti-resonance in the acoustic equivalent circuit 40 acts to form a dip of the sound pressure level in the sound pressure level curve shown in FIG. 3. For example, FIG. 3 illustrates the curve B having a dip in the middle register using a solid line. The dip corresponds to anti-resonance caused by the acoustic capacity and the acoustic inductance. Here, a resonance frequency fh of the anti-resonance can be decided based at least on a value of the acoustic capacity and a value of the acoustic inductance. In the present embodiment, by adjusting the value of the acoustic capacity and the value of the acoustic inductance, the frequency band in which the resonance frequency fh of the anti-resonance is included, i.e., the frequency band in which the dip of the sound pressure level is formed, can be adjusted.

In addition, the driver unit 110 according to the present embodiment may have the same configuration as an existing general dynamic driver unit as described above. Thus, in the present embodiment, a sound pressure level in a predetermined frequency band can also be decided based at least on a value of the resistance Rd (i.e., acoustic resistance), like an existing headphone. Specifically, in the present embodiment, a value of the sound pressure level can be adjusted from the lower register to the middle register by changing a value of the acoustic resistance. Thus, by appropriately adjusting the value of the acoustic capacity and the value of the acoustic inductance so that the resonance frequency fh of anti-resonance is positioned in the frequency band from the lower register to the middle register, the value of the sound pressure level from the lower register to the middle register can be the sum of a change of the value caused by the acoustic resistance and a change of the value caused by the dip formed due to the anti-resonance. Thus, a step of the sound pressure level with a steeper slope than the slope shown by the curve A can be formed in the frequency band in which the resonance frequency fh is positioned, i.e., the frequency band in which the dip is formed.

As described above, in the present embodiment, the sound pressure level of the headphone 10 in a predetermined frequency band can be decided based at least on a value of the acoustic capacity, a value of the acoustic inductance, and a value of the acoustic resistance. Specifically, the sound pressure level from the lower register to the middle register can be adjusted using the acoustic capacity, the acoustic inductance, and the acoustic resistance. In addition, since the front air chamber 125 is the air-tightened type in the present embodiment, the sound pressure level characteristic in which the sound pressure level in the lower register is maintained at a higher value than the sound pressure level in the middle register can be realized. Thus, by appropriately adjusting the values of the acoustic capacity, the acoustic inductance, and the acoustic resistance, for example, the above-described stair-like sound pressure level characteristic can be obtained. In addition, by further appropriately adjusting the values of the acoustic capacity, the acoustic inductance, and the acoustic resistance, the difference of the sound pressure levels in the lower register and the middle register and the frequency band in which the step formed when the sound pressure level decreases in the stair pattern is positioned can be adjusted. Thus, a fluctuating acoustic characteristic in which the difference in the levels in the lower register and the middle register is significant is realized.

Figure 3:
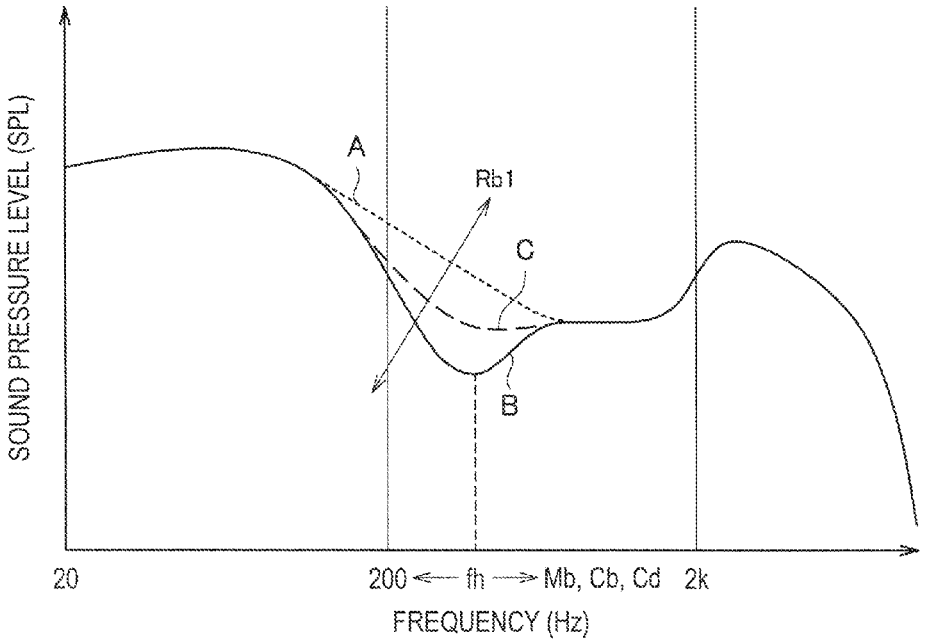
FIG. 3 is a graph diagram qualitatively showing sound pressure level characteristics of the headphone according to the embodiment.
Figure 4A:
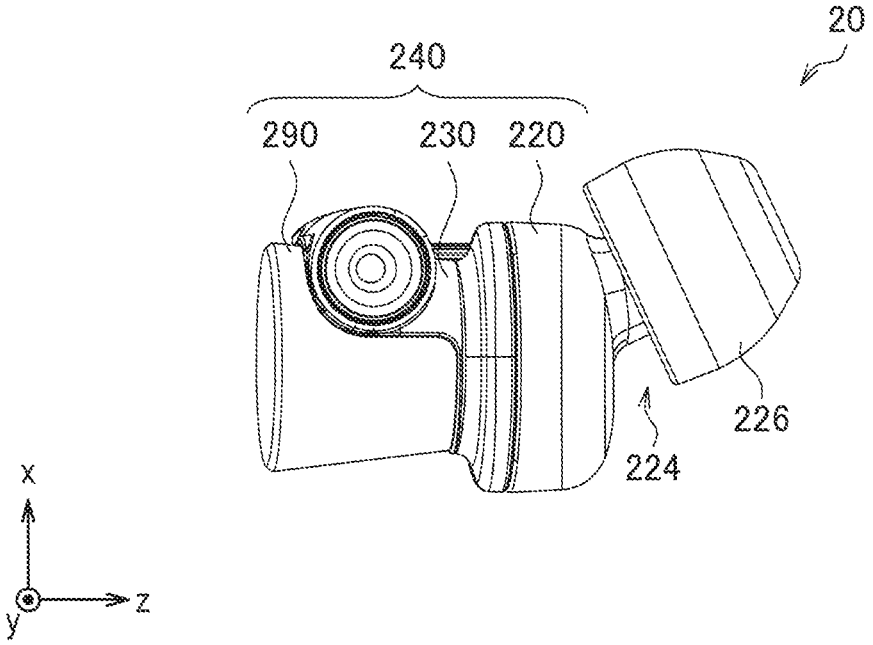
FIG. 4A is a hexahedral diagram showing the external appearance of the headphone according to the embodiment.
Figure 4B:
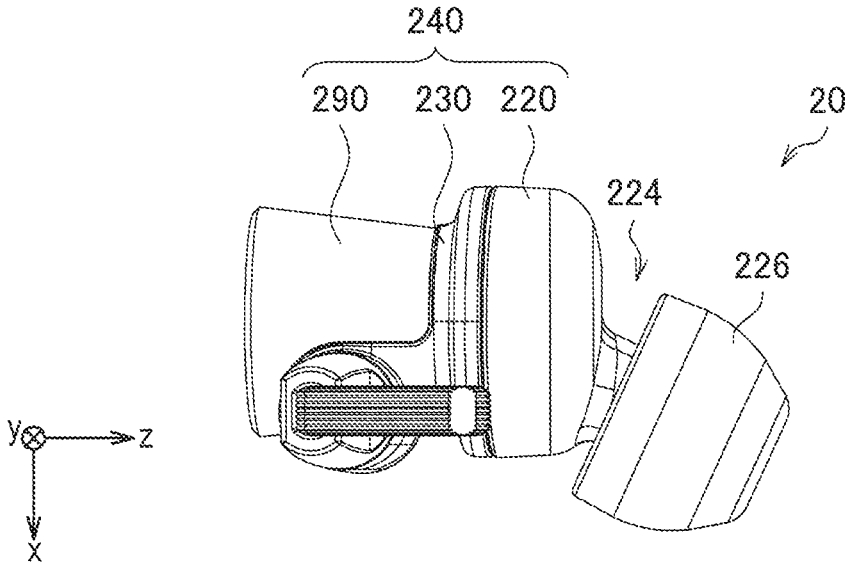
FIG. 4B is a hexahedral diagram showing the external appearance of the headphone according to the embodiment.
Figure 4C:
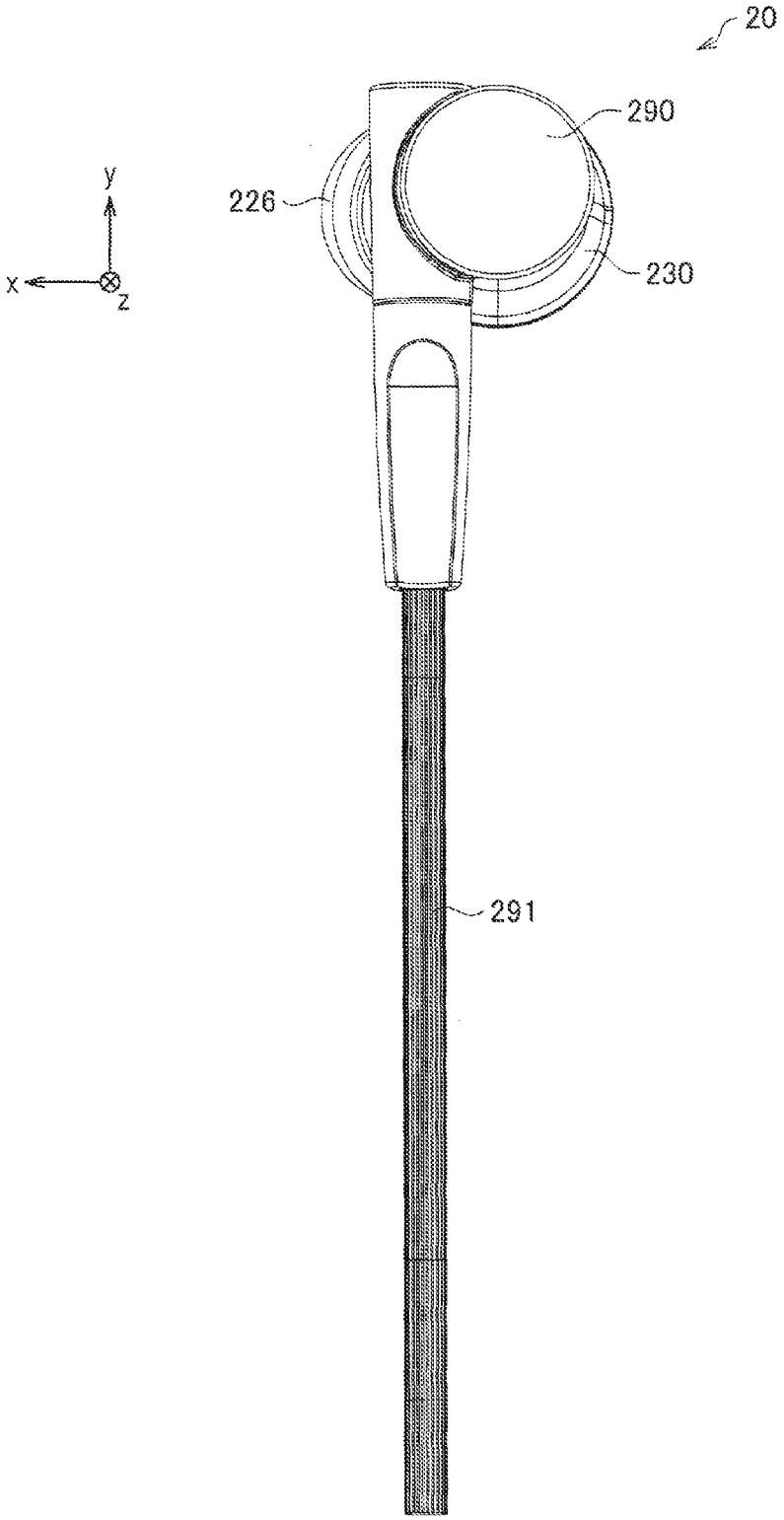
FIG. 4C is a hexahedral diagram showing the external appearance of the headphone according to the embodiment.
Figure 4D:
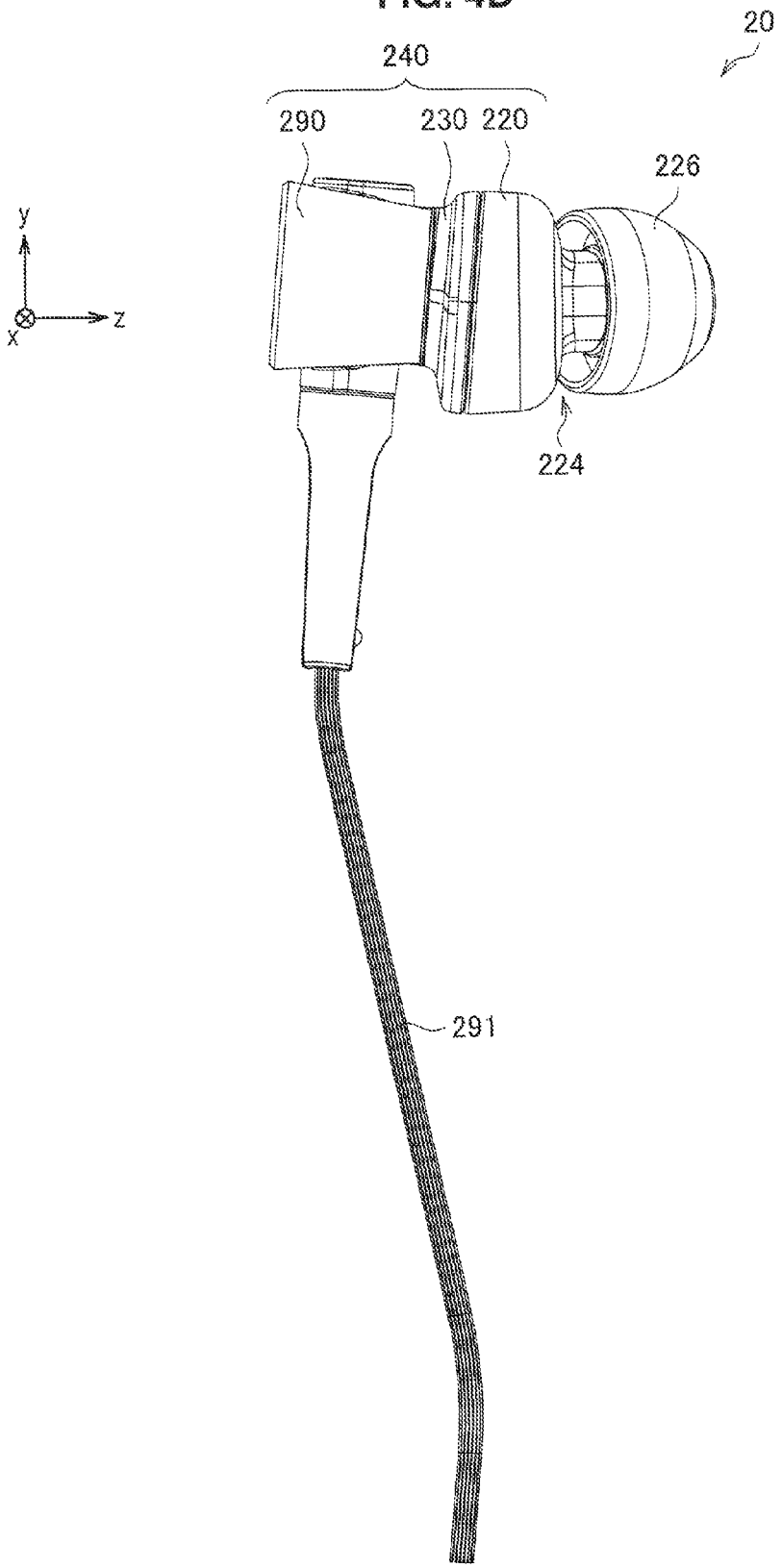
FIG. 4D is a hexahedral diagram showing the external appearance of the headphone according to the embodiment.
Figure 4E:
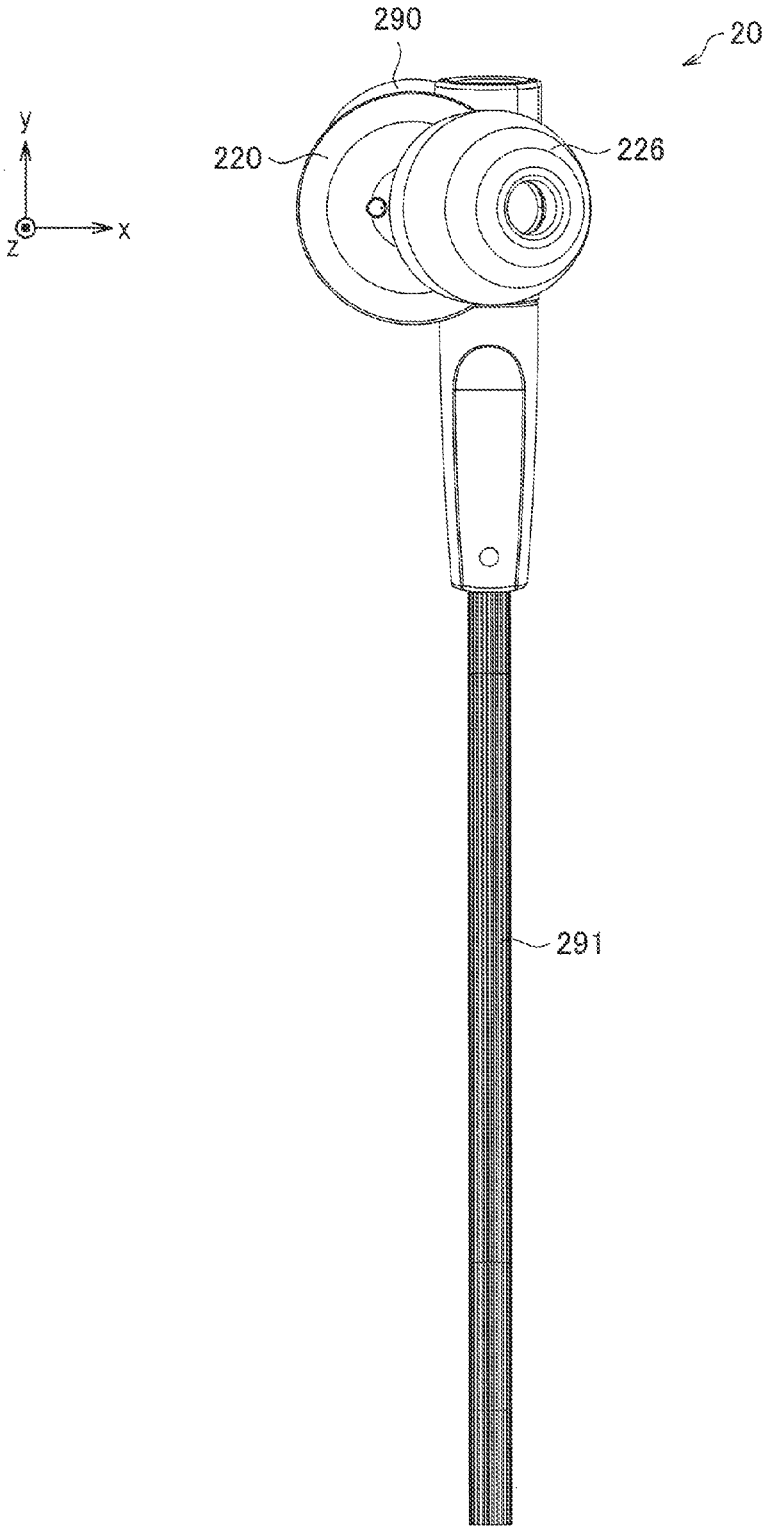
FIG. 4E is a hexahedral diagram showing the external appearance of the headphone according to the embodiment.
Figure 4F:
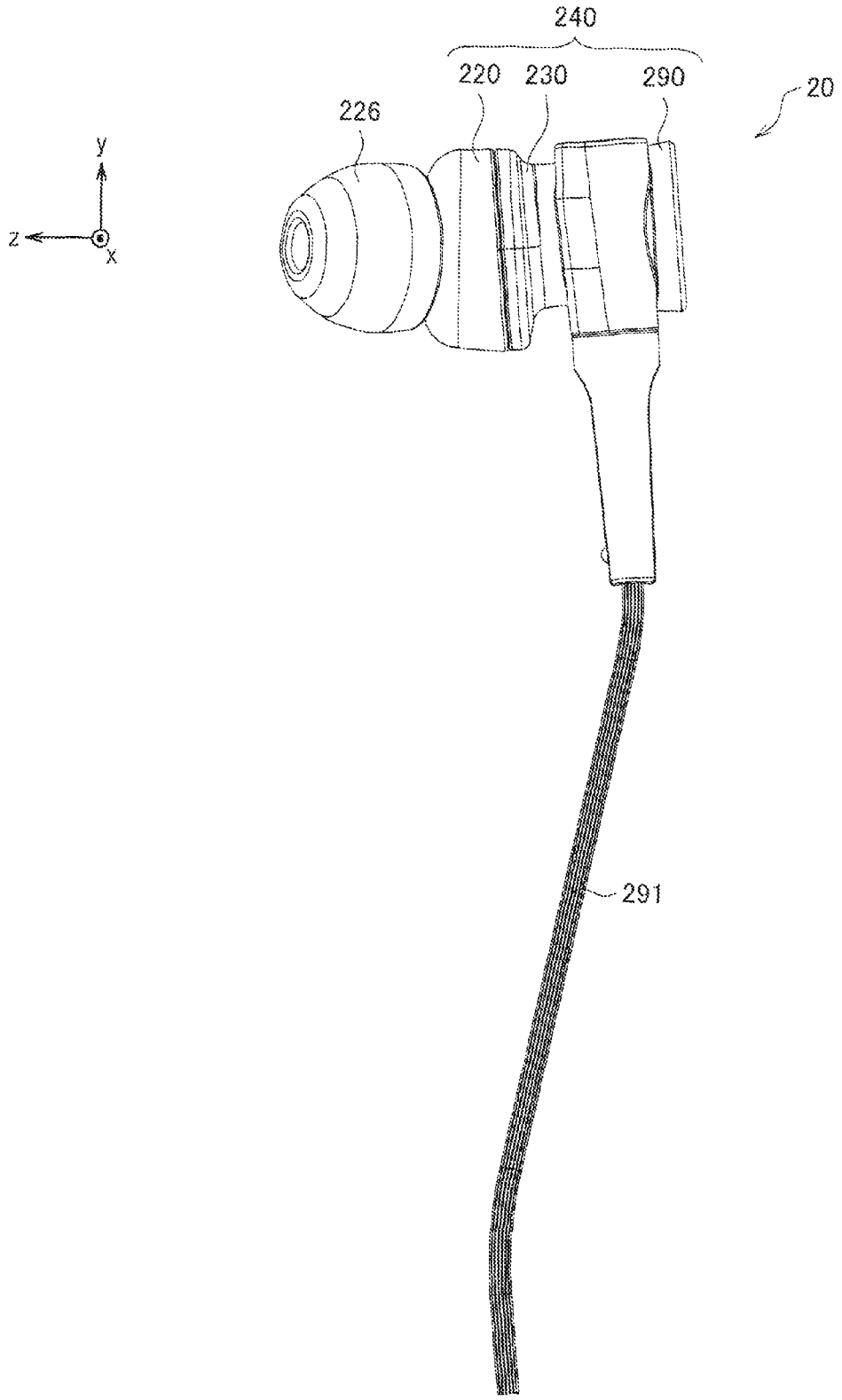
FIG. 4F is a hexahedral diagram showing the external appearance of the headphone according to the embodiment.

In FIG. 3, an example of the stair-like sound pressure level characteristic obtained in the present embodiment is illustrated using the dashed curve C. In the sound pressure level characteristic indicated by the dashed curve C, for example, values of the acoustic capacity and the acoustic inductance can be appropriately adjusted so that the resonance frequency fh of anti-resonance is positioned between about 350 (Hz) and 650 (Hz). In addition, in the state in which the resonance frequency fh is positioned between about 350 (Hz) and 650 (Hz), a value of the acoustic resistance can be appropriately adjusted so that the sound pressure level decreases with a steeper slope from the lower register to the middle register. In the present embodiment as described above, as one desired acoustic characteristic, the sound pressure level characteristic in which the quality of a sound of a middle register is more improved while a sound of a lower register is more emphasized is realized.

Here, the acoustic capacity corresponds to, for example, the combined capacitance of the capacitance Cb and the capacitance Cd as descried above. The capacitance Cd corresponds to the volume of the driver unit rear air chamber 118, and a value thereof can be decided according to the configuration of the frame 111 and the vibration plate 112 in the driver unit 110. In addition, the capacitance Cb corresponds to the volume of the rear air chamber 132, and a value thereof can be decided according to the configuration of the rear housing 130. In addition, the acoustic inductance (inductance Mb) corresponds to the inductance component of the acoustic tube 150, and a value thereof depends on the shape of the acoustic tube 150. For example, as the inner cross-sectional area of the acoustic tube 150 decreases and a length thereof increases, a value of the inductance Mb increases. In addition, the acoustic resistance (resistance Rd) corresponds to the resistive component of the ventilation resistor 117 provided in the vent hole 116 which spatially connects the driver unit rear air chamber 118 and the rear air chamber 132, and a value thereof depends on a material and a shape of the ventilation resistor 117. For example, as the material of the ventilation resistor 117 is packed with particles more densely, as a length of the ventilation resistor 117 in the direction of a flow of air (the z axis direction in the example shown in FIG. 1) is longer, and as the cross-sectional area of the ventilation resistor 117 decreases, the value of the resistance Rd increases. In this manner in the present embodiment, by changing the configuration of the rear housing 130, the configurations of the frame 111 and the vibration plate 112 in the driver unit 110, the shape of the acoustic tube 150, and the material and the shape of the ventilation resistor 117, the values of the acoustic capacity, the acoustic inductance, and the acoustic resistance can be changed and thus the desired sound pressure level characteristic can be realized.

2. Configuration of a Headphone According to the Present Embodiment

Figure 5:
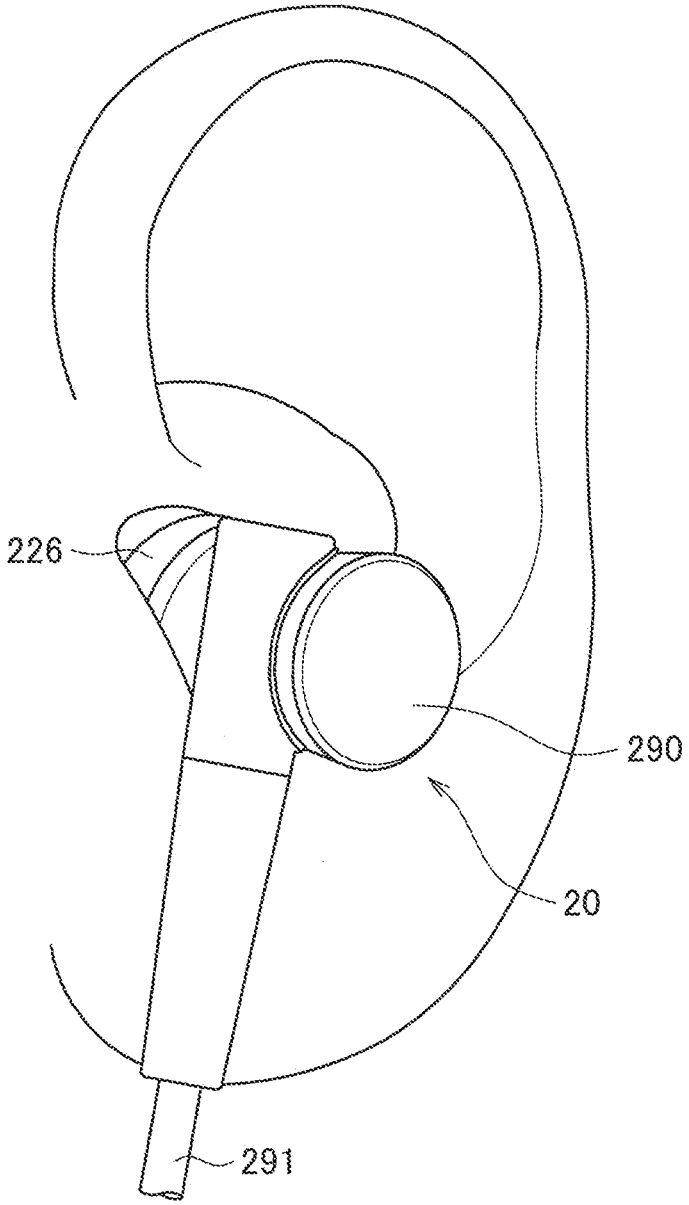
FIG. 5 is an illustrative diagram showing an example of the headphone according to the embodiment that is worn by a user.
Figure 6:
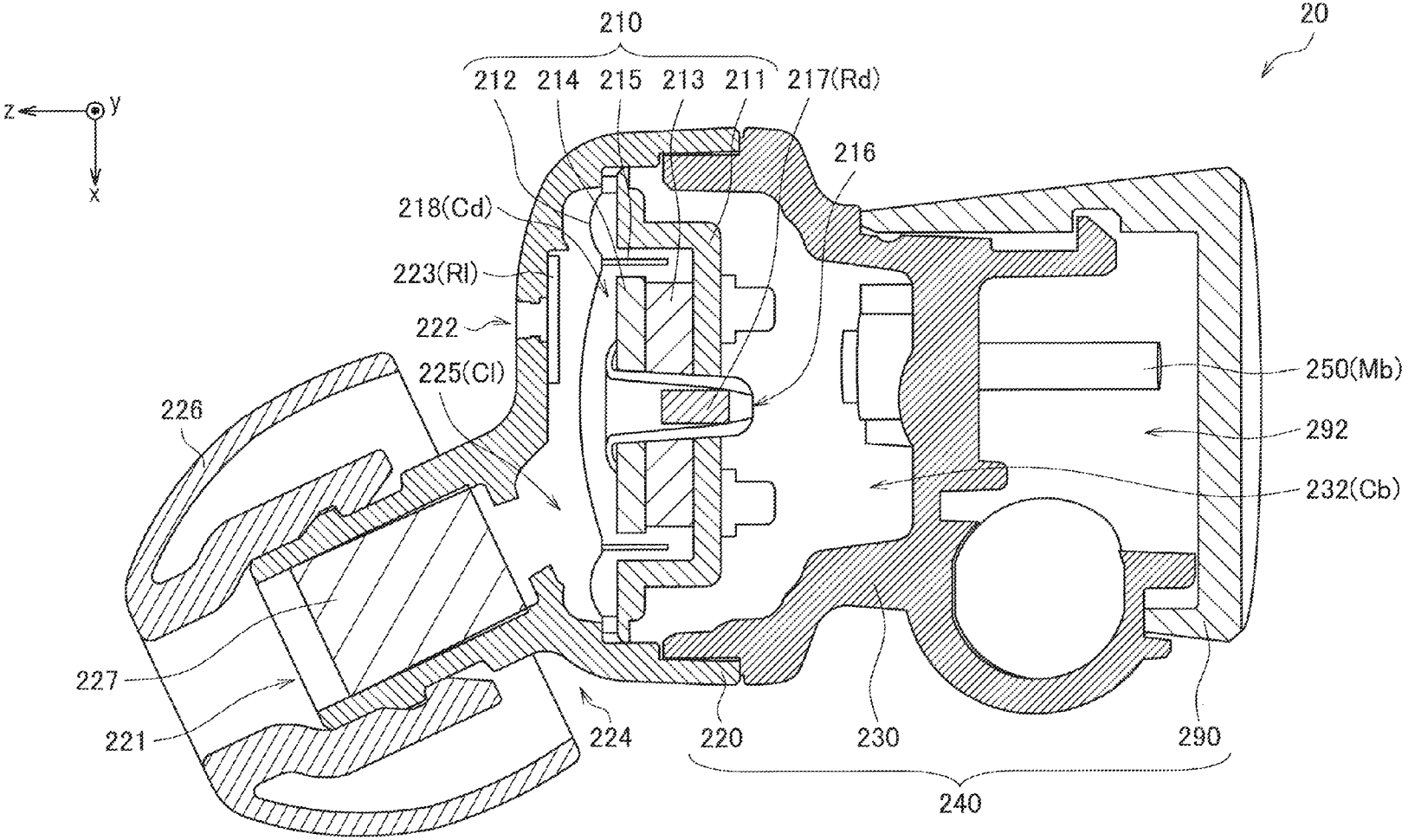
FIG. 6 is a cross-sectional diagram showing a configuration of the headphone according to the embodiment.
Figure 7:
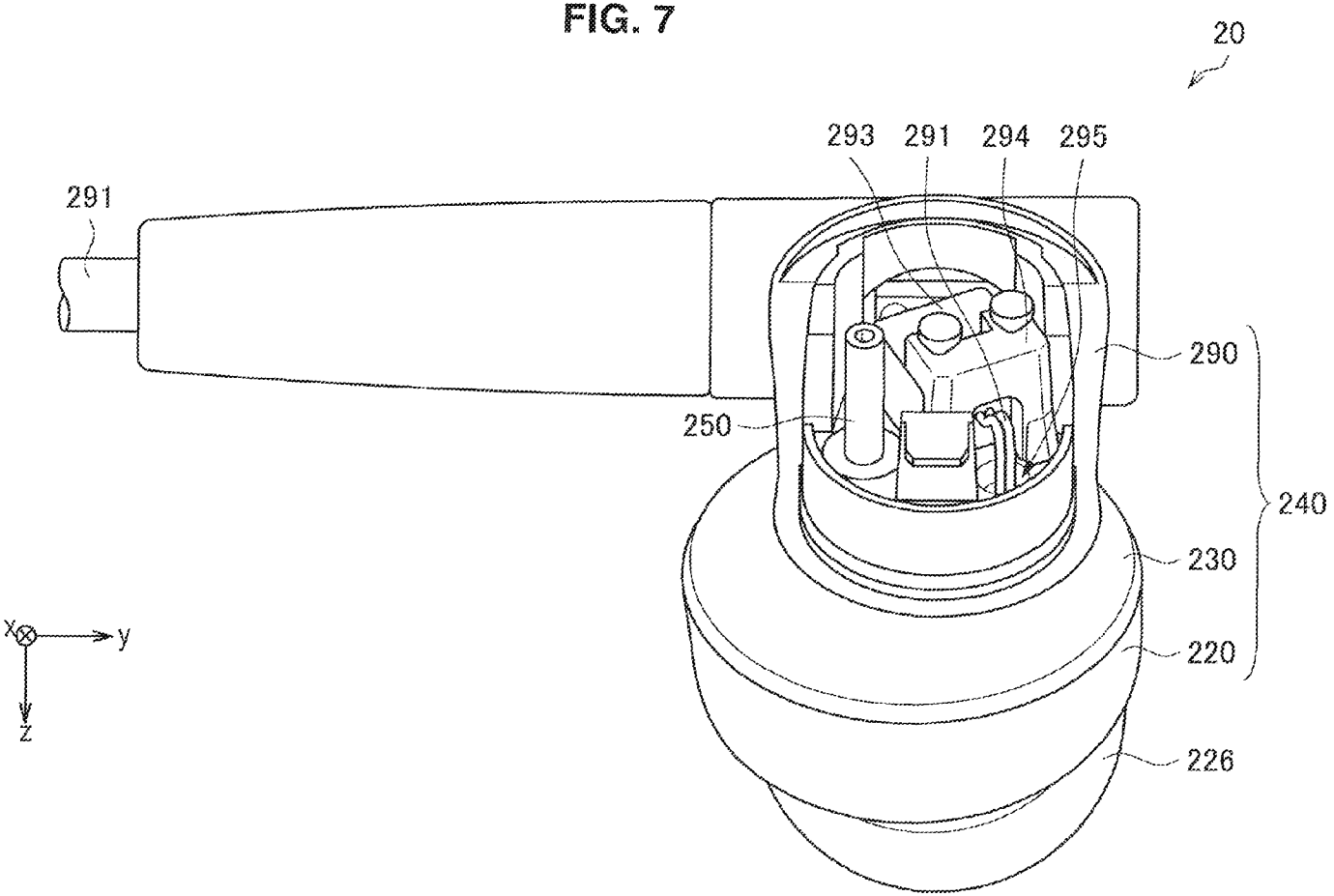
FIG. 7 is an exploded perspective diagram showing a configuration of the headphone according to the embodiment.

Next, a configuration of a headphone according to an embodiment of the present disclosure will be described in more detail with reference to FIGS. 4A to 4F, 5, 6, and 7. FIGS. 4A to 4F are hexahedral diagrams showing the external appearance of the headphone according to the present embodiment. FIG. 5 is an illustrative diagram showing an example of the headphone according to the present embodiment that is worn by a user. FIG. 6 is a cross-sectional diagram showing a configuration of the headphone according to the present embodiment. FIG. 7 is an exploded perspective diagram showing a configuration of the headphone according to the present embodiment.

Referring to FIGS. 4A to 4F, 5, 6, and 7, the headphone 20 according to the present embodiment is provided with a driver unit 210 and a housing 240 that houses the driver unit 210. Here, the headphone 20 shown in FIGS. 4A to 4F, 5, 6, and 7 corresponds to the headphone 10 described with reference to FIG. 1. Thus, when each of constituent members of the headphone 20 is described below, the correspondence with each of constituent members of the headphone 10 shown in FIG. 1 will also be described. In addition, since the corresponding constituent members have the same functions, constituent members of the headphone 20 that correspond to the constituent members described above with reference to FIG. 1 will not be described in detail.

First, the external appearance of the headphone 20 according to the present embodiment will be described with reference to FIGS. 4A to 4F and 5. Referring to FIGS. 4A to 4F, the housing 240 of the headphone 20 according to the present embodiment can be composed of a plurality of members. The housing 240 corresponds to the housing 140 shown in FIG. 1. In the example shown in FIGS. 4A to 4F, the housing 240 is composed of three components. In other words, the housing 240 is composed of a front housing 220 which covers the front side of the driver unit 210, a rear housing 230 which covers the rear side of the driver unit 210, and a cable housing 290 which covers a cable 291 that supplies audio signals to the driver unit 210. The front housing 220 and the rear housing 230 respectively correspond to the front housing 120 and the rear housing 130 shown in FIG. 1. Note that the present embodiment is not limited thereto, and the housing 240 may be composed of four or more members.

A sound guiding tube 224 that is a tubular portion protruding toward the outside is formed in a partial region of the front housing 220. The sound guiding tube 224 corresponds to the sound guiding tube 124 shown in FIG. 1. In addition, an earpiece 226 for bringing the sound guiding tube 224 in close contact with the inner wall of an external auditory canal of a user is provided in the outer circumference of a tip of the sound guiding tube 224. An opening for sound output (an opening 221 shown in FIG. 6) is provided inside the sound guiding tube 224, and when a user listens to a sound, the tip of the sound guiding tube 224 including the earpiece 226 is inserted into the external auditory canal of the user as shown in FIG. 5. As described above, the headphone 20 according to the present embodiment may be the so-called canal earphone.

Next, an inner configuration of the headphone 20 according to the present embodiment will be described with reference to FIGS. 6 and 7. Here, FIG. 6 shows a cross-section that passes through substantially the center of the driver unit 210 of the headphone 20. In addition, FIG. 7 shows an exploded state of a portion of the cable housing 290 of the headphone 20 to illustrate the disposition of an acoustic tube 250 and a cable 291 to be described below within the cable housing 290. Note that constituent members illustrated in FIGS. 6 and 7 are simplified for the sake of description of the present embodiment, and the headphone 20 may be further provided with other constituent members that are not illustrated in the drawings. Since the constituent members that are not illustrated may be known constituent members of an existing general headphone, detailed description thereof will be omitted. In addition, since the headphone 20 corresponds to the headphone 10 shown in FIG. 1 as described above, an acoustic equivalent circuit of the headphone 20 may be, for example, the same as the acoustic equivalent circuit 40 shown in FIG. 2. Thus, as in FIG. 1, reference symbols of elements of the acoustic equivalent circuit 40 are affixed to several reference numerals given to the constituent members of the headphone 20 in FIG. 6.

The driver unit 210 has a frame 211, a vibration plate 212, a magnet 213, a plate 214, and a voice coil 215. The driver unit 210 corresponds to the driver unit 110 shown in FIG. 1. In addition, the frame 211, the vibration plate 212, the magnet 213, the plate 214, and the voice coil 215 respectively correspond to the frame 111, the vibration plate 112, the magnet 113, the plate 114, and the voice coil 115 shown in FIG. 1. A driver unit rear air chamber 218 is formed between the driver unit 210 and the vibration plate 212. An element that corresponds to vibratory force generated when the vibration plate 212 vibrates corresponds to a signal source Vs in the acoustic equivalent circuit 40. In addition, a mass, mechanical resistance, and compliance of the driver unit 210 respectively correspond to inductance Mo, resistance Ro, and capacitance Co in the acoustic equivalent circuit 40. Furthermore, the volume of the driver unit rear air chamber 218 corresponds to capacitance Cd in the acoustic equivalent circuit 40. Note that the driver unit 210 according to the present embodiment may be a so-called dynamic driver unit, like the driver unit 110 shown in FIG. 1. In the present embodiment, however, a type of the driver unit 210 is not limited, and the same effect can be obtained even if the driver unit 210 is a driver unit of another type.

A vent hole 216 that passes through the frame 211 in the z axis direction is provided in the frame 211 of the driver unit 210. The vent hole 216 corresponds to the vent hole 116 shown in FIG. 1. The vent hole 216 is provided substantially at the center of the frame 211, and spatially connects the driver unit rear air chamber 218 and the space which is a space on the rear side of the driver unit 210 and is surrounded by the driver unit 210 and the housing 240 (a rear air chamber 232 to be described below).

The vent hole 216 is provided with a ventilation resistor 217 that plugs the hole. The ventilation resistor 217 corresponds to the ventilation resistor 117 shown in FIG. 1. A resistive component of the ventilation resistor 217 to a flow of air corresponds to resistance Rd in the acoustic equivalent circuit 40.

Here, a material and a shape of the ventilation resistor 217 may be appropriately set so that a desired sound pressure level characteristic is obtained when taking, for example, the sound pressure level characteristic shown in FIG. 3 into consideration. More specifically, a material and a shape of the ventilation resistor 217 can be appropriately set so that a value of the resistance Rd with which the stair-like sound pressure level characteristic is obtained is realized as described with reference to FIG. 3. For example, in the present embodiment, an element that has relatively small resistance to a flow of air can be selected as the ventilation resistor 217. Due to the relatively small resistance of the ventilation resistor 217 to a flow of air, air between the driver unit rear air chamber 218 and the rear air chamber 232 flows relatively freely. However, as described above with reference to FIGS. 2 and 3, resistance Rd for the resistive component of the ventilation resistor 217 in an acoustic equivalent circuit 40 is linked to a sound pressure level characteristic of the headphone 20. In addition, as will be described in (3. Acoustic characteristics of the headphone according to the present embodiment) below, when the ventilation resistor 217 is not provided (in other words, when the resistance Rd is zero), acoustic characteristics of the headphone 20 remarkably change. Thus, a characteristic with regard to ventilation resistance, such as a material of the ventilation resistor 217, can be appropriately selected in reality when taking the influence of the resistance Rd on the acoustic characteristics of the headphone 20 into account.

Note that, in the present embodiment, it is desirable that the vent hole 216 be provided to spatially connect the driver unit rear air chamber 218 and the rear air chamber 232, and a position thereof to be formed is not limited to the example shown in FIG. 6. For example, the vent hole 216 may be formed at a position deviated from the center of the frame 211 only a predetermined distance in the radial direction (i.e., the edge part). In addition, a plurality of vent holes 216 may be provided at different positions in the frame 211. In the present embodiment, the position at which the vent hole 216 is provided in the frame 211 may be a position in the acoustic equivalent circuit 40 at which the ventilation resistor 217 provided in the vent hole 216 has the same function, and may be appropriately set when taking, for example, disposed positions of other constituent members within the housing 240 into account.

The housing 240 houses the driver unit 210. The housing 240 corresponds to the housing 140 shown in FIG. 1. A front air chamber 225 which is a space surrounded by the driver unit 210 and the housing 240 is formed on the front side of the driver unit 210. In addition, the rear air chamber 232 which is a space surrounded by the driver unit 210 and the housing 240 is formed on the rear side of the driver unit 210. The volume of the front air chamber 225 and the volume of the rear air chamber 232 respectively correspond to capacitance Cl and capacitance Cb in the acoustic equivalent circuit 40.

As described above, the housing 240 can be composed of a plurality of members. As shown in FIG. 6, the housing 240 is formed by joining the front housing 220 that covers the front side of the driver unit 210, the rear housing 230 that covers the rear side of the driver unit 210, and the cable housing 290 that covers the cable 291.

Openings 221 and 222 which spatially connect the inside and the outside of the housing 240 are provided in a partition wall of the front housing 220. The openings 221 and 222 each correspond to the openings 121 and 122 shown in FIG. 1. The opening 221 is an opening through which sounds are output to the outside, and is provided inside the sound guiding tube 224 described above.

An equalizer 227 which is a ventilation resistor is provided inside the sound guiding tube 224. By appropriately setting a material and a shape of the equalizer 227, adjustment of sound quality, for example, reducing a component of a specific frequency band for an output sound or the like, can be performed.

The opening 222 is provided with a ventilation resistor 223 that plugs the hole. The ventilation resistor 223 corresponds to the ventilation resistor 123 shown in FIG. 1. Thus, a material and a shape of the ventilation resistor 223 of the headphone 20 are also selected to substantially block air, as for the headphone 10. As described above, in the present embodiment, the front air chamber 225 may be an air-tightened air chamber that is spatially blocked from the outside except for the opening 221. A resistive component of the ventilation resistor 223 to a flow of air corresponds to resistance Rl in the acoustic equivalent circuit 40.

The acoustic tube 250 that is configured by a tubular member and spatially connects the rear air chamber 232 and an inner space 292 of the cable housing 290 through a tube is provided in a partial region of a partition wall of the rear housing 230. The acoustic tube 250 corresponds to the acoustic tube 150 shown in FIG. 1. In the example shown in FIG. 6, an opening which spatially connects the rear air chamber 232 and the outside of the housing 240 is provided in a partial region of a partition wall of the housing 240 constituting the rear air chamber 232, and the acoustic tube 250 is configured such that a tubular member thereof is connected to the opening. Specifically, the acoustic tube 250 is provided to pass through the opening that is provided in the partition wall of the rear housing 230 such that one end of the acoustic tube is positioned in the rear air chamber 232 and the other end is positioned in the inner space 292. A configuration of the acoustic tube 250, however, is not limited thereto, and the tubular member may not be provided to, for example, pass through the opening, and the acoustic tube 250 may have one end of the tubular member connected to the opening.

Here, in the present embodiment, the inner space 292 of the cable housing 290 is connected to the outside of the housing 240 (i.e., the outside of the headphone 20) with no substantial resistance to a flow of air. Thus, the acoustic tube 250 can be said to connect the rear air chamber 232 and the outside of the housing 240 (i.e., the outside of the headphone 20) through the tube. Note that, in order to realize such a configuration in the present embodiment, for example, an opening having a size in which no substantial resistance to a flow of air is generated may be provided in the partition wall of the cable housing 290, or the joining part of the rear housing 230 and the cable housing 290 may be joined in a simple method without taking air tightness into consideration.

The acoustic tube 250 is formed to have a length and an inner cross-sectional area in which a predetermined inductance component can be obtained with respect to a flow of air passing through the inside of the acoustic tube 250. The inductance component of the acoustic tube 250 with respect to a flow of air functions as inductance Mb that acts on an acoustic characteristic in the acoustic equivalent circuit 40. Note that a detailed configuration and shape of the acoustic tube 250 will be described in more detail in (4. Acoustic tube design method) below.

In addition, in the present embodiment, an opening that spatially connects the rear air chamber 232 and the inner space 292 or the outside of the housing 240 may not be provided in the region of the partition wall of the rear housing 230 other than the region in which the acoustic tube 250 is provided. Thus, the rear air chamber 232 can be spatially blocked from the outside except for ventilation in the acoustic tube 250. In order to realize such a configuration, the joining part of the front housing 220 and the rear housing 230 is joined in a state in which, for example, air tightness is maintained using an adhesive or the like. In addition, with regard to the opening provided in the partition wall of the rear housing 230 to which the acoustic tube 250 is connected, the joining part of the opening and the acoustic tube 250 is joined in a state in which, for example, air tightness is maintained using an adhesive or the like. Note that the influence caused by providing an opening other than the acoustic tube 250 in the partition wall of the rear housing 230 (which corresponds to providing housing resistance to be described below) on the acoustic characteristics of the headphone 20 will be described in detail in (3. Acoustic characteristics of the headphone according to the present embodiment) below.

In addition, although the acoustic tube 250 is formed such that the tubular member is prepared separately from the housing 240 and the tubular member and the housing 240 are combined in the example shown in FIG. 6, the embodiment is not limited thereto. For example, the acoustic tube 250 may be formed integrated with the housing 240. If the acoustic tube 250 is formed integrated with the housing 240, it is not necessary to form an opening to be connected to the tubular member in the partition wall of the housing 240, and thus air tightness of the rear air chamber 232 can be secured more reliably.

One end of the acoustic tube 250 is provided in the inner space 292 of the cable housing 290, and the cable 291 for audio signal transfer is drawn thereinto. Specifically, although not illustrated in FIG. 6, the cable 291 that extends from acoustic equipment that outputs audio signals is connected to the driver unit 210 via the inner space 292 of the cable housing 290.

A configuration of the inner space 292 of the cable housing 290 will be described in detail with reference to FIG. 7. Referring to FIG. 7, not only the acoustic tube 250 but also a locking member 293 that locks the cable 291 and a stopper 294 that fixes the locking member 293 are provided in the inner space 292. The cable 291 that extends from acoustic equipment that outputs audio signals is locked by the locking member 293 in the inner space 292, and thus the extension direction changes to the direction in which the driver unit 210 is provided. In addition, as the position of the locking member 293 is fixed by the stopper 294, a position in which the cable 291 is disposed is fixed in the inner space 292. As shown in FIG. 7, an opening 295 that guides the cable 291 into the rear air chamber 232 is provided in the partition wall of the rear housing 230 that is a partition wall facing the inner space 292, and the cable 291 is inserted into the opening 295, is extended to the inside of rear air chamber 232, and then is connected to the driver unit 210. In the present embodiment, however, since the rear air chamber 232 can be spatially blocked from the outside except for ventilation through the acoustic tube 250 as described above, the opening 295 may be plugged in a state in which, for example, air tightness is maintained using a resin material or the like after the cable 291 is inserted thereinto.

Here, a shape (a length and/or an inner cross-sectional area) of the acoustic tube 250 of the headphone 20 according to the present embodiment and the way in which the cable 291 is drawn into the inner space 292 of the cable housing 290 are not limited to the example shown in FIG. 7, and may be appropriately changed according to, for example, an acoustic characteristic of the headphone 20, the disposition of members in the inner space 292, and the like. Several modified examples of the headphone 20 according to the present embodiment will be described with reference to FIGS. 8A to 8C.

Figure 8A:
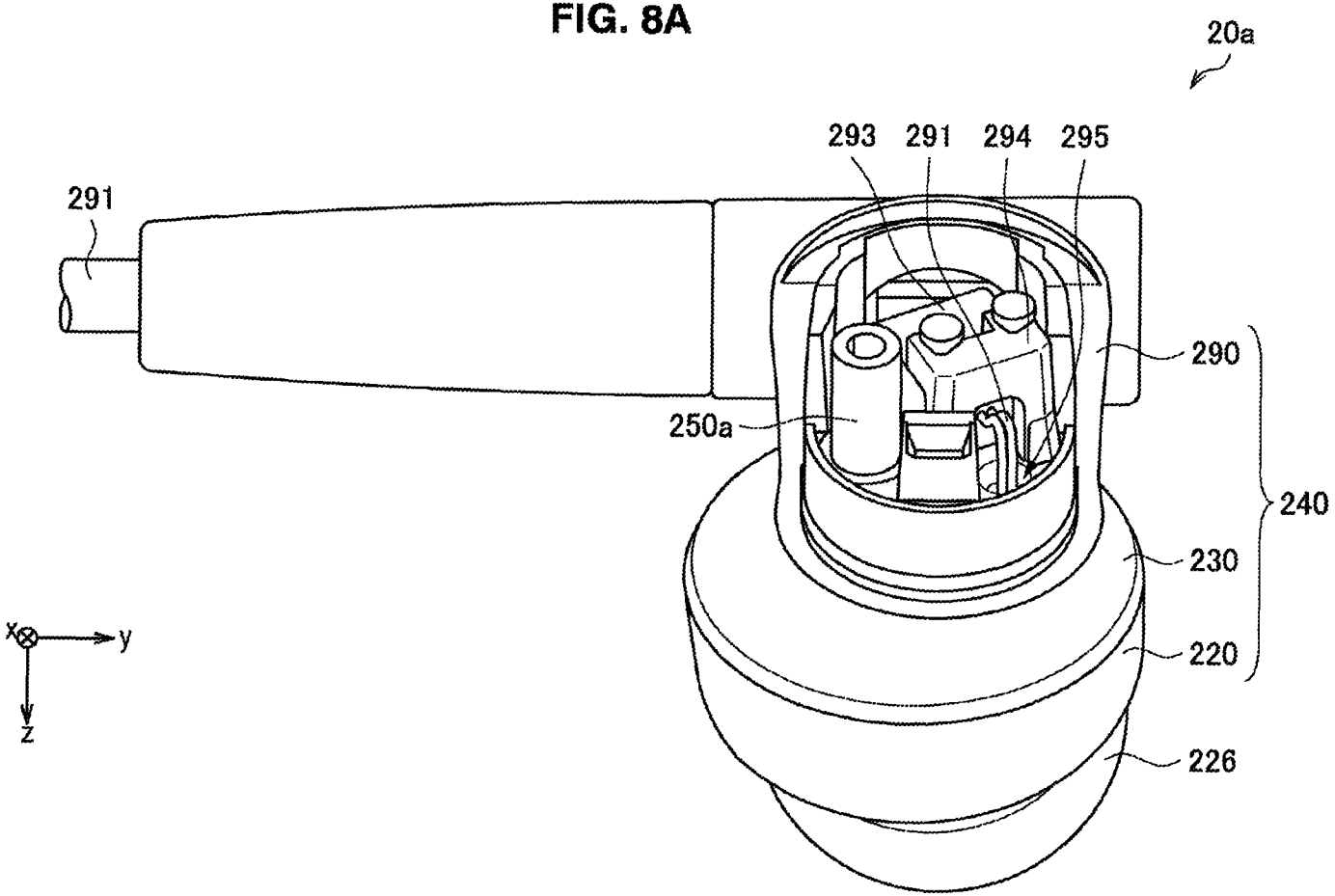
FIG. 8A is an exploded perspective diagram showing a configuration of a modified example of the headphone of the embodiment in which the shape of an acoustic tube is changed.

Since an acoustic characteristic is adjusted by changing a value of the inductance Mb of the acoustic equivalent circuit 40 in the present embodiment as described above, the shape (length and/or the inner cross-sectional area) of the acoustic tube 250 can be appropriately changed. A modified example of the headphone 20 according to the present embodiment in which the shape of the acoustic tube 250 is changed will be described with reference to FIG. 8A. FIG. 8A is an exploded perspective diagram showing a configuration of the modified example of the headphone 20 according to the present embodiment in which the shape of the acoustic tube 250 is changed. Note that a headphone 20*a* according to the present modified example corresponds to one obtained by changing the size of the inner diameter of the acoustic tube 250 of the headphone 20 of the present embodiment described above, and other configurations thereof may be the same as those of the headphone 20. In addition, FIG. 8A is an exploded perspective diagram that corresponds to FIG. 7, showing exploded external appearance of one portion of a cable housing 290 of the headphone 20*a* according to the present modified example, and the disposition of an acoustic tube 250*a* and a cable 291 to be described below within the cable housing 290 is illustrated.

Referring to FIG. 8A, the acoustic tube 250*a* provided in the headphone 20*a* according to the present modified example is formed to have a larger inner diameter than that of the acoustic tube 250 provided in the headphone 20 shown in FIG. 7. The acoustic tube 250*a* having the larger inner diameter as shown in FIG. 8A is easy to form to be integrated with a housing 240. The housing 240 can be formed using a method, for example, an injection molding method or the like, and if the inner diameter of the acoustic tube 250*a* is relatively large, a desired inner diameter is easy to secure when it is formed to be integrated with the housing 240. By forming the acoustic tube 250*a* to be integrated with the housing 240 as described above, air tightness of the rear air chamber 232 can be reliably secured, and thus if the inner diameter of the acoustic tube 250*a* is relatively large, it is preferable that the acoustic tube 250*a* be formed to be integrated with the housing 240.

Figure 8B:
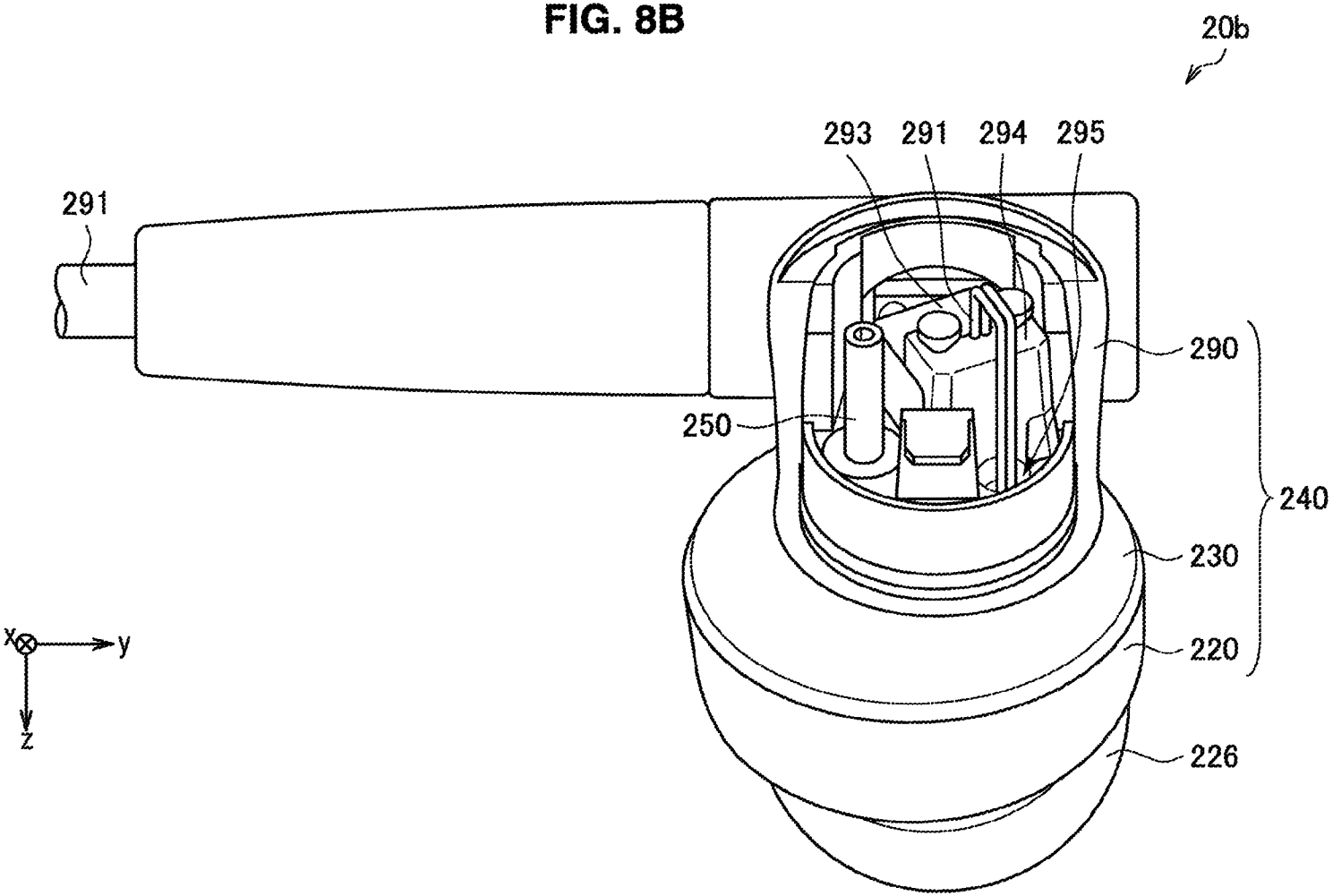
FIG. 8B is an exploded perspective diagram showing a configuration of a modified example of the headphone of the embodiment in which the way that a cable is drawn into an inner space of a cable housing is changed.
Figure 8C:
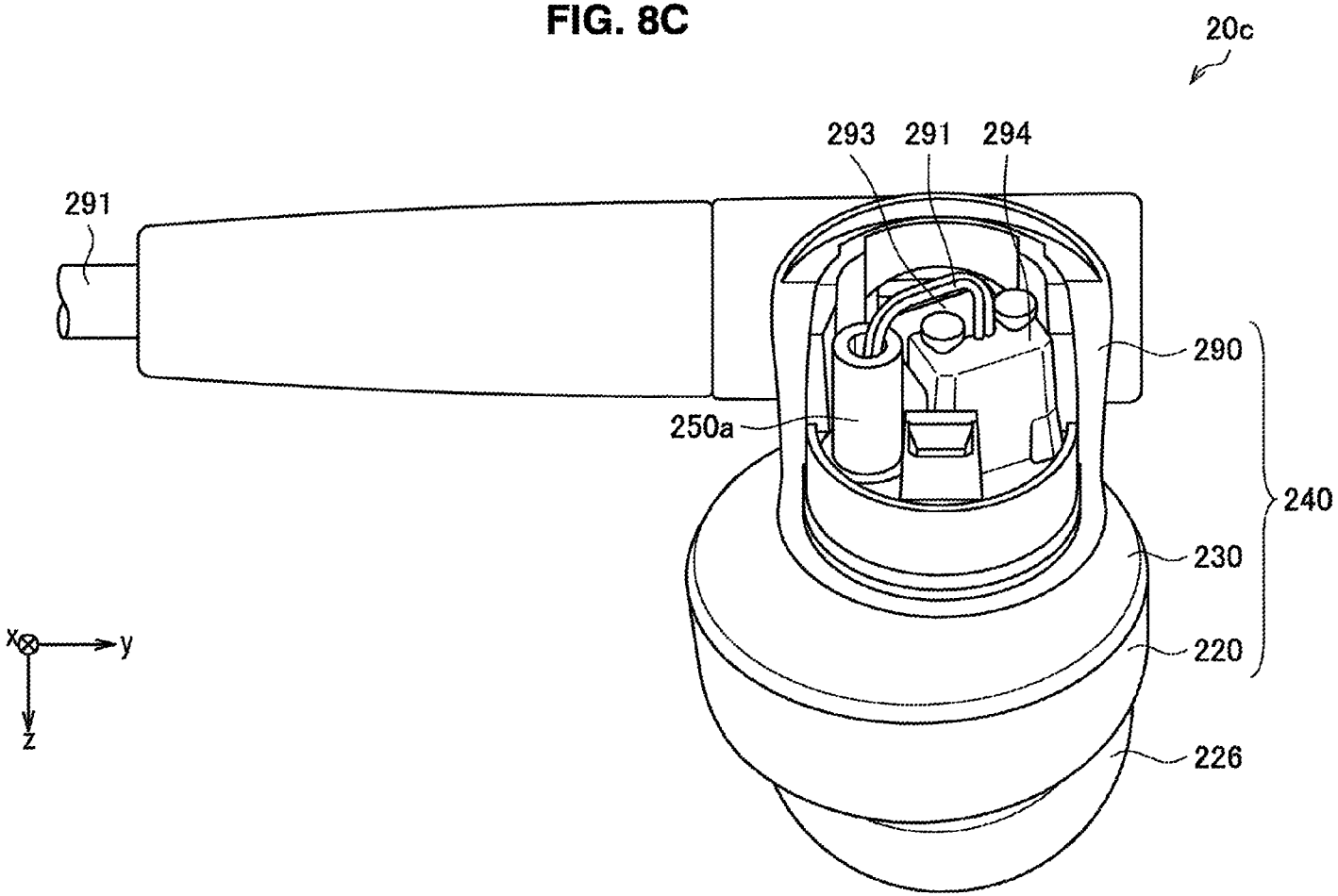
FIG. 8C is an exploded perspective diagram showing a configuration of a modified example of the headphone of the embodiment in which the way that a cable is drawn into an inner space of a cable housing is changed.

In addition, FIGS. 8B and 8C are exploded perspective diagrams showing configurations of modified examples of the headphone 20 of the present embodiment in which the way of drawing a cable 291 into an inner space 292 of the cable housing 290 is changed. Referring to FIG. 8B, a headphone 20*b* according to the present modified example corresponds to one obtained by changing the way of drawing the cable 291 into the headphone 20 shown in FIG. 7 provided with the acoustic tube 250 having a relatively small inner diameter, and other configurations may be the same as those of the headphone 20. In addition, FIG. 8B is an exploded perspective diagram corresponding to FIG. 7, showing the external appearance of the headphone 20*b* according to the present modified example in which a portion of a cable housing 290 is exploded, and the disposition of an acoustic tube 250 and a cable 291 in the cable housing 290 is illustrated.

As shown in FIG. 8B, in the headphone 20*b* according to the present modified example, the cable 291 that extends from audio equipment that outputs audio signals is drawn out between a locking member 293 and a stopper 294. Then, the cable 291 is inserted into an opening 295 that is provided in a partition wall of a rear housing 230 that is a partition wall facing an inner space 292, is extended to the inside of a rear air chamber 232, and is connected to a driver unit 210. As shown in FIG. 8B, the stopper 294 can fix both the locking member 293 and the cable 291 in the present modified example. By appropriately changing the configuration of the locking member 293 and the stopper 294 in the present embodiment as described above, the way in which the cable 291 is drawn may be appropriately changed.

In addition, FIG. 8C illustrates a configuration example of a modified example in which a way of drawing a cable 291 is changed from that of the headphone 20*a* provided with an acoustic tube 250*a* having a relatively large inner diameter shown in FIG. 8A. FIG. 8C is an exploded perspective diagram corresponding to FIG. 8A, showing the external appearance of a headphone 20*c* according to the present modified example in which a portion of a cable housing 290 is exploded, and the disposition of the acoustic tube 250*a* and the cable 291 in the cable housing 290 is illustrated.

Referring to FIG. 8C, the cable 291 that extends from acoustic equipment that outputs audio signals is drawn from a gap between a locking member 293 and a stopper 294 in the headphone 20*c* according to the present modified example, like the headphone 20*b* shown in FIG. 8B described above. In this manner, the stopper 294 can also fix both a locking member 293 and the cable 291 in the present modified example. In the present modified example, however, an opening 295 is not provided in a partition wall of a rear housing 230, and the cable 291 is inserted into the tube of the acoustic tube 250*a*, is extended to the inside of a rear air chamber 232, and is connected to a driver unit 210.

If the inner diameter of the acoustic tube 250*a* is relatively large as in the present modified example, the cable 291 may be inserted thereinto and the cable 291 may be extended to the inside of the rear air chamber 232. In this case, the opening 295 may not be provided as shown in FIG. 8C. Without providing the opening 295, it is not necessary to consider air tightness of the opening 295, and thus air tightness in the rear air chamber 232 is maintained more reliably. Note that, if the inner diameter of the acoustic tube 250*a* is relatively large and even if the cable 291 is inserted thereinto, the inside of the acoustic tube 250*a* will not be plugged with the cable 291, and thus the function of the acoustic tube 250*a* relating to acoustic characteristics will not be impaired. In addition, by appropriately calculating, for example, an inductance component Mb and a resistive component of the acoustic tube 250*a* when taking the influence caused by the insertion of the cable 291 into consideration, acoustic characteristics of the headphone 20*c* can be evaluated using the acoustic equivalent circuit 40 in the same manner as described above.

The configuration of the headphone 20 according to the embodiment of the present disclosure has been described with reference to FIGS. 4A to 4F, 5, 6, and 7. In addition, with reference to FIGS. 8A to 8C, the modified examples of the headphone 20 according to the present embodiment in which the shape of the acoustic tube 250 and the way in which the cable 291 is drawn into the inner space 292 of the cable housing 290 are changed have been described.

Figure 9:
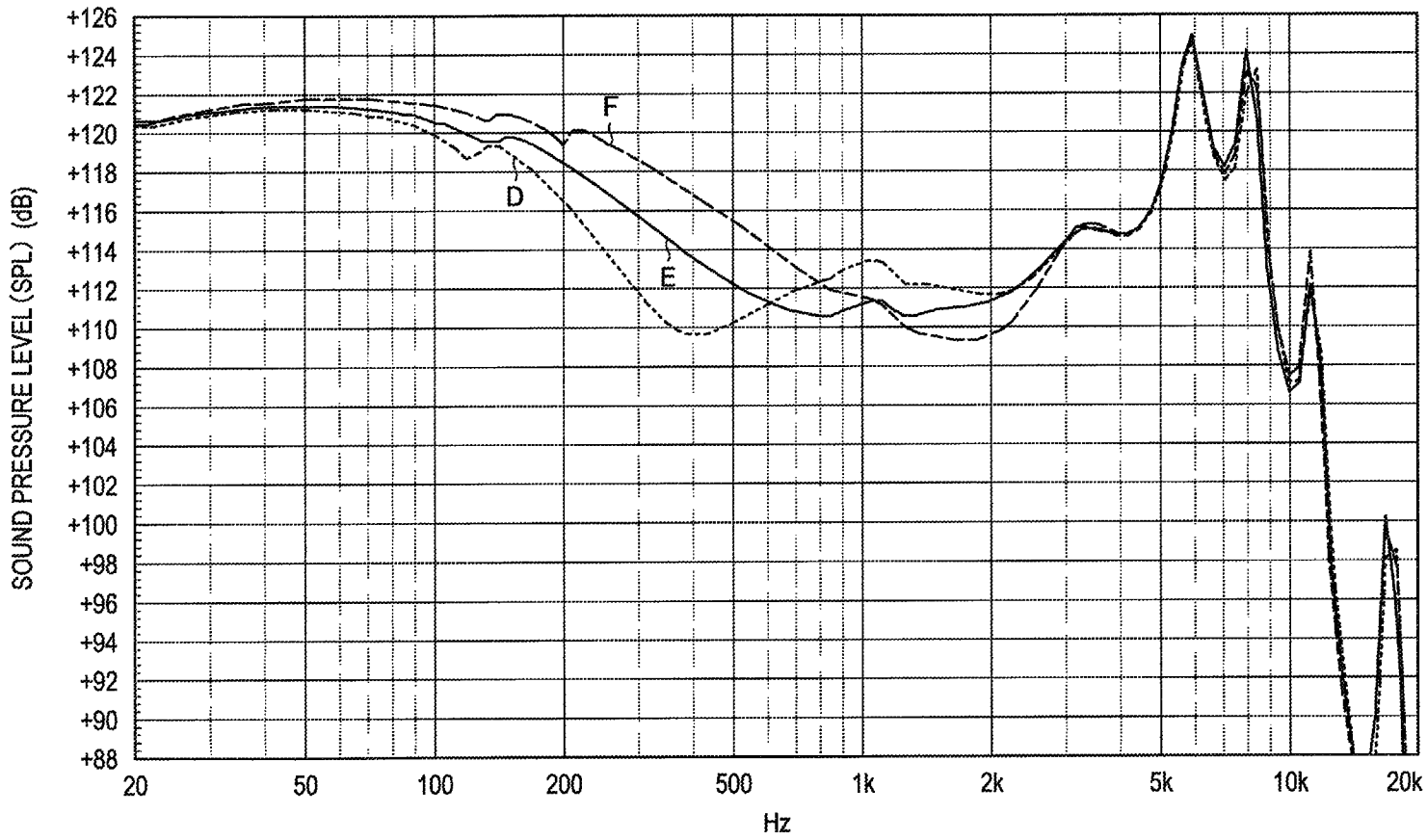
FIG. 9 is a graph diagram showing sound pressure level characteristics of the headphone according to the embodiment.
Figure 10:
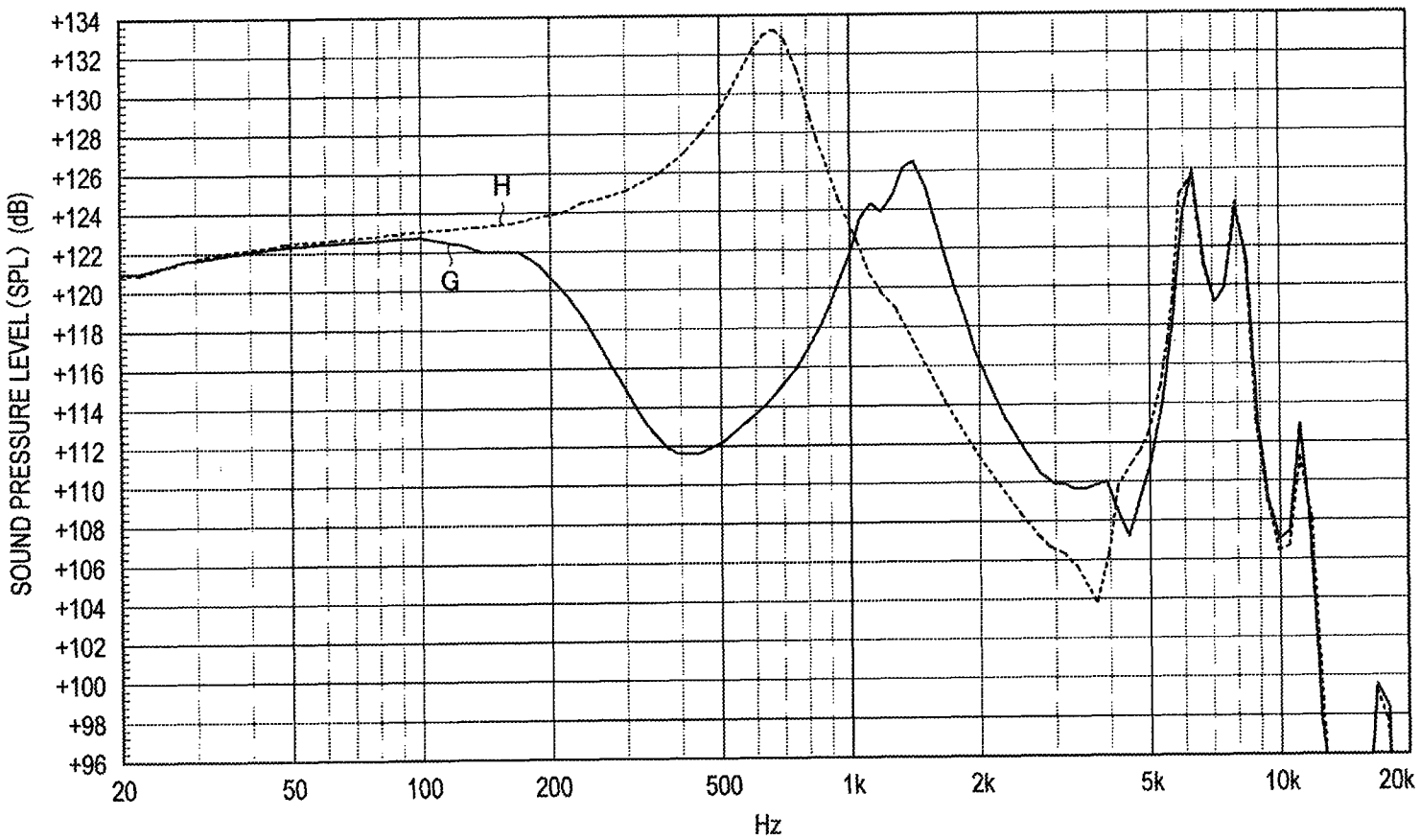
FIG. 10 is a graph diagram for describing an effect of an acoustic resistance Rd in the sound pressure level characteristic of the headphone according to the embodiment.
Figure 11A:
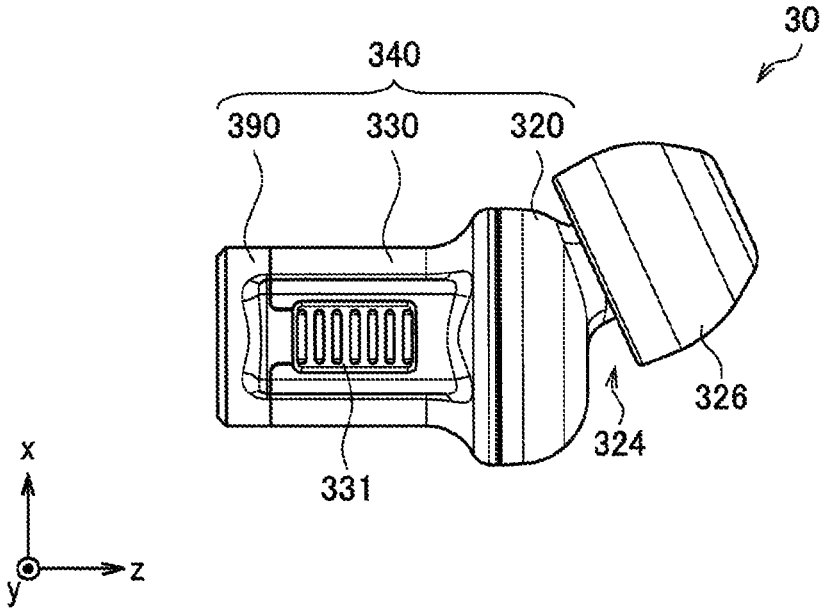
FIG. 11A is a hexahedral diagram showing the external appearance of a headphone according to a modified example of the embodiment.
Figure 11B:
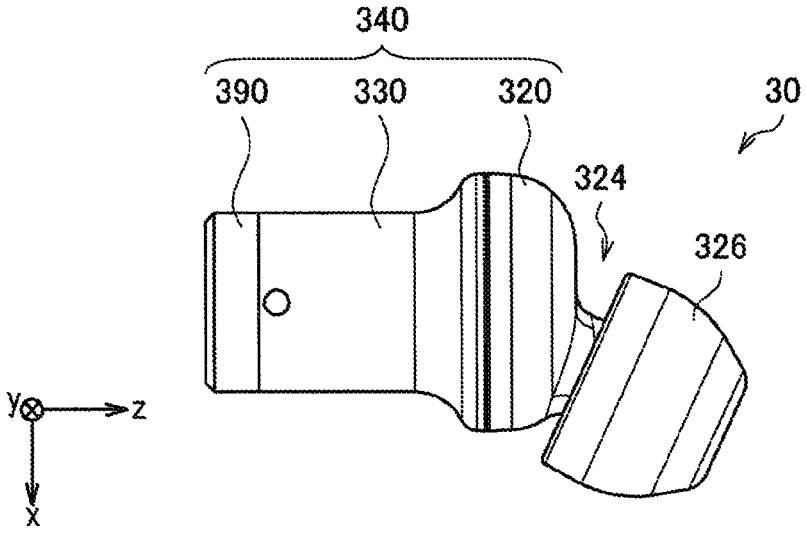
FIG. 11B is a hexahedral diagram showing the external appearance of a headphone according to a modified example of the embodiment.
Figure 11C:
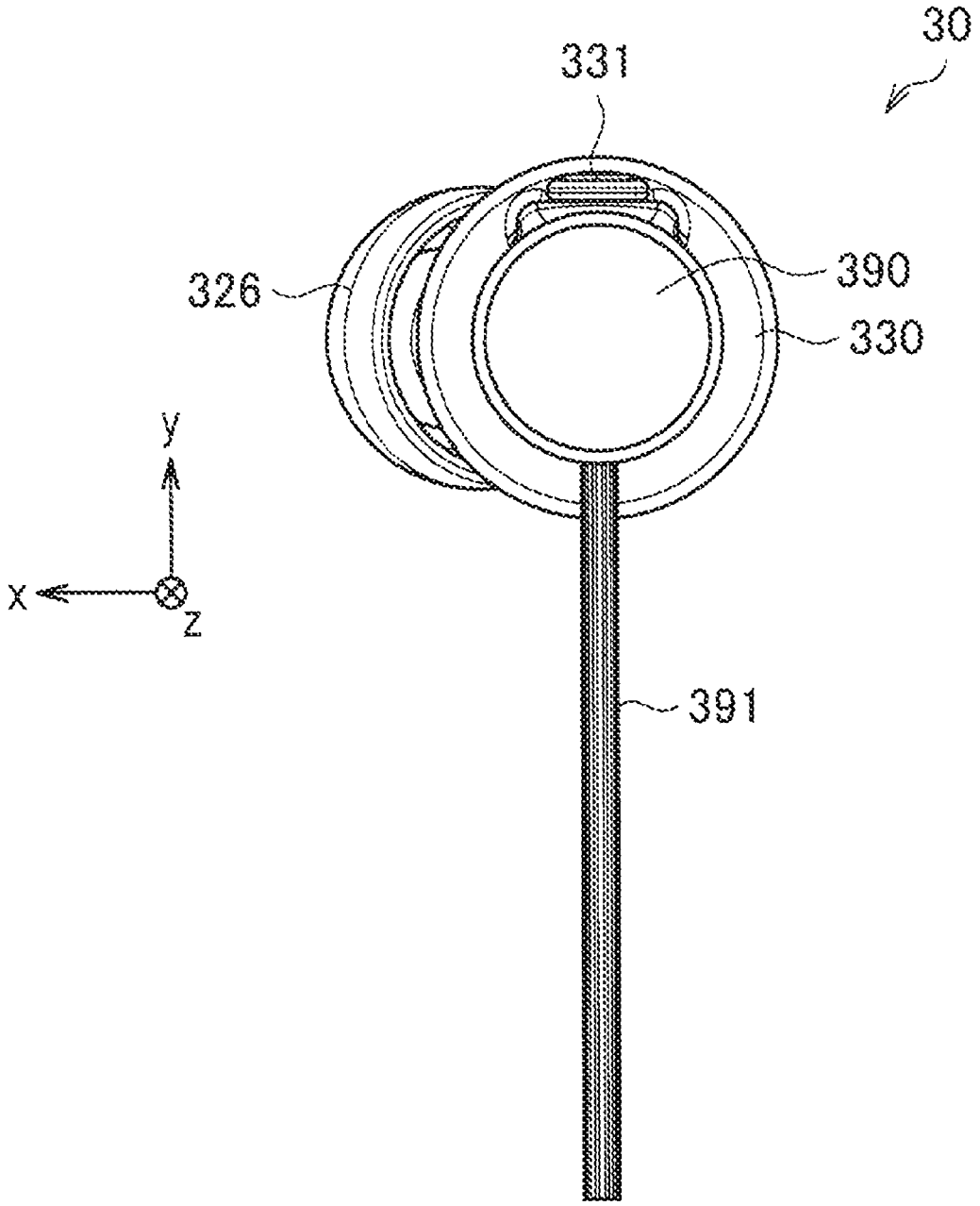
FIG. 11C is a hexahedral diagram showing the external appearance of a headphone according to a modified example of the embodiment.
Figure 11D:
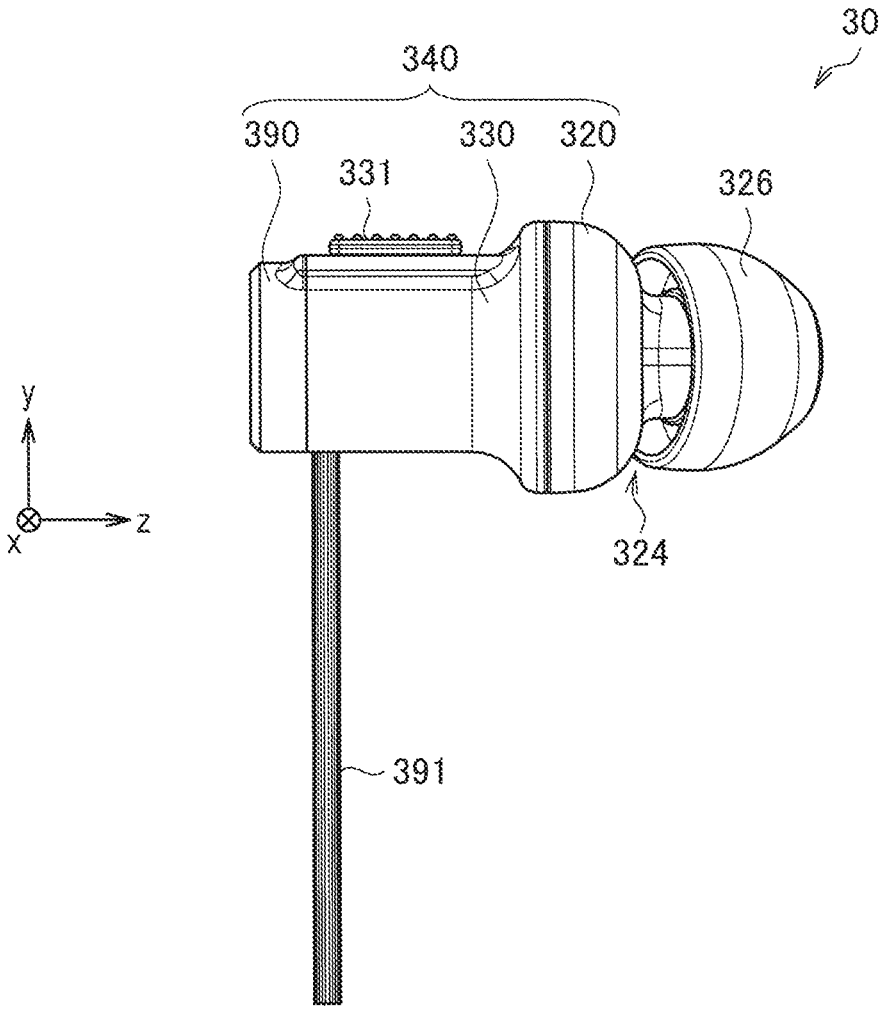
FIG. 11D is a hexahedral diagram showing the external appearance of a headphone according to a modified example of the embodiment.
Figure 11E:
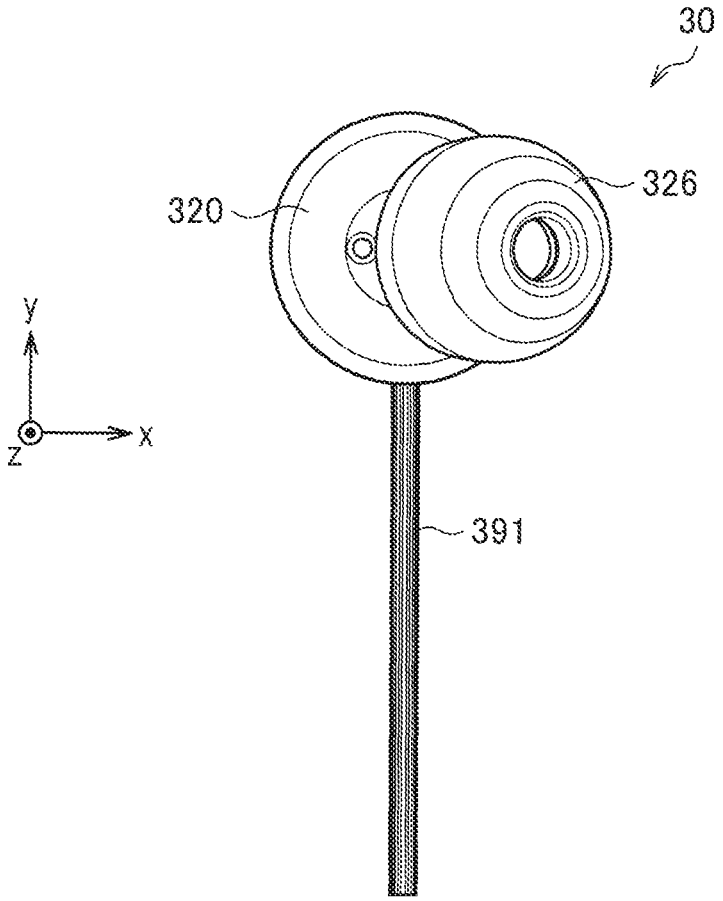
FIG. 11E is a hexahedral diagram showing the external appearance of a headphone according to a modified example of the embodiment.
Figure 11F:
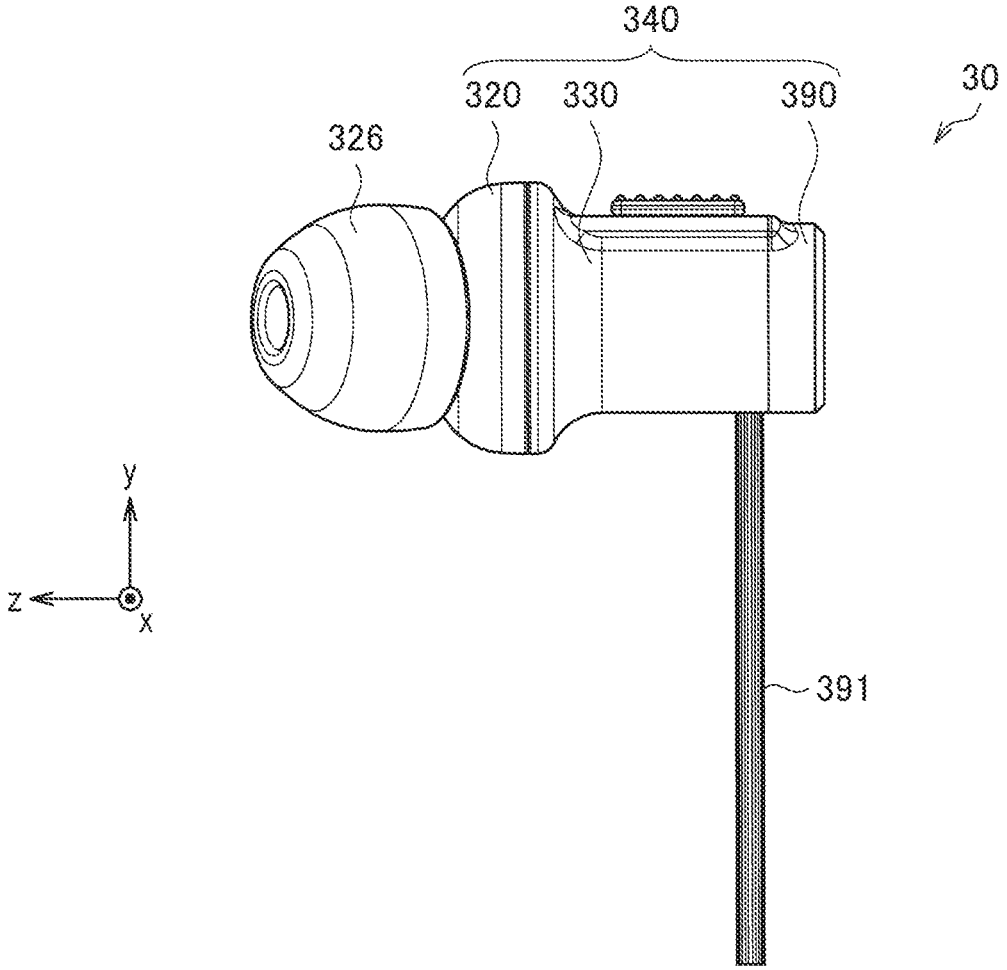
FIG. 11F is a hexahedral diagram showing the external appearance of a headphone according to a modified example of the embodiment.

3. Acoustic Characteristics of the Headphone According to the Present Embodiment Next, acoustic characteristics of the headphone 20 according to the present embodiment will be described with reference to FIGS. 9 and 10. FIG. 9 is a graph diagram showing sound pressure level characteristics of the headphone 20 according to the present embodiment. FIG. 10 is a graph diagram for describing an effect of the acoustic resistance Rd in the sound pressure level characteristics of the headphone 20 according to the present embodiment. In FIGS. 9 and 10, the horizontal axis represents frequency, the vertical axis represents sound pressure level, and the sound pressure level characteristics of the headphone 20 obtained from the analysis result of the acoustic equivalent circuit 40 shown in FIG. 2 are plotted. In FIGS. 9 and 10, however, a plurality of curves indicating sound pressure level characteristics that correspond to cases in which the configuration of the headphone 20 is changed are illustrated for comparison.

Referring to FIG. 9, three curves indicating sound pressure level characteristics are illustrated. The curve D indicated by a dotted line in the drawing indicates the sound pressure level characteristic of the headphone 20 according to the present embodiment having the configuration shown in FIGS. 4A to 4F, 5, 6, and 7. In addition, the curve F indicated by a dashed line in the drawing indicates the sound pressure level characteristic of the headphone 20 according to the present embodiment when the acoustic tube 250 is not provided (in other words, when the inductance Mb is not provided in the acoustic equivalent circuit 40). In addition, the curve E indicated by a solid line in the drawing indicates the sound pressure level characteristic of the headphone 20 according to the present embodiment when an opening that leads to the outside of the housing 240 is provided in a partition wall of the housing 240 that constitutes the rear air chamber 232, in addition to the acoustic tube 250, and a ventilation resistor that acts as resistance to a flow of air is further provided in the opening. The opening and the ventilation resistor act as a resistive component in the acoustic equivalent circuit 40, and can change an acoustic characteristic of the headphone 20. Since the ventilation resistor, which is a ventilation resistor provided in the opening formed in the partition wall of the housing 240 and is provided in the opening that spatially connects the rear air chamber 232 and the outside of the housing 240, other than the acoustic tube 250, is a resistive component provided in the partition wall of the housing 240, it will also be referred to as a housing resistance in the description below. In such a headphone having the housing resistance, the rear air chamber 232 is spatially connected to the outside of the housing 240 through at least two portions including the acoustic tube 250 and the opening in which the housing resistance is provided. In this manner, the headphone corresponding to the curve F corresponds to one obtained by removing the acoustic tube 250 from the configuration of the headphone 20 corresponding to the curve D, and the headphone corresponding to the curve E corresponds to one obtained by adding the housing resistance to the configuration of the headphone 20 corresponding to the curve D.

The curve F can be said to correspond to the curve A described with reference to FIG. 3, and to indicate the sound pressure level characteristic of an existing general headphone. Referring to FIG. 9, the curve F has a characteristic in which the sound pressure level gently decreases in the middle register. As described with reference to FIG. 3, it is hard to say that the sound pressure level characteristic indicated by the curve F is preferable for, for example, a voice of a person.

On the other hand, in the curve D indicating the characteristic of the headphone 20 according to the present embodiment, the sound pressure level decreases from the lower register to the middle register with a steeper slope than in the curve F. It can be said that, in the curve D, the stair-like sound pressure level characteristic that is one ideal acoustic characteristic is realized like that as illustrated using the curve C in FIG. 3. It can be considered that the stair-like sound pressure level characteristic is realized in the headphone 20 according to the present embodiment as shown by the curve D because, by providing the acoustic tube 250, anti-resonance caused by an acoustic inductance (inductance Mb caused by the acoustic tube 250) and an acoustic capacity (capacitance Cb caused at least by the rear air chamber 232) has occurred and thus a dip of the sound pressure level has been formed in the middle register.

In order to realize a desired sound pressure level characteristic in the present embodiment, the inner cross-sectional area and the length of the acoustic tube 250 and at least the volume of the rear air chamber 232 are adjusted, accordingly, values of the inductance Mb and the capacitance Cb are adjusted, and thereby the position of the dip (i.e., the position of a resonance frequency fh of anti-resonance) is controlled. The position of the dip can also be controlled by further adjusting the volume of driver unit rear air chamber. In the present embodiment, for example, the inner cross-sectional area and the length of the acoustic tube 250 and the volumes of the driver unit rear air chamber 218 and the rear air chamber 232 can be adjusted so that the resonance frequency fh is about 350 (Hz) to 650 (Hz). Specifically, in the example shown in FIG. 9, the curve D indicates the sound pressure level characteristic of the headphone 20 when the total volume of the driver unit rear air chamber 218 and the rear air chamber 232 is 400 ($mm^3$) and the size of the acoustic tube 250 has inner diameter=0.55 (mm) and length=8 (mm).

In addition, as described in (2. Configuration of a headphone according to the present embodiment) above, the headphone 20 according to the present embodiment can be configured such that the rear air chamber 232 is spatially blocked from the outside except for ventilation in the acoustic tube 250. In FIG. 9, the curve E which indicates the sound pressure level characteristic of the headphone which further has the housing resistance in addition to the acoustic tube 250 is also illustrated for comparison. Comparing the curve E to the curve D, it can be seen that, due to the provision of the housing resistance, the slope of the sound pressure level becomes more gentle from the lower register to the middle register. In the present embodiment as described above, if a housing resistance is not provided (in other words, if the rear air chamber 232 is configured to be spatially blocked from the outside except for ventilation in the acoustic tube 250), the sound pressure level characteristic in which the sound pressure level decreases with a steeper slope can be obtained.

In addition, FIG. 10 illustrates the sound pressure level characteristic of the headphone 20 according to the present embodiment when an acoustic resistance (resistance Rd) that corresponds to the ventilation resistor 217 provided in the vent hole 216 which spatially connects the driver unit rear air chamber 218 and the rear air chamber 232 is not provided. The curve G indicated by a solid line in the drawing indicates the sound pressure level characteristic of the headphone 20 according to the present embodiment when the ventilation resistor 217 is not provided (in other words, when the resistance Rd is not provided). The curve G can be said to correspond to the curve B described with reference to FIG. 3. In addition, the curve H indicated by a dotted line in the drawing indicates the sound pressure level characteristic of the headphone 20 according to the present embodiment when neither the acoustic tube 250 nor the ventilation resistor 217 is provided (in other words, when neither the inductance Rb nor the resistance Rd is provided). Like this, the headphone corresponding to the curve G corresponds to one obtained by removing the ventilation resistor 217 from the configuration of the headphone 20 corresponding to the curve D, and the headphone corresponding to the curve H corresponds to one obtained by removing the acoustic tube 250 and the ventilation resistor 217 from the configuration of the headphone 20 corresponding to the curve D.

Comparing the curve G to the curve H, it can be seen that, by providing the acoustic tube 250 when the resistance Rd is not provided, a dip is formed in the middle register. Referring to the curve G, however, while the dip is formed by providing the acoustic tube 250, the sound pressure level radically increases in the frequency band of about 500 (Hz) or higher, and thus it is hard to say that a sound pressure level characteristic in which a change of the sound pressure level is relatively small is obtained in the middle register. When the resistance Rd is not provided as described above, it is difficult to obtain the stair-like sound pressure level characteristic that is one ideal acoustic characteristic.

On the other hand, by providing the resistance Rd in addition to forming a dip by providing the acoustic tube 250 in the present embodiment, a value of the sound pressure level from the lower register to the middle register is adjusted. Accordingly, it is possible to realize the sound pressure level characteristic, for example, as indicated by the curve D shown in FIG. 9 in which the quality of a sound of the middle register is more improved while a sound of a lower register is more emphasized.

Here, an acoustic characteristic of an existing headphone as described in, for example, Patent Literature 1 will be reviewed. For example, the headphone described in Patent Literature 1 is provided with a duct structure that is similar to the acoustic tube 250 of the present embodiment.

A front air chamber of the existing headphone, however, is not an air-tightened front air chamber, and thus a relatively high sound pressure level is not maintained in the lower register. In addition, the headphone described in Patent Literature 1 above is provided with such a housing resistance described above in a rear air chamber. If the housing resistance is provided, the slope that indicates a decrease of the sound pressure level from the lower register to the middle register becomes gentle as described with reference to FIG. 9. Thus, the sound pressure level characteristic of the headphone described in Patent Literature 1 is not necessarily a preferable characteristic from the perspective of more improving the quality of a sound of the middle register while more emphasizing a sound of the lower register.

On the other hand, in the present embodiment, it is possible to realize the acoustic characteristic in which the sound pressure level in the lower register is higher than the sound pressure level in the middle register, i.e., a sound of the lower register is more emphasized by forming the air tightened front air chamber. In addition, as described with reference to FIG. 9, as a housing resistance is not provided in the present embodiment, the slope that indicates a decrease of the sound pressure level from the lower register to the middle register can be steeper.

As described above, it is considered that, even if the configuration described in Patent Literature 1 is applied without change, it is difficult to realize the acoustic characteristic of the headphone 20 according to the present embodiment. It is possible to say that, as the front air chamber is set to be air tightened and a housing resistance is not provided in the rear housing 230 in the headphone 20 according to the present embodiment, a desired sound pressure level characteristic in which the quality of a sound of the middle register is more improved while a sound of the lower register is more emphasized is realized.

4. Acoustic Tube Design Method

Next, a specific design method of the acoustic tube 250 and driver unit 210 according to the present embodiment will be described exemplifying the headphone 20. As described with reference to FIG. 3, by adjusting the value of the resonance frequency fh of anti-resonance caused by the capacitance Cd, the capacitance Cb, and the inductance Mb in the present embodiment, the acoustic characteristic of the headphone 20 is improved. Here, the inductance Mb depends on the length and the inner cross-sectional area of the acoustic tube 250, the capacitance Cb depends on the volume of the rear air chamber 232 (i.e., the shape of the housing 240), and the capacitance Cd depends on the volume of the driver unit rear air chamber 218 (i.e., the shape of the driver unit 210) as described above. As an example of the present embodiment, a method of designing the length and the inner cross-sectional area of the acoustic tube 250, and the volumes of the rear air chamber 232 and the driver unit rear air chamber 218 which cause the resonance frequency fh of anti-resonance to be included in the frequency band of 350 (Hz) to 650 (Hz) will be described below.

Note that, as the ventilation resistor 217 provided between the rear air chamber 232 and the driver unit rear air chamber 218, one having a relatively small resistance to a flow of air (i.e., one having relatively small resistance Rd) can be selected in the present embodiment as described in (2. Configuration of a headphone according to the present embodiment) above. Thus, for the sake of simplification in description below, the combined capacitance of the capacitance Cb and the capacitance Cd (i.e., the volume that corresponds to the total volume of the rear air chamber 232 and the driver unit rear air chamber 218) is assumed to be Cs, and a case in which anti-resonance occurs due to the inductance Mb and the capacitance Cs will be described. When a more sophisticated analysis is to be performed, values of Mb, the capacitance Cb, and the capacitance Cd that can impart the desired resonance frequency fh can be obtained through calculation using, for example, various circuit simulations and the like with respect to acoustic equivalent circuit 40 shown in FIG. 2.

The resonance frequency fh (Hz) of anti-resonance caused by the inductance Mb and the capacitance Cs is expressed by Expression (1) below.

[Math. 1]

$$fh = \frac{1}{2\pi\sqrt{Mb \times Cs}} \tag{1}$$

In addition, the inductance Mb is expressed by Expression (2) below by setting the length of the acoustic tube 250 to L (m) and the inner cross-sectional area thereof to S ($m^2$).

[Math. 2]

$$Mb = \rho \times \frac{L}{S} \tag{2}$$

Here, ρ ($kg/m^3$) represents air density. In addition, the capacitance Cs is expressed by Expression (3) below by setting the volume of the driver unit rear air chamber 218 and the rear air chamber 232 to V ($m^3$). Note that c (m/s) represents sound velocity in air.

[Math. 3]

$$Cs = \frac{V}{\rho c^2} \tag{3}$$

Using Expressions (1) to (3) described above, it is possible to obtain conditions for the length L and the inner cross-sectional area S of the acoustic tube 250 and the volume V of the rear air chamber 232 and the driver unit rear air chamber 218 that can cause, for example, the resonance frequency fh to be included in the frequency band of 350 (Hz) to 650 (Hz). For example, the relations between the resonance frequency fh and the length L of the acoustic tube 250 and the inner cross-sectional area S of the acoustic tube 250 in the case of V=400 ($mm^3$) are shown in the following table. Note that, in the table below, as parameters indicating the length L (mm) of the acoustic tube 250 and the inner cross-sectional area S ($mm^2$) of the acoustic tube 250, ratios L/S ($1/mm^2$) of the length L (mm) of the acoustic tube 250 to the inner cross-sectional area S ($mm^2$) thereof are calculated.

TABLE 1

| Resonance frequency fh (Hz) | L/S ($1/mm^2$) |
|---|---|
| 200 | 140 |
| 250 | 90 |
| 300 | 62 |
| 350 | 45 |
| 400 | 35 |
| 450 | 28 |
| 500 | 22 |
| 550 | 19 |
| 600 | 16 |
| 650 | 13 |
| 700 | 11 |
| 750 | 10 |
| 800 | 9 |
| 850 | 8 |
| 900 | 7 |

Referring to the table above, it can be seen that the ratio L/S (1/mm) of the length L (mm) of the acoustic tube 250 to the inner cross-sectional area S ($mm^2$) thereof is desirably 13 to 45 (1/mm) in order to cause the resonance frequency fh to be included in 350 (Hz) to 650 (Hz). In reality, for example, it may be possible that several types of acoustic tubes 250 having different shapes are prepared and they can be differently used according to applications. For example, it may be possible in the present embodiment that an acoustic tube 250 having an inner diameter of 0.6 (mm) and a length of 8 (mm) and an acoustic tube 250 having an inner diameter of 1.2 (mm) and a length of 8 (mm) are produced and headphones 20 each provided with the acoustic tubes 250 are produced as headphones 20 of different types.

In the present embodiment, a shape (a length and an inner cross-sectional area) of the acoustic tube 250, a shape of the housing 240, and a shape of the driver unit 210 which causes the resonance frequency fh to be included in a desired frequency band, for example, 200 (Hz) to 400 (Hz), can be designed using Expressions (1) to (3) as described above. In the example above, as an example of a method for designing the acoustic tube 250, the housing 240, and the driver unit 210 according to the present embodiment, the method for designing the acoustic tube 250, the housing 240, and the driver unit 210 has been introduced under conditions in which the resonance frequency fh is to be included in the range of 350 (Hz) to 650 (Hz) and the volume V of the rear air chamber 232 and the driver unit rear air chamber 218 is to be 400 ($mm^3$); however, the present embodiment is not limited thereto. Even in cases of conditions in which the resonance frequency fh is to be included in another frequency band and the volume V of the rear air chamber 232 and the driver unit rear air chamber 218 is to have another value, the acoustic tube 250, the housing 240, and the driver unit 210 can be designed using the same method as described above.

Note that, when values of a length L (mm) and an inner cross-sectional area S ($mm^2$) of the acoustic tube 250 are designed, processing accuracy in manufacturing the acoustic tube 250 may be considered. For example, minimum values of a length L (mm) and an inner cross-sectional area S ($mm^2$) may be limited to values at which the acoustic tube 250 can be manufactured within a predetermined dimensional tolerance. In addition, a shape of the driver unit 210 can directly affect an acoustic characteristic of sounds generated by the driver unit 210. Thus, when the driver unit 210 is designed, the acoustic characteristic of sounds generated by the driver unit 210 may be considered. In addition, when a shape of the housing 240 is designed, elements other than an acoustic characteristic, for example, user wearability of the headphone 20 and designability thereof may be considered. In the case of a canal earphone as exemplified in FIG. 6, for example, a size of the housing 240 is set to be relatively small, and in the case of so-called overhead headphones, for example, a size of the housing 240 is set to be larger. In this manner, a shape of the housing 240 may be designed comprehensively in consideration of wearability, designability, and the like of the headphone 20, in addition to the acoustic characteristic.

5. Modified Example

According to the present embodiment, the headphone having the acoustic characteristic in which the quality of a sound of the middle register is more improved while a sound of the lower register is more emphasized is realized as described above. However, there is a desire to more freely adjust an acoustic characteristic of the same headphone according to preference of a user or a peripheral situation.

Generally, there are headphones with a relatively large housing that houses a driver unit, such as so-called overhead headphones, which are provided with a mechanism for adjusting an acoustic characteristic (hereinafter referred to as an acoustic characteristic adjustment mechanism). However, since a size of a housing is small in a so-called inner-ear headphone such as a canal earphone, it is difficult to provide an acoustic characteristic adjustment mechanism, and thus there are few products that have the acoustic characteristic adjustment mechanism.

In rare cases, there are inner-ear headphones provided with an acoustic characteristic adjustment mechanism. In order to adjust an acoustic characteristic in such an acoustic characteristic adjustment mechanism, however, a relatively cumbersome operation, for example, rotating a screw or replacing a component using a dedicated tool such as a screwdriver is necessary.

Taking the above-described circumstances into consideration, a technology for enabling an acoustic characteristic to be adjusted more easily even in a headphone with a relatively small size of a housing such as an inner-ear headphone has been demanded. Thus, as a result of discussing a technology for enabling an acoustic characteristic to be adjusted more easily, the present inventors think that an acoustic characteristic adjustment mechanism that enables an acoustic characteristic to be adjusted through a relatively simple operation can be realized using the headphone according to the embodiment described above.

As a modified example of the present embodiment, a modified example in which an acoustic characteristic adjustment mechanism with which an acoustic characteristic can be adjusted through a simpler operation is added to the embodiment described above will be described below. Note that a headphone according to the present modified example to be described below is one in which the acoustic characteristic adjustment mechanism to be described below is added to the headphone of the embodiment described above, and other configurations thereof may be substantially the same as the headphone of the embodiment described above. Thus, in the description with regard to the present modified example below, the detailed description regarding the configurations described above will be omitted, and different configurations from the embodiment above will be mainly described.

In addition, with respect to the headphone according to the present modified example, it is possible to generate an acoustic equivalent circuit that represents characteristics of the headphone according to the present modified example by replacing configurations with electric elements, as in the acoustic equivalent circuit 40 shown in FIG. 2. The acoustic equivalent circuit of the headphone according to the present modified example can be one obtained by changing some elements of the acoustic equivalent circuit 40 shown in FIG. 2 corresponding to the constituent members that are newly added in the present modified example. Thus, as in FIGS. 1 and 6, reference symbols of the elements of the acoustic equivalent circuit 40 are affixed to several reference numbers given to the constituent members of the headphone according to the present modified example.

(5-1. Configuration of the Headphone According to the Present Modified Example)

Figure 12A:
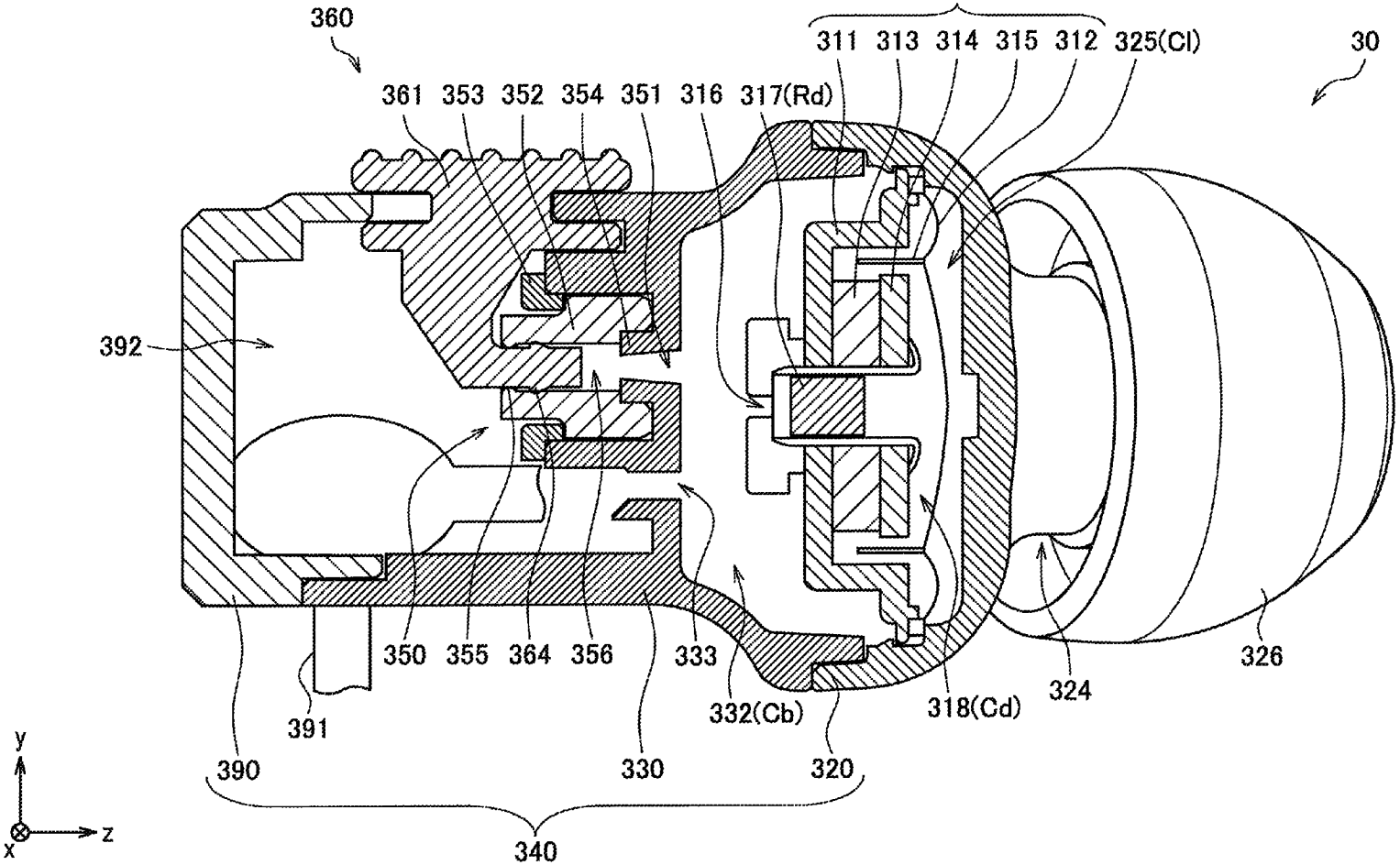
FIG. 12A is a cross-sectional diagram of one cross-section of the headphone according to the modified example.
Figure 12B:
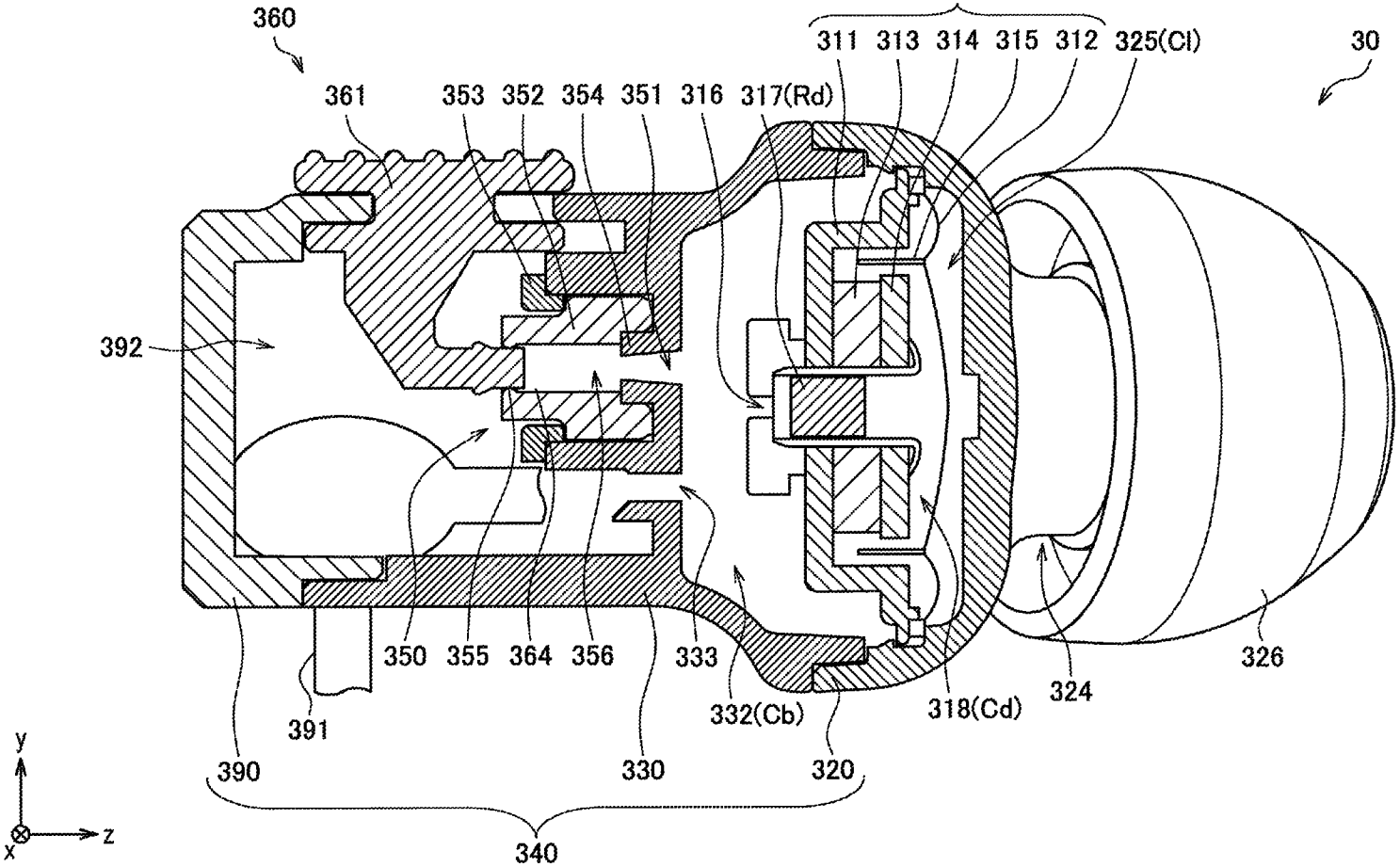
FIG. 12B is a cross-sectional diagram of one cross-section of the headphone according to the modified example.
Figure 13A:
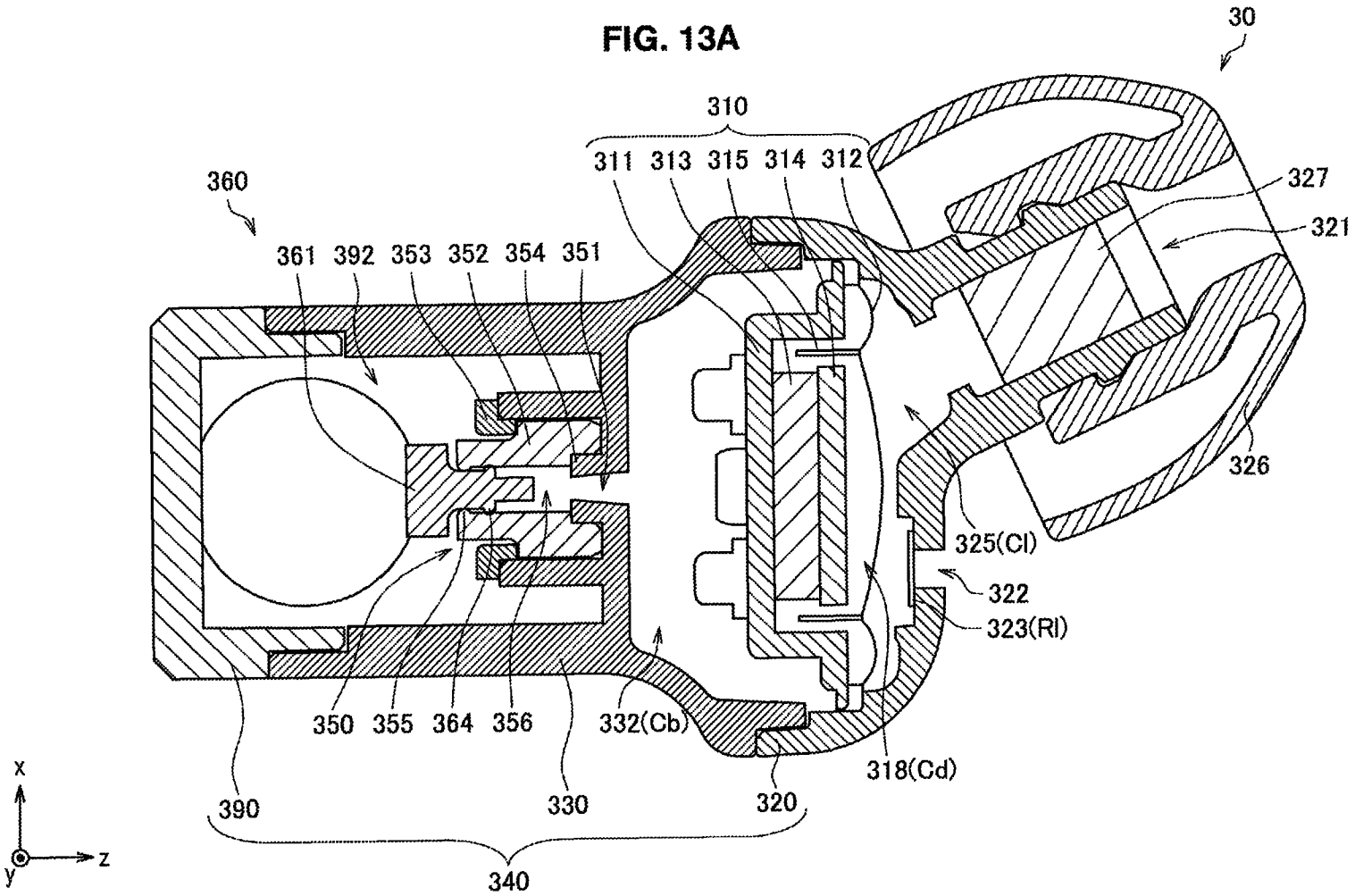
FIG. 13A is a cross-sectional diagram of another cross-section of the headphone according to the modified example.
Figure 13B:
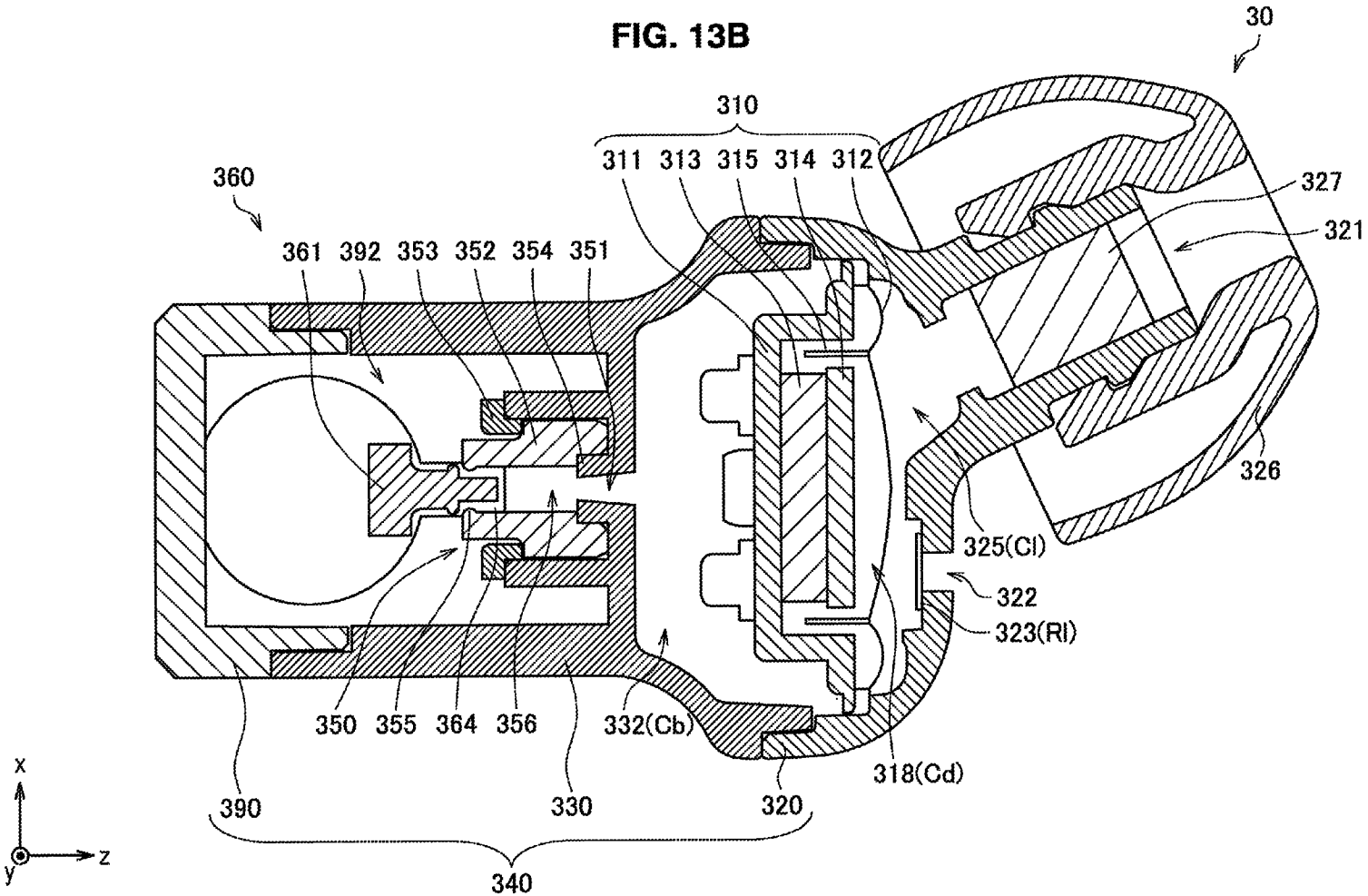
FIG. 13B is a cross-sectional diagram of another cross-section of the headphone according to the modified example.
Figure 14:
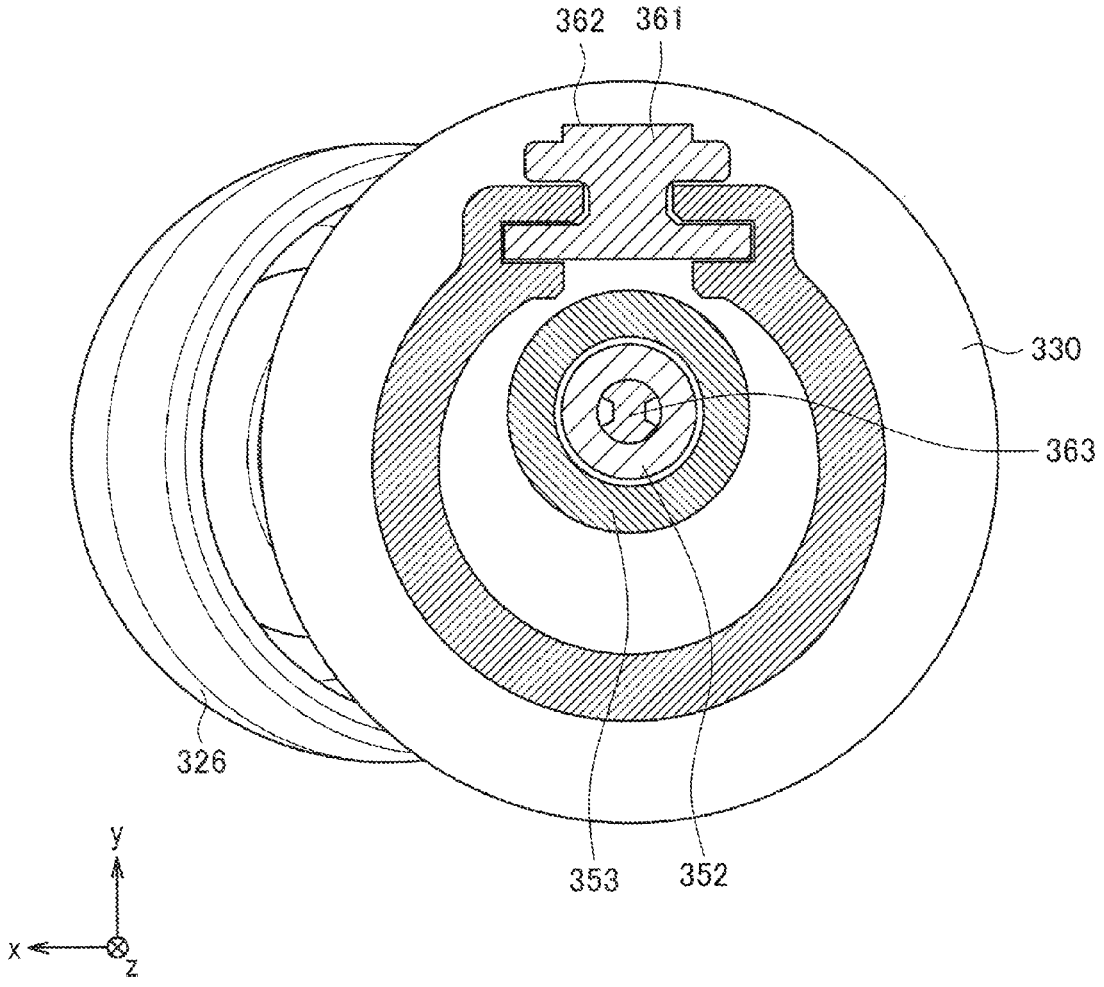
FIG. 14 is a cross-sectional diagram of still another cross-section of the headphone according to the modified example.
Figure 15:
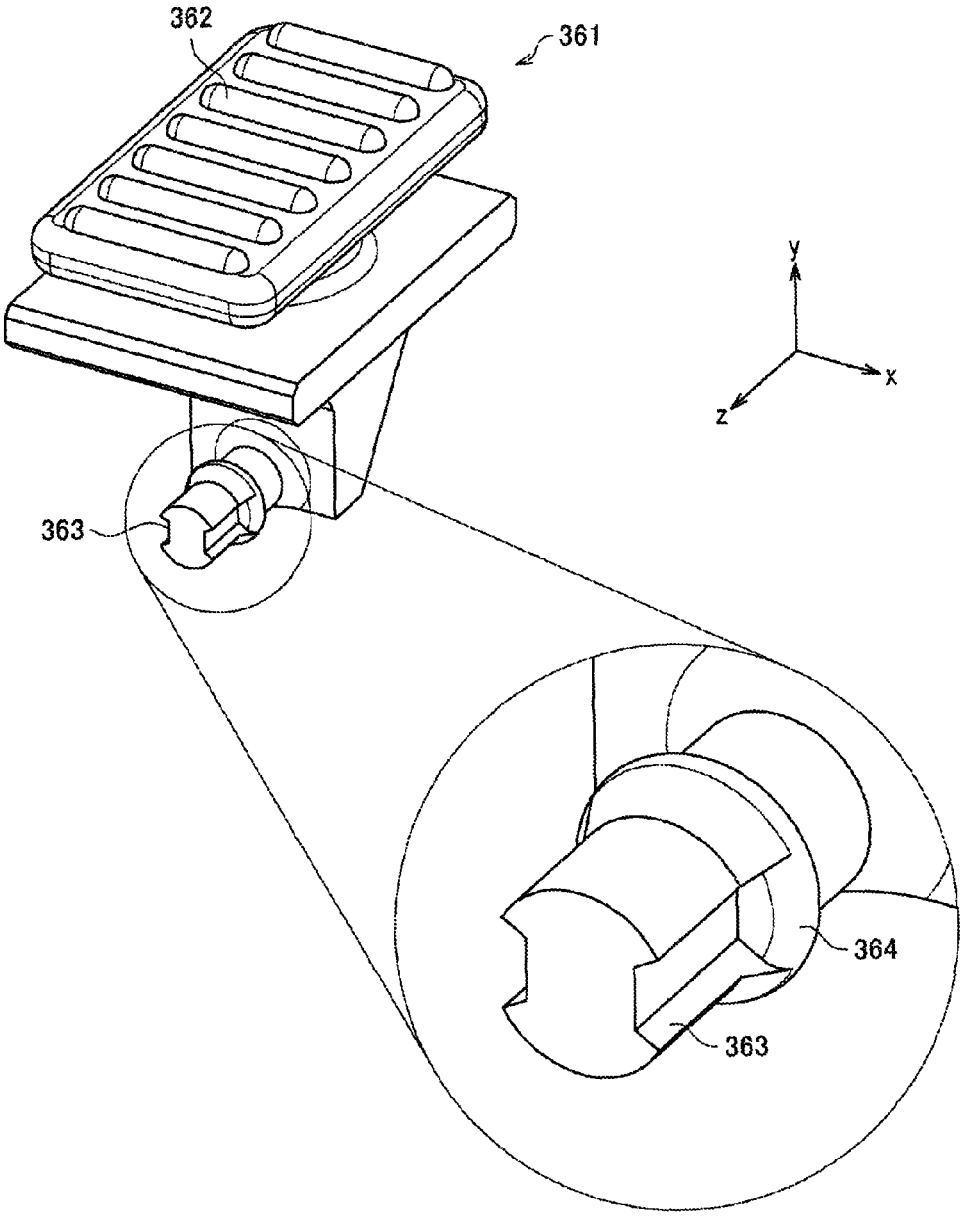
FIG. 15 is a perspective diagram showing a configuration of a switch member mounted in the headphone according to the modified example.

A configuration of the headphone according to a modified example of the present embodiment will be described with reference to FIGS. 11A to 15. FIGS. 11A to 11F are hexahedral diagrams showing the external appearance of the headphone according to a modified example of the present embodiment. FIGS. 12A and 12B are cross-sectional diagrams of one cross-section of the headphone according to the present modified example. FIGS. 13A and 13B are cross-sectional diagrams of another cross-section of the headphone according to the present modified example. FIG. 14 is a cross-sectional diagram of still another cross-section of the headphone according to the present modified example. FIG. 15 is a perspective diagram showing a configuration of a switch member mounted in the headphone according to the present modified example.

Note that FIGS. 12A and 12B are the cross-sectional diagrams of the cross-section of the headphone according to the present modified example, which is parallel with the y-z plane, and is obtained by cutting an acoustic tube 350 to be described below in a longitudinal direction. In addition, FIGS. 13A and 13B are the cross-sectional diagrams of the cross-section of the headphone according to the present modified example, which is parallel with the x-z plane, and is obtained by cutting the acoustic tube 350 to be described below in a longitudinal direction. In addition, FIG. 14 is the cross-sectional diagram of the cross-section of the headphone according to the present modified example, which is parallel with the x-y plane and is obtained by cutting the acoustic tube 350 to be described below in a radial direction.

In addition, as will be described below, the switch member shown in FIG. 15 constitutes an acoustic characteristic adjustment mechanism, and when the switch member is operated, an acoustic characteristic is adjusted in the present modified example. FIGS. 12A and 12B illustrate states of the headphone before and after the switch member is moved. Likewise, FIGS. 13A and 13B also illustrate states of the headphone before and after the switch member is moved.

Referring to FIGS. 11A to 14, a headphone 30 according to the present modified example is provided with a driver unit 310, a housing 340 that houses the driver unit 310, and an acoustic characteristic adjustment mechanism 360. Note that the headphone 30 illustrated in FIGS. 11A to 14 is simplified for description of the present modified example, and the headphone 30 may be further provided with constituent members that are not illustrated. Since the constituent members that are not illustrated can be those known as configurations of existing general headphones, detailed description thereof will be omitted.

The driver unit 310 has a frame 311, a vibration plate 312, a magnet 313, a plate 314, and a voice coil 315. The driver unit 310 corresponds to the driver units 110 and 210 shown in FIGS. 1 and 6. In addition, the frame 311, the vibration plate 312, the magnet 313, the plate 314, and the voice coil 315 each correspond to the frames 111 and 211, the vibration plates 112 and 212, the magnets 113 and 213, the plates 114 and 214, and the voice coils 115 and 215 shown in FIGS. 1 and 6.

A driver unit rear air chamber 318 is formed between the frame 311 and the vibration plate 312. An element that corresponds to vibratory force generated when the vibration plate 312 vibrates corresponds to a signal source (electromotive force) Vs of the acoustic equivalent circuit 40. In addition, a mass, mechanical resistance, and compliance of the driver unit 310 respectively correspond to inductance Mo, resistance Ro, and capacitance Co of the acoustic equivalent circuit 40. Furthermore, a capacity of the driver unit rear air chamber 318 corresponds to the capacitance Cd of the acoustic equivalent circuit 40.

As shown in FIGS. 12A and 12B, a vent hole 316 that passes through the frame 311 in the z axis direction is provided in the frame 311 of the driver unit 310. The vent hole 316 corresponds to the vent holes 116 and 216 shown in FIGS. 1 and 6. The vent hole 316 is provided substantially at the center of the frame 311, and spatially connects the driver unit rear air chamber 318 and the space which is a space on the rear side of the driver unit 310 and is surrounded by the driver unit 310 and the housing 340 (a rear air chamber 332 to be described below).

The vent hole 316 is provided with a ventilation resistor 317 that plugs the hole. The ventilation resistor 317 corresponds to the ventilation resistors 117 and 217 shown in FIGS. 1 and 6. A resistive component of the ventilation resistor 317 to a flow of air corresponds to resistance Rd in the acoustic equivalent circuit 40.

Here, a material and a shape of the ventilation resistor 317 may be appropriately set so that a desired sound pressure level characteristic is obtained in consideration of, for example, the sound pressure level characteristic shown in FIG. 3. More specifically, as described with reference to FIG. 3, a material and a shape of the ventilation resistor 317 can be appropriately set so that a value of the resistance Rd with which the stair-like sound pressure level characteristic is obtained is realized. In this manner, a characteristic relating to a ventilation resistance such as a material of the ventilation resistor 317 can be appropriately selected in consideration of the influence of the resistance Rd on the acoustic characteristic of the headphone 30. In addition, since the configuration and the function of the ventilation resistor 317 are the same as those of the ventilation resistors 117 and 217 described above, detailed description thereof will be omitted.

Note that, like the vent hole 216 described with reference to FIG. 6, a formation position of the vent hole 316 and the number thereof to be formed are not limited to the example shown in FIGS. 12A and 12B in the present modified example. A position in the frame 311 at which the vent hole 316 is provided may be a position at which the ventilation resistor 317 provided in the vent hole 316 has the same function as in the acoustic equivalent circuit 40, and may be appropriately set in consideration of, for example, disposition positions of other constituent members in the housing 340.

The housing 340 corresponds to the housings 140 and 240 shown in FIGS. 1 and 6. A front air chamber 325 which is a space surrounded by the driver unit 310 and the housing 340 is formed on the front side of the driver unit 310. In addition, the rear air chamber 332 which is a space surrounded by the driver unit 310 and the housing 340 is formed on the rear side of the driver unit 310. The volume of the front air chamber 325 and the volume of the rear air chamber 332 respectively correspond to capacitance Cl and capacitance Cb in the acoustic equivalent circuit 40.

The housing 340 can be composed of a plurality of members. As shown in FIGS. 11A to 13B, the housing 340 is formed by joining the front housing 320 that covers the front side of the driver unit 310, the rear housing 330 that covers the rear side of the driver unit 310, and the cable housing 390 that covers the cable 391.

A sound guiding tube 324 that is a tubular portion protruding toward the outside is formed in a partial region of the front housing 320. The sound guiding tube 324 corresponds to the sound guiding tubes 124 and 224 shown in FIGS. 1 and 6. In addition, an earpiece 326 for bringing the sound guiding tube 324 in close contact with the inner wall of an external auditory canal of a user is provided in the outer circumference of a tip of the sound guiding tube 324. An opening for sound output (an opening 321 shown in FIGS. 13A and 13B) is provided inside the sound guiding tube 324, and when a user listens to a sound, the tip of the sound guiding tube 324 including the earpiece 326 is inserted into the external auditory canal of the user as shown in FIG. 5. As described above, the headphone 30 according to the present modified example may be the so-called canal earphone.

An equalizer 327 which is a ventilation resistor is provided inside the sound guiding tube 324. By appropriately setting a material and a shape of the equalizer 327, adjustment of sound quality, for example, reducing a component of a specific frequency band for an output sound or the like, can be performed.

Openings 321 and 322 that spatially connect the inside and the outside of the housing 340 are provided in the partition wall of the front housing 320. The openings 321 and 322 correspond to the openings 121 and 221, and the openings 122 and 222 shown in FIGS. 1 and 6. The opening 321 is an opening for outputting sounds to the outside, and is provided at the position corresponding to the sound guiding tube 324 as described above.

The opening 322 is provided with a ventilation resistor 323 to plug the hole. The ventilation resistor 323 corresponds to the ventilation resistors 123 and 223 shown in FIGS. 1 and 6. Like the ventilation resistors 123 and 223, a material and a shape of the ventilation resistor 323 are selected to substantially block air. In the present modified example, the front air chamber 325 may be an air-tightened air chamber that is spatially blocked from the outside except for the opening 321 as described. A resistive component of the ventilation resistor 323 to a flow of air corresponds to the resistance Rl of the acoustic equivalent circuit 40.

Openings 333 and 351 that spatially connect the rear air chamber 332 and an inner space 392 of the cable housing 390 are provided in partial regions of the partition wall of the rear housing 330. The opening 333 is an opening for inserting the cable 391 thereinto. The cable 391 that extends from acoustic equipment (not illustrated) that outputs audio signals is connected to the driver unit 310, passing through the inner space 392 of the cable housing 390 via the opening 333. Note that, in FIGS. 12A and 12B, the state of the cable 391 inserted into the opening 333 is not illustrated to avoid the drawing becoming more complicated.

Although the opening 333 is illustrated as spatially connecting the rear air chamber 332 and the inner space 392 in FIGS. 12A and 12B, actually, after the cable 391 is inserted into the opening 333, the remaining space of the opening 333 is plugged with an arbitrary sealing material which maintains air tightness. In this manner, in the headphone 30, only the opening 351 spatially connects the rear air chamber 332 and the inner space 392 of the cable housing 390.

A tubular part 354 that projects toward the inner space 392 of the cable housing 390 in a tubular shape is provided along the edge of the opening 351. The tubular part 354 is formed to have a cylindrical shape. The tubular part 354 constitutes at least a partial side wall of the acoustic tube 350 that spatially connects the rear air chamber 332 and the inner space 392 through the tube, and the opening 351 can constitute a hollow part of the acoustic tube 350.

A packing 352 in a hollow cylindrical shape is fitted to the outer circumferential part of the tubular part 354. The inner diameter of the packing 352 is formed to correspond to the outer diameter of the cylindrical tubular part 354, and both are fitted with air tightness maintained. As shown in FIGS. 12A to 13B, one end of the packing 352 having a cylindrical shape is fitted to the tubular part 354, and the other end of the packing 352 extends toward the inner space 392. Since the fitted portion of the tubular part 354 and the packing 352 maintains air tightness as described above, the tubular part 354 and the packing 352 can function as a single tube. In this manner, the acoustic tube 350 can be configured by the tubular part 354 and the packing 352 in the present modified example. The acoustic tube 350 corresponds to the acoustic tubes 150 and 250 shown in FIG. 1 and FIG. 6.

The acoustic tube 350 is formed to have a length and an inner cross-sectional area in which a predetermined inductance component can be obtained with respect to a flow of air passing through the inside of the acoustic tube 350. The inductance component of the acoustic tube 350 with respect to a flow of air functions as inductance Mb that acts on an acoustic characteristic in the acoustic equivalent circuit 40.

A length and an inner cross-sectional area of the acoustic tube 350 may be appropriately set so that a desired sound pressure level characteristic is obtained in consideration of, for example, the sound pressure level characteristic shown in FIG. 3. Specifically, as described with reference to FIG. 3, the length and the inner cross-sectional area of the acoustic tube 350 can be appropriately set so that a value of the inductance Mb that causes a resonance frequency at which anti-resonance occurs to be positioned in a desired frequency band is realized. For example, a shape of the acoustic tube 350 may be designed according to the technique described in (4. Acoustic tube design method) above. By providing the acoustic tube 350 designed above, the headphone 30 can realize, for example, the stair-like sound pressure level characteristic as described with reference to FIG. 3, like the headphones 10 and 20 of the embodiments described above.

The packing 352 can be formed of any of various elastic materials that are generally used for packing (sealing member), for example, natural rubber, synthetic rubber, a resin material, and the like. Thus, the packing 352 can be an elastic body.

Partial regions of the partition wall of the rear housing 330 are extended toward the inner space 392 as shown in FIGS. 12A to 13B so that the regions come in contact with the outer circumferential part of the packing 352. The contact face of the outer circumferential part of the packing 352 and the extending portions is welded using, for example, ultrasonic waves or the like. Accordingly, the packing 352 is reliably fixed to the partition wall of the rear housing 330, and thus air tightness of the fitting part of the tubular part 354 and the packing 352 can be further strengthened.

A supporting member 353 having a ring shape is fitted to the outer circumferential part of a portion of the packing 352 that extends toward the inner space 392. The supporting member 353 is attached to the packing 352 to press the packing 352 toward the tubular part 354 (in other words, in the forward direction of the z axis in the drawing). Accordingly, the packing 352 can be more reliably fixed to the partition wall of the rear housing 330, the tubular part 354 can come in close contact with the packing 352, and air tightness in the fitting part of the tubular part 354 and the packing 352 can be further strengthened.

Here, in the present modified example, the inner space 392 of the cable housing 390 is connected to the outside of the housing 340 (i.e., the outside of the headphone 30) with no substantial resistance to a flow of air. Thus, the acoustic tube 350 can be said to connect the rear air chamber 332 and the outside of the housing 340 (i.e., the outside of the headphone 20) through the tube. Note that, in order to realize such a configuration in the present modified example, for example, an opening having a size in which no substantial resistance to a flow of air is generated may be provided in the partition wall of the cable housing 390, or the joining part of the rear housing 330 and the cable housing 390 may be joined in a simple method without taking air tightness into consideration.

In addition, in the present modified example, since the opening 333 is plugged after the cable 391 is inserted thereinto as described above, the rear air chamber 332 is configured to be spatially blocked from the inner space 392 (i.e., the outside of the headphone 30) except for ventilation in the acoustic tube 350. In order to realize the configuration, the joining part of the front housing 320 and the rear housing 330 are joined in a state in which, for example, air tightness is maintained using an adhesive or the like.

By providing the acoustic tube 350 in the headphone 30 according to the present modified example as described above, the same stair-like sound pressure level characteristic is realized as in the headphones 10 and 20 according to the embodiments described above. In the headphone 30 according to the present modified example, however, the acoustic characteristic adjustment mechanism 360 that adjusts an acoustic characteristic of the headphone 30 by changing a characteristic of the acoustic tube 350 is further provided.

The acoustic characteristic adjustment mechanism 360 is constituted by a switch member 361. The switch member 361 is constituted by an operation part 362 having a substantial plate shape and a boss 363 that projects in the substantial parallel direction with a plane of the plate shape of the operation part 362 and has a substantially cylindrical shape as shown in FIG. 15.

The switch member 361 is attached to the housing 340 such that the boss 363 is inserted into an opening 356 of the packing 352 (i.e., the opening 356 of the acoustic tube 350) and the operation part 362 is positioned outside of the housing 340 as shown in FIGS. 12A to 14. In addition, in this state, the switch member 361 is attached to the housing 340 to be movable in parallel with the projection direction of the boss 363 (the z axis direction in the drawing). In other words, the boss 363 is inserted into and removed from the opening 356 of the packing 352 through parallel movements of the switch member 361.

Here, a projecting part 364 that projects in the radial direction is provided in a partial region of the boss 363 in the longitudinal direction as shown in FIGS. 12A to 15. In addition, the boss 363 and the projecting part 364 are configured such that the outer diameter of the boss 363 is smaller than the inner diameter of the packing 352 and the outer diameter of the projecting part 364 is greater than the inner diameter of the packing 352.

By forming the outer diameter of the boss 363, the outer diameter of the projecting part 364, and the inner diameter of the packing 352 so as to satisfy the above size relation, when the boss 363 is inserted into the opening 356 of the packing 352, the projecting part 364 of the boss 363 is press-fitted into the opening 356 of the packing 352 that is an elastic body. Thus, the projecting part 364 comes in pressured contact with the entire circumference of the inner wall of the opening 356 of the packing 352, and thus the opening 356 is plugged to more reliably prevent ventilation in the opening 356.

Here, a length of the boss 363 is adjusted in the present modified example such that, when the boss 363 is pulled out from the opening 356 of the packing 352, the boss 363 is not completely pulled out from the opening 356 of the packing 352 and a tip of the boss 363 is slightly positioned inside the opening 356 of the packing 352 (see FIGS. 12B and 13B). In addition, a formation position of the projecting part 364 in the longitudinal direction of the boss 363 is adjusted such that, when the boss 363 is pulled out from the opening 356 of the packing 352, at least the projecting part 364 is pulled out from the opening 356 of the packing 352. In other words, when the boss 363 is pulled out from the opening 356 of the packing 352 while the tip of the boss 363 is positioned inside the opening 356 of the packing 352, the projecting part 364 of the boss 363 is not press-fitted into the opening 356 of the packing 352 that is an elastic body, and thus ventilation in the opening 356 of the packing 352 is maintained.

Note that, notches are formed on side faces of the boss 363 that has a pillar shape in the longitudinal direction of the pillar as shown in FIGS. 14 and 15. Thus, when the boss 363 is pulled out from the opening 356 of the packing 352, even in the state in which the tip of the boss 363 is slightly inserted into the opening 356 of the packing 352, ventilation in the opening 356 of the packing 352 can be maintained due to the notches at substantially the same degree as when there is not the switch member 361.

A user can, for example, operate the switch member 361 to move it in the z axis direction with his or her finger pressing the upper face of the operation part 362. With this operation, an insertion length of the boss 363 into the opening 356 of the packing 352 is adjusted. FIGS. 12A and 13A illustrate a state in which the switch member 361 moves in the forward direction of the z axis, the boss 363 is inserted into the opening 356 of the packing 352, the opening 356 is plugged by the projecting part 364, and thus ventilation is not performed in the acoustic tube 350 (hereinafter, this state will also be referred to as a closed state). In addition, FIGS. 12B and 13B illustrate a state in which the switch member 361 moves in the backward direction of the z axis, the projecting part 364 of the boss 363 is pulled out from the opening 356 of the packing 352, and thus ventilation in the acoustic tube 350 is ensured (hereinafter, this state will also be referred to as an open state).

In the open state, ventilation in the acoustic tube 350 is ensured, and thus the acoustic tube 350 has the same characteristics as those of the acoustic tubes 150 and 250 of the above-described embodiments. Thus, in the open state, the same stair-like sound pressure level characteristic is realized in the headphone 30 as in the above-described embodiments.

On the other hand, in the closed state, ventilation in the acoustic tube 350 is obstructed. Thus, the acoustic tube 350 does not function as a tube that spatially connects the rear air chamber 332 and the inner space 392, and thus the headphone 30 has a different acoustic characteristic from the stair-like sound pressure level characteristic. Specifically, as ventilation in the acoustic tube 350 is not ensured, operations of the vibration plate 312 of the driver unit 310 are suppressed, and a sound pressure level in a lower register drastically decreases more than when ventilation occurs. Note that a difference in acoustic characteristics in the open state and the closed state will be described in detail in (5-2. Acoustic characteristic of a headphone according to the present modified example) below.

As described above, in the present modified example, the acoustic characteristic adjustment mechanism 360 has the function of adjusting an acoustic characteristic of the headphone 30 by changing the ventilation in the acoustic tube 350. Specifically, as the boss 363 of the switch member 361 is inserted into and removed from the opening 356 of the packing 352 (i.e., the opening 356 of the acoustic tube 350), the ventilation in the acoustic tube 350 is adjusted, and thus the acoustic characteristic of the headphone 30 is adjusted. In addition, with the configuration in which the projecting part 364 of the boss 363 is press-fitted into the packing 352 that is an elastic body, it is possible to switch the state in which ventilation in the acoustic tube 350 is ensured (the open state) and the state in which ventilation is not performed (the closed state) more reliably.

Here, in the present modified example, a length of the boss 363 is adjusted as described above so that the tip of the boss 363 is slightly positioned in the opening 356 of the packing 352 even in the open state. This is because, if the tip of the boss 363 is completely pulled from the opening 356 of the packing 352 in the open state, there is a possibility that, when a user next attempts to operate the switch member 361 and insert the boss 363 into the opening 356, the tip of the boss 363, for example, comes in contact with an edge of the opening 356 or the like and thus a smooth insertion is obstructed. When smooth insertion is not performed, there is concern of user operability deteriorating. In the present modified example, by adjusting the length of the boss 363 to the extent that the boss 363 is not completely removed from the opening 356 of the packing 352 even in the open state, the smooth insertion of the boss 363 into the opening 356 becomes possible and thus user operability can be improved.

In addition, a projecting part 355 that projects in a radial direction is provided in a partial region on the inner wall of the opening 356 of the packing 352 in the longitudinal direction as shown in FIGS. 12A to 15. The projecting part 355 is appropriately provided at a tip of the opening 356 of the packing 352 on the side on which the boss 363 of the switch member 361 is inserted. Accordingly, in the course of transition from the open state to the closed state and the course of transition from the closed state to the open state, the projecting part 364 of the boss 363 moves as if sliding over the projecting part 355 of the opening 356 of the packing 352, in other words, the projecting part 364 of the boss 363 and the projecting part 355 of the opening 356 of the packing 352 are engaged and rub against each other.

Thus, when a user operates the switch member 361, the feeling given when the projecting part 364 of the boss 363 passes over the projecting part 355 of the opening 356 of the packing 352 is transferred to the user. Based on that feeling, the user can sense the transition from the open state to the closed state and the transition from the closed state to the open state, and thus can know a current state.

The configuration of the headphone 30 according to a modified example of the present embodiment has been described with reference to FIGS. 11A to 15. As described above, the acoustic characteristic adjustment mechanism 360 that adjusts the acoustic characteristic of the headphone 30 by changing the characteristic of the acoustic tube 350 is provided in the present modified example. According to the present modified example, by switching into the open state that is a state in which ventilation in the acoustic tube 350 is ensured and the closed state in which ventilation is not performed in the acoustic tube 350 with the acoustic characteristic adjustment mechanism 360, the acoustic characteristic of the headphone 30 can be adjusted.

The acoustic characteristic adjustment mechanism 360 is constituted by, for example, the switch member 361 that has the function of adjusting the ventilation in the acoustic tube 350. The switch member 361 has a relatively simple configuration in which the ventilation in the acoustic tube 350 is adjusted by inserting or removing the boss 363 into or from the acoustic tube 350. In addition, since the switch member 361 is moved manually by a user, another configuration for driving the switch member 361 such as a power source is also unnecessary. In the present modified example, by configuring the acoustic characteristic adjustment mechanism 360 with such a relatively simple configuration like the switch member 361, the acoustic characteristic adjustment mechanism 360 can also be mounted in a headphone having a housing of a relatively small size such as an inner-ear headphone.

In addition, according to the present modified example, a user can adjust the acoustic characteristic of the headphone 30 with a relatively simple operation of sliding the switch member 361. In addition, the user can easily know a current state (the open state or the closed state) based on a position of the switch member 361. In this manner, according to the present modified example, user operability and usability can be improved.

Note that, although the acoustic tube 350 is configured by the tubular part 354 and the packing 352 as one end of the cylindrical packing 352 is fitted to the tubular part 354 that is formed by projection of a part of the partition wall of the rear housing 330 as described above in the example shown in FIGS. 11A to 14, the present modified example is not limited thereto. As the acoustic tube 350, another configuration, for example, the acoustic tube 150 shown in FIG. 1 or the acoustic tube 250 shown in FIG. 6 may be applied.

The acoustic tube 350 may be configured by the tubular part 354 such that, for example, the length of the tubular part 354 is formed to be longer. In other words, the packing 352 may not be provided. In this case, the acoustic tube 350 is formed to be integrated with the rear housing 330, like the acoustic tube 150 shown in FIG. 1. Here, in order to plug the opening 356 of the acoustic tube 350 more reliably and thus set the state in which ventilation does not occur, it is desirable to form either of the acoustic tube 350 and a member used to plug the opening 356 of the acoustic tube 350 (the boss 363 in the above example) using an elastic body and to press-fit one into the other. Thus, it is preferable that, when the acoustic tube 350 has the same configuration as the acoustic tube 150 shown in FIG. 1, for example, the boss 363 of the switch member 361 be formed of an elastic body and the boss 363 formed of the elastic body be press-fitted into the acoustic tube 350. Alternatively, the opening 356 of the acoustic tube 350 may be plugged such that the switch member 361 has a cylindrical member formed of an elastic body whose one end is sealed and the other end is opened, and a tip of the acoustic tube 350 may be press-fitted into the opened end of the cylindrical member.

In addition, the acoustic tube 350 may be configured by inserting a tubular member into an opening that does not have a projecting part formed on a partition wall of the rear housing 330, like the acoustic tube 250 shown in FIG. 6. In this way, another configuration can also be applied to the acoustic tube 350, like, for example, the acoustic tube 150 shown in FIG. 1, or the acoustic tube 250 shown in FIG. 6.

In addition, in the present modified example, a configuration of the acoustic characteristic adjustment mechanism 360 is not limited to the example described above. The acoustic characteristic adjustment mechanism 360 can have any of various types of configurations. Another configuration example of the acoustic characteristic adjustment mechanism 360 will be described in detail in (5-3. Another configuration example of the acoustic characteristic adjustment mechanism) below.

(5-2. Acoustic Characteristic of a Headphone According to the Present Modified Example)

Figure 16:
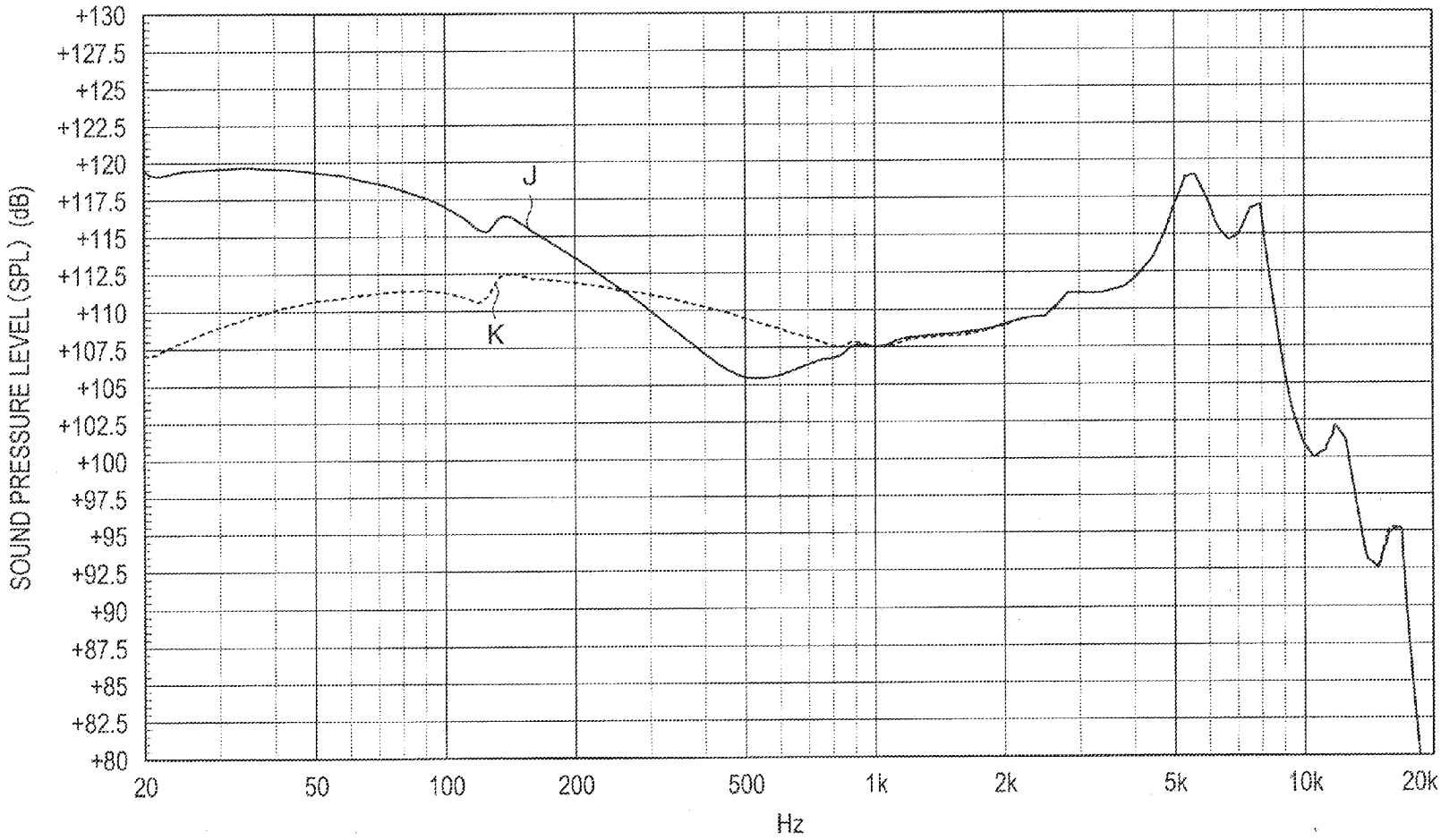
FIG. 16 is a graph diagram showing sound pressure level characteristics of the headphone according to the modified example.

An acoustic characteristic of the headphone 30 according to the present modified example will be described with reference to FIG. 16. FIG. 16 is a graph diagram showing sound pressure level characteristics of the headphone 30 according to the present modified example. In FIG. 16, the horizontal axis represents frequency, the vertical axis represents sound pressure level, and the sound pressure level characteristics of the headphone 30 that are obtained from the analysis result of the acoustic equivalent circuit that corresponds to the headphone 30, which is the same as the acoustic equivalent circuit 40 shown in FIG. 2, are plotted.

Referring to FIG. 16, two curves indicating sound pressure level characteristics are illustrated. The curve J indicated by a solid line in the drawing indicates the sound pressure level characteristic of the headphone 30 according to the present modified example in the open state, i.e., the state in which ventilation in the acoustic tube 350 is ensured. The curve K indicated by a dotted line in the drawing indicates the sound pressure level characteristic of the headphone 30 according to the present modified example in the closed state, i.e., the state in which ventilation is not performed in the acoustic tube 350.

As indicated by the curve J, the headphone 30 in the open state obtains the stair-like sound pressure level characteristic (in other words, the sound pressure level characteristic in which a sound pressure level is relatively high in the lower register, the sound pressure level decreases relatively steeply from the lower register to the middle register, and the sound pressure level shows a relatively little change in the middle register), like the curve D shown in FIG. 9. On the other hand, referring to the curve K indicating the sound pressure level characteristic of the headphone 30 in the closed state, it can be seen that the sound pressure level in the lower register decreases more drastically than the curve J. The reason for this is considered to be, since ventilation is substantially not performed in the acoustic tube 350 in the closed state, the amount of air in the rear air chamber 332 is limited, and operations of the vibration plate 312 of the driver unit 310 are suppressed.

The acoustic characteristic of the headphone 30 according to the present modified example has been described above with reference to FIG. 16. It is possible to appropriately switch a plurality of different acoustic characteristics in the headphone 30 according to the present modified example according to preference of a user or peripheral circumstances by providing the acoustic characteristic adjustment mechanism 360 as described above. Specifically, the sound pressure level characteristic of the lower register can be adjusted with the acoustic characteristic adjustment mechanism 360.

Thus, in a situation in which noise is loud and low-pitched sounds are hardly heard, for example, on a train, if the headphone 30 is set to the open state, the sound pressure level in the lower register can be further improved and low-pitched sounds can be more emphasized. Conversely, if the headphone 30 is set to the closed state in a place in which ambient noise is not very loud, it is possible to cause the sound pressure level in the lower register to decrease and low-pitched sounds not to be emphasized more than necessary.

In addition, it is possible in the headphone 30 to switch the open state and the closed state with a relatively simple operation, e.g., sliding the switch member 361, as described above. Thus, a user can adjust the acoustic characteristics as described above more freely and more quickly according to a change in a peripheral situation.

Here, comparing the curve K and the curve J, it can be seen that, in the middle register and the upper register, in particular, in the frequency band in which the frequency is 1 (kHz) or higher, both curves show substantially the same sound pressure level characteristic. In the headphone 30 according to the present modified example as described above, even if acoustic characteristics are switched using the acoustic characteristic adjustment mechanism 360, the sound pressure level characteristic in the middle register and the upper register that are registers relating to human voices (for example, vocal ranges, or the like) rarely changes. If the sound pressure level characteristic of the middle register and the upper register remarkably changes, a user feels a significant change of sound quality, and thus there is a possibility of the user feeling discomfort. In the present modified example, however, since only the sound pressure level characteristic of the lower register is mainly adjusted using the acoustic characteristic adjustment mechanism 360 as described above, a change of an acoustic characteristic that could give a feeling of discomfort to a user does not occur.

Here, the headphone 30 according to the present modified example can, of course, benefit by having the acoustic tube 350 in the open state, as described in (3. Acoustic characteristics of the headphone according to the present embodiment) above. The benefit gained by having the acoustic tube 350 refers to the fact that, in an air-tightened headphone, for example, a difference in sound pressure levels of the lower register and the middle register and a frequency band that causes the difference in sound pressure levels can be adjusted, thus an adjustable range of an acoustic characteristic is widened, and thus fluctuating quality of sound particularly having a significant difference in sound pressure levels of the lower register and the middle register can be realized. The headphone 30 according to the present modified example is set to have an acoustic characteristic that can be changed more easily as necessary while maintaining the advantage gained by having the acoustic tube 350.

(5-3. Another Configuration Example of the Acoustic Characteristic Adjustment Mechanism)

The acoustic characteristic adjustment mechanism 360 according to the present modified example can have any of various configurations in addition to the configuration described in (5-1. Configuration of the headphone according to the present modified example) above. Here, another configuration example of the acoustic characteristic adjustment mechanism will be described.

Although the acoustic characteristic adjustment mechanism 360 is, for example, constituted by the switch member 361 and has the function of adjusting the acoustic characteristic of the headphone 30 in two stages by switching the two states that are the open state or the closed state, the present modified example is not limited thereto. The acoustic characteristic adjustment mechanism 360 may have a function of adjusting the acoustic characteristic of the headphone 30 in multiple stages or consecutively. Thus, the acoustic characteristic adjustment mechanism 360, for example, has a function of changing the characteristic of the acoustic tube 350 in multiple stages or consecutively.

The acoustic characteristic adjustment mechanism 360, for example, may change an amount of ventilation in the acoustic tube 350 in multiple stages or consecutively to adjust an acoustic characteristic of the headphone 30 in multiple stages or consecutively.

For example, a plurality of notches with different lengths in the longitudinal direction may be formed in the outer circumferential part of the boss 363. Accordingly, according to a length of the boss 363 to be inserted into the opening 356 of the packing 352, the number of notches that contribute to ventilation in the acoustic tube 350 changes, in other words, an amount of the ventilation in the acoustic tube 350 changes, and thus the ventilation in the acoustic tube 350 can be adjusted by stages.

Furthermore, in that configuration, either of the projecting part 364 of the boss 363 and the projecting part 355 of the packing 352 may be provided in a plurality having a predetermined interval in the longitudinal direction according to a length of the notches. Accordingly, while the boss 363 is once inserted into the opening 356 of the packing 352 or the boss 363 is once removed from the opening 356 of the packing 352, contact of the projecting part 364 of the boss 363 and the projecting part 355 of the packing 352 occurs a plurality of times. Thus, the position of the switch member 361 in the movement direction changes by stages. At this time, the change in the position of the switch member 361 in the movement direction by stages is linked to a change of an amount of ventilation by stages caused by differences in the lengths of the notches (for example, ventilation is performed with one notch in a state in which the switch member 361 moves by one stage, ventilation is performed with two notches in a state in which the switch member 361 moves by two stages, and the like), and thus a user can know a change of an amount of ventilation in the acoustic tube 350 by stages based on a position of the switch member 361 in the movement direction.

In addition, for example, the notches of the boss 363 may be formed in a tapered shape (in other words, may be formed such that the amount of notches gradually changes in the longitudinal direction). Accordingly, it is possible to consecutively adjust the amount of ventilation in the acoustic tube 350 according to an amount of the boss 363 to be inserted into the opening 356 of the packing 352.

In addition, for example, a screw thread may be cut into the outer circumferential part of the boss 363 and on the inner wall of the opening 356 of the packing 352 and the boss 363 may be inserted into and removed from the opening 356 while being screwed with the opening 356 of the packing 352. In this case, the acoustic characteristic adjustment mechanism 360 is not a member having a mechanism that slides in one direction like the switch member 361, but can be configured with a member having a mechanism that rotates the boss 363 in the longitudinal direction as an axis of rotation direction. Since insertion and removal of the boss 363 into and from the opening 356 of the packing 352 are performed using a screw, it is possible to consecutively change an amount of the boss 363 to be inserted into the opening 356 of the packing 352 at a fixed ratio. By using not only the screw mechanism but also, for example, the configuration in which the notches of the boss 363 are formed in the tapered shape as described above, it is possible to consecutively change an amount of ventilation in the acoustic tube 350.

Here, the acoustic characteristic adjustment mechanism 360 may change the characteristic of the acoustic tube 350 by changing an element other than the amount of ventilation in the acoustic tube 350. The acoustic tube 350 functions as the inductance Mb in the acoustic equivalent circuit as described above. In addition, a value of the inductance Mb depends on a length and an inner cross-sectional area (i.e., inner diameter) of the acoustic tube 350. Thus, the acoustic characteristic adjustment mechanism 360 may have a mechanism that changes the length and the inner diameter of the acoustic tube 350 to change the length and the inner diameter and change the inductance Mb of the acoustic tube 350, and thereby adjust the acoustic characteristic of the headphone 30.

Figure 17:
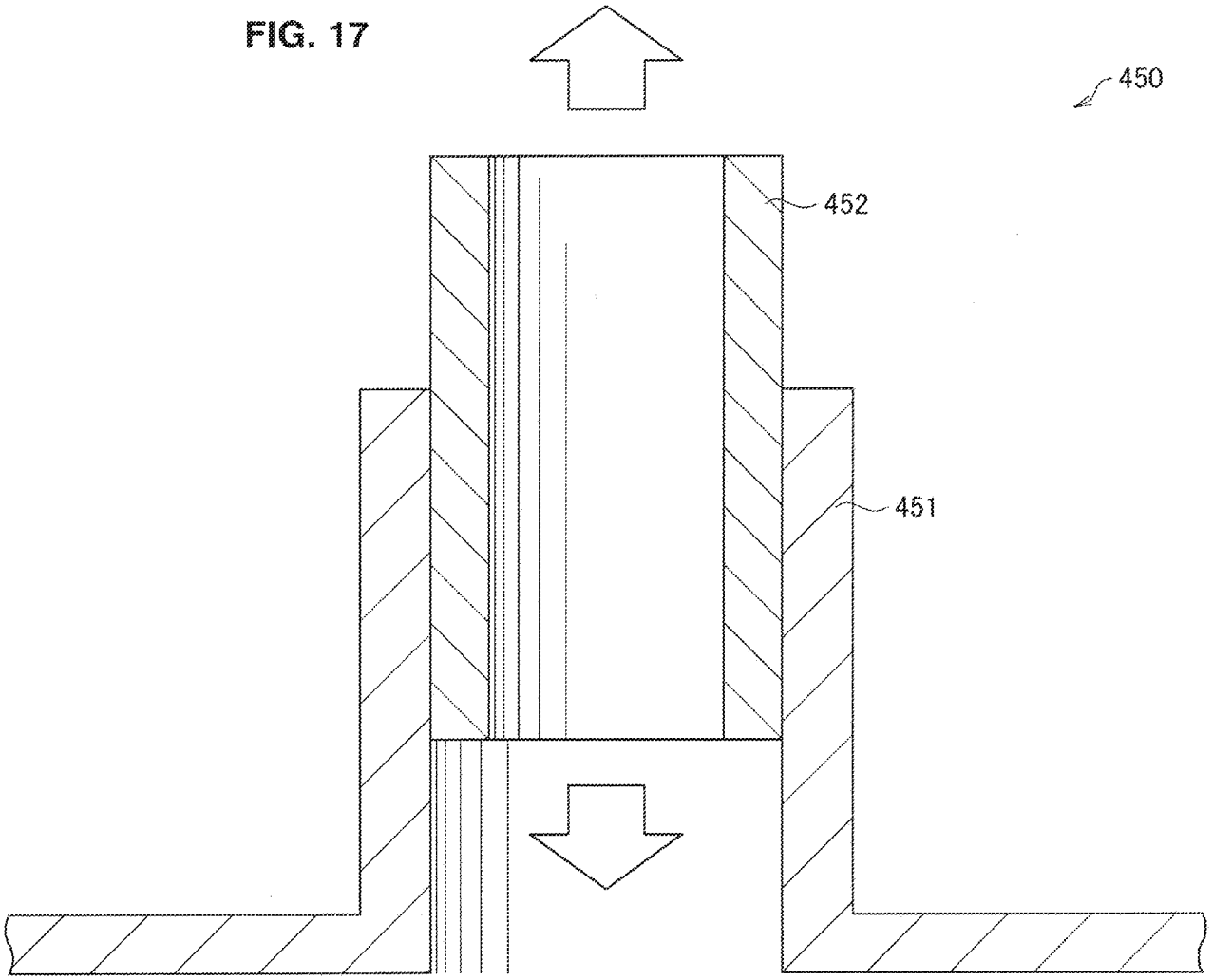
FIG. 17 is an illustrative diagram for describing an acoustic characteristic adjustment mechanism having a mechanism that changes a length and an inner diameter of an acoustic tube.

A configuration example of the acoustic characteristic adjustment mechanism 360 having the mechanism that changes the length and the inner diameter of the acoustic tube 350 will be described with reference to FIG. 17. FIG. 17 is an illustrative diagram for describing the acoustic characteristic adjustment mechanism 360 having the mechanism that changes the length and the inner diameter of the acoustic tube 350.

Referring to FIG. 17, an acoustic tube 450 of the present configuration example is configured such that a second tube 452 is inserted into a first tube 451. Although the illustration of other constituent members is omitted, the acoustic tube 450 spatially connects the rear air chamber 332 of a headphone and the outside through a tube, and has the same function as the acoustic tubes 150, 250, and 350 shown in FIGS. 1, 6, and 12A to 14.

The first tube 451 can be provided projecting toward the outside from a partial region of the partition wall of the housing forming the rear air chamber of the headphone. The second tube 452 is formed such that the outer diameter thereof is a little smaller than the inner diameter of the first tube 451, and is configured to be movable in an insertion direction in a state in which it is inserted into the first tube 451.

When the second tube 452 is inserted into the first tube 451 to a deeper position (when the second tube 452 is moved in the lower direction of the drawing), it can be said that the length of the acoustic tube 450 becomes shorter and the inner diameter thereof becomes smaller. Conversely, when the second tube 452 is moved to be pulled out from the first tube 451 (when the second tube 452 is moved in the upper direction of the drawing), it can be said that the length of the acoustic tube 450 becomes longer and the inner diameter thereof becomes greater.

By moving the second tube 452 in the insertion direction in the present configuration example as described above, the length and the inner diameter of the acoustic tube 450 can be changed, and an acoustic characteristic of the headphone in which the acoustic tube 450 is provided can be adjusted. In the present configuration example, it can be said that an acoustic characteristic adjustment mechanism is provided to be integrated with the acoustic tube 450.

Note that, in the configuration example shown in FIG. 17, the acoustic tube 450 may be configured such that the second tube 452 is externally fitted to the first tube 451. In this case, the second tube 452 can be formed to have an inner diameter that is slightly greater than the outer diameter of the first tube 451, and in a state in which the first tube 451 is inserted into the second tube 452, the second tube 452 at the outside can be movable in the insertion direction. By also setting the second tube 452 to move in the insertion direction in this configuration like the acoustic tube 450 shown in FIG. 17, the length and the inner diameter of the acoustic tube 450 can be changed.

Other configuration examples of the acoustic characteristic adjustment mechanism 360 have been described above. The above-described configuration examples are, however, mere exemplification of several configurations that the acoustic characteristic adjustment mechanism 360 can take, and a configuration of the acoustic characteristic adjustment mechanism 360 is not limited to the above-described configuration examples. The acoustic characteristic adjustment mechanism 360 may have any specific configuration that can change the characteristic of the acoustic tube 350.

6. Supplement

It should be understood by those skilled in the art that various modifications, combinations, sub-combinations and alterations may occur depending on design requirements and other factors insofar as they are within the scope of the appended claims or the equivalents thereof.

In addition, the effects described in the present specification are merely illustrative and demonstrative, and not limitative. In other words, the technology according to the present disclosure can exhibit other effects that are evident to those skilled in the art along with or instead of the effects based on the present specification.

Although, for example, the case in which the headphone according to the present embodiment is a canal earphone has been described above, the present technology is not limited thereto. The headphone according to the present embodiment may be a headphone in another form. For example, the headphone according to the present embodiment may be a so-called overhead headphone that has an air-tightened front air chamber. Here, such overhead headphones are headphones in which one pair of housings that house a driver unit provided with an acoustic tube according to the present embodiment are included and the one pair of housings are linked to each other by a supporting member that curves in an arch shape, and thus the headphones are worn on the head of a user using the supporting member so that openings provided in the housings through which sounds are output to the outside face the ears of the user. It is assumed that, when the headphone according to the present embodiment is an overhead headphone, the sizes of the housings and the driver unit increase more than when it is a canal earphone. In that case, by appropriately changing values of the elements of the acoustic equivalent circuit according to a change in the characteristics of the housings and the driver unit, a shape of the acoustic tube can be designed using the same method as that described above, and the acoustic characteristic can be improved.

In addition, although a member that can serve as a resistive component such as a ventilation resistor is not provided in the acoustic tube according to the present embodiment in above description, the present technology is not limited thereto. The acoustic tube according to the present embodiment may be provided with a ventilation resistor that acts as a resistive component to a flow of air inside the tube. By providing a ventilation resistor in the acoustic tube, a resistive component can be further imparted to the acoustic equivalent circuit shown in FIG. 2, and acoustic characteristics of the headphone may be changed. In the present embodiment, by providing the ventilation resistor in the acoustic tube and appropriately setting a material and a shape of the ventilation resistor, the acoustic characteristic of the headphone may be further adjusted.

Furthermore, other constituent members may be appropriately included in the housing of the headphone according to the present embodiment according to application of the headphone, for example, in addition to the configuration shown in FIG. 6 and FIGS. 12A to 13B. Although the case in which the headphone has only one driver unit has been described above, for example, the present embodiment is not limited thereto. The headphone according to the present embodiment may be, for example, a so-called multi-way headphone in which a plurality of driver units are mounted in a housing. Even if there is a change in constituent members included in the housing in the present embodiment, by appropriately changing elements of the acoustic equivalent circuit or values thereof according to the change, a shape of the acoustic tube can be designed using the same method as that described above.

Additionally, the Present Technology May Also be Configured as Below.

(1) A headphone including:

a driver unit including a vibration plate;

a housing configured to house the driver unit, to form an air-tightened front air chamber of which a part except for an opening for sound output is spatially blocked from the outside on a front side on which the vibration plate of the driver unit is provided, and to form a rear air chamber that has a predetermined capacity on a rear side that is the opposite side to the front side; and an acoustic tube provided in a partial region of a partition wall of the housing that constitutes the rear air chamber and configured to spatially connect the rear air chamber and the outside of the housing through a tube.

(2) The headphone according to (1), wherein, in an acoustic equivalent circuit of the headphone, a parallel resonance circuit that causes anti-resonance in a predetermined resonance frequency is formed at least with an acoustic capacity that corresponds to a capacity component of the rear air chamber and an acoustic inductance that corresponds to an inductance component of the acoustic tube.

(3) The headphone according to (2), wherein the acoustic capacity further includes a capacity component of a driver unit rear air chamber that is formed between a frame and the vibration plate of the driver unit.

(4) The headphone according to (2) or (3), wherein the resonance frequency is decided at least based on a value of the acoustic inductance and a value of the acoustic capacity.

(5) The headphone according to any one of (1) to (4), wherein a vent hole that spatially connects a driver unit rear air chamber that is formed between a frame of the driver unit and the vibration plate and the rear air chamber is provided in the frame, wherein the vent hole is provided with a ventilation resistor that serves as resistance in the acoustic equivalent circuit of the headphone, and wherein a sound pressure level of the headphone in a predetermined frequency band is decided based at least on a value of an acoustic resistance that corresponds to a resistive component of the ventilation resistor in the acoustic equivalent circuit.

(6) The headphone according to (5), wherein the sound pressure level of the headphone in the predetermined frequency band is decided based at least on a value of an acoustic capacity that corresponds at least to a capacity component of the rear air chamber, a value of acoustic tube inductance that corresponds to an inductance component of the acoustic tube in the acoustic equivalent circuit, and a value of the acoustic resistance.

(7) The headphone according to any one of (1) to (6), wherein the rear air chamber is spatially blocked from the outside except for ventilation in the acoustic tube.

(8) The headphone according to (4), wherein the value of the acoustic inductance is decided according to a length and an inner cross-sectional area of the acoustic tube, and wherein the length and the inner cross-sectional area of the acoustic tube are set such that the resonance frequency has a value from 350 (Hz) to 650 (Hz).

(9) The headphone according to (8), wherein, in the acoustic tube, a ratio of the length to the inner cross-sectional area is 13 (1/mm) to 45 (1/mm).

(10) The headphone according to any one of (1) to (9), wherein the housing and the acoustic tube are formed to be integrated.

(11) The headphone according to any one of (1) to (9), wherein an opening that spatially connects the rear air chamber and the outside of the housing is provided in a partial region of a partition wall constituting the rear air chamber of the housing, and wherein the acoustic tube is configured such that a tubular member is connected to the opening.

(12) The headphone according to any one of (1) to (11), wherein the driver unit is a dynamic driver unit.

(13) The headphone according to any one of (1) to (12), wherein a sound guiding tube that is a tubular portion projecting toward the outside is formed in one portion of a region constituting the front air chamber of the housing, wherein the opening for sound output is provided at a tip of the sound guiding tube, and wherein the headphone is a canal earphone of which the tip of the sound guiding tube is inserted into an external auditory canal of a user.

(14) The headphone according to any one of (1) to (12), including:

one pair of housings that house the driver unit, wherein the one pair of housings are linked to each other by a supporting member that curves in an arch shape, and wherein the headphone is an overhead headphone worn on the head of a user using the supporting member so that the opening for sound output of the housing faces an ear of a user.

(15) The headphone according to any one of (1) to (14), further including:

an acoustic characteristic adjustment mechanism configured to adjust an acoustic characteristic of the headphone by changing a characteristic of the acoustic tube.

(16) The headphone according to (15), wherein the acoustic characteristic adjustment mechanism adjusts the acoustic characteristic of the headphone by changing ventilation in the acoustic tube.

(17) The headphone according to (16), wherein the acoustic characteristic adjustment mechanism is constituted by a switch member that has a boss to be inserted into and removed from the acoustic tube, and wherein the boss is inserted into and removed from the acoustic tube through a parallel movement of the switch member, and ventilation in the acoustic tube is adjusted.

(18) The headphone according to (17), wherein at least a partial region of the acoustic tube is formed of an elastic body, and wherein the boss is press-fitted to the region of the acoustic tube that is formed of the elastic body and thereby ventilation in the acoustic tube is obstructed.

(19) The headphone according to (17) or (18), wherein a first projecting part that projects in a radial direction is formed in a partial region of the boss in a longitudinal direction, wherein a second projecting part that projects in the radial direction is formed in a partial region on an inner wall of the acoustic tube in the longitudinal direction, and wherein, when the boss is inserted into and removed from the acoustic tube, the first projecting part and the second projecting part are engaged with and rub against each other.

(20) An acoustic characteristic adjustment method including:

housing a driver unit that includes a vibration plate in a housing, forming an air-tightened front air chamber of which a part except for an opening for sound output is spatially blocked from the outside between the housing and a front side on which the vibration plate of the driver unit is provided, and forming a rear air chamber that has a predetermined capacity on a rear side that is the opposite side to the front side; and providing an acoustic tube provided in a partial region of a partition wall of the housing that constitutes the rear air chamber and configured to spatially connect the rear air chamber and the outside of the housing through a tube.

REFERENCE SIGNS LIST

10, 20, 30 headphone
40 acoustic equivalent circuit
110, 210, 310 driver unit
116, 216, 316 vent hole
117, 217, 317 ventilation resistor
118, 218, 318 driver unit rear air chamber
120, 220, 320 front housing
125, 225, 325 front air chamber
130, 230, 330 rear housing
132, 232, 332 rear air chamber
140, 240, 340 housing
150, 250, 350 acoustic tube
360 acoustic characteristic adjustment mechanism

The invention claimed is:

1. A headphone, comprising:

a driver unit including a vibration plate; and a housing configured to house the driver unit, wherein the vibration plate of the driver unit is present on a first side of the housing, and wherein the housing comprises:

an air tight first air chamber of which a part except for an opening for sound output is spatially blocked from an outside of the housing, wherein the air-tight first air chamber is present on the first side of the housing, a second air chamber on a second side of the housing, wherein the second side of the housing is an opposite side to the first side of the housing; and an acoustic tube present in a partial region of a partition wall of the housing, wherein the housing constitutes the second air chamber, wherein the acoustic tube is configured to spatially connect the second air chamber and the outside of the housing, wherein an acoustic capacity of the headphone is based on a capacity component of the second air chamber and an acoustic inductance of the acoustic tube, wherein a value of the acoustic inductance is determined based on a length of the acoustic tube and an inner cross-sectional area of the acoustic tube, and wherein a ratio of the length of the acoustic tube to the inner cross-sectional area of the acoustic tube is in a range of 13 (1/mm) to 45 (1/mm).

2. The headphone according to claim 1, wherein an acoustic equivalent circuit of the headphone comprises a parallel resonance circuit configured for anti-resonance at a resonance frequency, wherein an acoustic capacity of the parallel resonance circuit corresponds to the capacity component of the second air chamber, and wherein an acoustic inductance of the parallel resonance circuit corresponds to an inductance component of the acoustic tube.

3. The headphone according to claim 1, wherein the acoustic capacity further includes a capacity component of a driver unit air chamber that is between a frame and the vibration plate of the driver unit.

4. The headphone according to claim 2, wherein the resonance frequency is determined at least based on a value of the acoustic inductance of the parallel resonance circuit and a value of the acoustic capacity of the parallel resonance circuit.

5. The headphone according to claim 1, wherein a driver unit air chamber is between a frame of the driver unit and the vibration plate, wherein a vent hole that spatially connects the driver unit air chamber and the second air chamber is present in the frame, wherein the vent hole comprises a ventilation resistor that serves as a resistance in an acoustic equivalent circuit of the headphone, wherein a sound pressure level of the headphone in a frequency band is determined based at least on a value of an acoustic resistance that corresponds to a resistive component of the ventilation resistor in the acoustic equivalent circuit.

6. The headphone according to claim 5, wherein the sound pressure level of the headphone in the frequency band is determined based at least on a value of the acoustic capacity of the headphone, and wherein the acoustic capacity is based on at least one of the capacity component of the second air chamber, a value of the acoustic inductance of the acoustic tube, or a value of the acoustic resistance.

7. The headphone according to claim 1, wherein the second air chamber is spatially blocked from the outside of the housing except for ventilation in the acoustic tube.

8. The headphone according to claim 4, wherein the resonance frequency has a value from 350 (Hz) to 650 (Hz), based on the length of the acoustic tube and the inner cross-sectional area of the acoustic tube.

9. The headphone according to claim 1, wherein the housing is integrated to the acoustic tube.

10. The headphone according to claim 1, wherein an opening that spatially connects the second air chamber and the outside of the housing is present in the partial region of the partition wall, and wherein a tubular member is connected to the opening based on a configuration of the acoustic tube.

11. The headphone according to claim 1, wherein the driver unit is a dynamic driver unit.

12. The headphone according to claim 1, wherein a sound guiding tube is a tubular portion that projects toward the outside of the housing, wherein the sound guiding tube is in one portion of a region that constitutes the air-tight first air chamber of the housing, wherein the opening for sound output is at a tip of the sound guiding tube, and wherein the headphone is a canal earphone of which the tip of the sound guiding tube is inserted into an external auditory canal of a user.

13. The headphone according to claim 1, further comprising:

one pair of housings that house the driver unit, wherein a first housing of the one pair of housings is linked to a second housing of the one pair of housings by a supporting member that curves in an arch shape, wherein the headphone is an overhead headphone worn on a head of a user based on the supporting member, and wherein the opening for sound output of the housing faces an ear of the user.

14. The headphone according to claim 1, further comprising:

an acoustic characteristic adjustment mechanism configured to adjust an acoustic characteristic of the headphone based on a change of a characteristic of the acoustic tube.

15. The headphone according to claim 14, wherein the characteristic of the acoustic tube comprises a ventilation in the acoustic tube.

16. The headphone according to claim 15, wherein the acoustic characteristic adjustment mechanism comprises a switch member that has a boss to insert into and remove from the acoustic tube, and wherein the boss is inserted into and removed from the acoustic tube through a parallel movement of the switch member, to adjust the ventilation in the acoustic tube.

17. The headphone according to claim 16, wherein at least a partial region of the acoustic tube is an elastic body, and wherein the boss is press-fitted to the partial region of the acoustic tube, to obstruct the ventilation in the acoustic tube.

18. The headphone according to claim 16, wherein a first projecting part that projects in a radial direction is in a partial region of the boss in a longitudinal direction, wherein a second projecting part that projects in the radial direction is in the partial region on an inner wall of the acoustic tube in the longitudinal direction, and wherein the first projecting part and the second projecting part are engaged with and rub against each other, based on an insertion of the boss into the acoustic tube and a removal of the boss from the acoustic tube.

19. An acoustic characteristic adjustment method, comprising:

housing a driver unit that includes a vibration plate in a housing, wherein the vibration plate of the driver unit is present on a first side of the housing;

forming an air tight first air chamber of which a part except for an opening for sound output is spatially blocked from an outside of the housing, wherein the air-tight first air chamber is present on the first side of the housing;

forming a second air chamber on a second side of the housing, wherein the second side of the housing is an opposite side to the first side of the housing; and providing an acoustic tube in a partial region of a partition wall of the housing, wherein the housing constitutes the second air chamber, wherein the acoustic tube is configured to spatially connect the second air chamber and the outside of the housing, wherein an acoustic capacity of a headphone is based on a capacity component of the second air chamber and an acoustic inductance of the acoustic tube, wherein a value of the acoustic inductance is determined based on a length of the acoustic tube and an inner cross-sectional area of the acoustic tube, and wherein a ratio of the length of the acoustic tube to the inner cross-sectional area of the acoustic tube is in a range of 13 (1/mm) to 45 (1/mm).

20. A headphone, comprising:

a driver unit that includes a vibration plate; and a housing configured to house the driver unit, wherein the vibration plate of the driver unit is present on a first side of the housing, and wherein the housing comprises:

an air-tight first air chamber of which a part except for an opening for sound output is spatially blocked from an outside of the housing, wherein the air-tight first air chamber is present on the first side of the housing, a second air chamber on a second side of the housing, wherein the second side of the housing is an opposite side to the first side of the housing; and an acoustic tube present in a partial region of a partition wall of the housing, wherein the housing constitutes the second air chamber, wherein the acoustic tube is configured to spatially connect the second air chamber and the outside of the housing, wherein at least a partial region of the acoustic tube is an elastic body, and wherein a boss is press-fitted to the partial region of the acoustic tube, to obstruct a ventilation in the acoustic tube.

21. A headphone, comprising:

a driver unit that includes a vibration plate; and a housing configured to house the driver unit, wherein the vibration plate of the driver unit is present on a first side of the housing, and wherein the housing comprises:

an air-tight first air chamber of which a part except for an opening for sound output is spatially blocked from an outside of the housing, wherein the air-tight first air chamber is present on the first side of the housing, a second air chamber on a second side of the housing, wherein the second side of the housing is an opposite side to the first side of the housing; and an acoustic tube present in a partial region of a partition wall of the housing, wherein the housing constitutes the second air chamber, wherein the acoustic tube is configured to spatially connect the second air chamber and the outside of the housing, wherein a first projecting part that projects in a radial direction is in a partial region of a boss in a longitudinal direction, wherein a second projecting part that projects in the radial direction is in the partial region on an inner wall of the acoustic tube in the longitudinal direction, and wherein the first projecting part and the second projecting part are engaged with and rub against each other, based on an insertion of the boss into the acoustic tube and a removal of the boss from the acoustic tube.

* * * * *